US011280523B2

(12) United States Patent
Sakae et al.

(10) Patent No.: US 11,280,523 B2
(45) Date of Patent: Mar. 22, 2022

(54) REFRIGERATION APPARATUS WITH LEAK DETECTION ON THE USAGE SIDE AND A REFRIGERANT RELEASE MECHANISM

(71) Applicant: DAIKIN INDUSTRIES, LTD., Osaka (JP)

(72) Inventors: Satoru Sakae, Osaka (JP); Takenori Mezaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 171 days.

(21) Appl. No.: 16/485,675

(22) PCT Filed: Feb. 14, 2018

(86) PCT No.: PCT/JP2018/005141
§ 371 (c)(1),
(2) Date: Aug. 13, 2019

(87) PCT Pub. No.: WO2018/151178
PCT Pub. Date: Aug. 23, 2018

(65) Prior Publication Data

US 2019/0390877 A1 Dec. 26, 2019

(30) Foreign Application Priority Data

Feb. 14, 2017 (JP) ..... JP2017-025459

(51) Int. Cl.
*F25B 1/04* (2006.01)
*F25B 49/02* (2006.01)

(52) U.S. Cl.
CPC ..... *F25B 1/04* (2013.01); *F25B 49/02* (2013.01); *F25B 2400/04* (2013.01)

(58) Field of Classification Search
CPC ..... F25B 1/04; F25B 2400/04; F25B 49/02
See application file for complete search history.

(56) References Cited

U.S. PATENT DOCUMENTS 9,915,436 B1 * 3/2018 Feria ..... F25B 47/022
2005/0056031 A1 3/2005 Jeong
(Continued)

FOREIGN PATENT DOCUMENTS

CN 104930655 A 9/2015
JP 1-300170 A 12/1989
(Continued)

OTHER PUBLICATIONS

International Search Report for PCT/JP2018/005141 dated Apr. 24, 2018.

*Primary Examiner* — Henry T Crenshaw
(74) *Attorney, Agent, or Firm* — Birch, Stewart, Kolasch & Birch, LLP

(57) ABSTRACT

Provided is a refrigeration apparatus with improved safety. A refrigeration apparatus includes: a compressor; a heat source-side expansion valve to be controlled to have a minimum opening degree and brought into a closed state in which the heat source-side expansion valve maximizes prevention of a flow of a refrigerant toward a usage-side refrigerant circuit; a fusible plug; a controller; and a refrigerant leak detector configured to detect a refrigerant leak at the usage-side refrigerant circuit. The fusible plug is disposed in a refrigerant circuit, and is brought into an open state to allow the refrigerant circuit to communicate with an external space. When the refrigerant leak detector detects a refrigerant leak at the usage-side refrigerant circuit, the controller performs refrigerant leak first control to bring the heat source-side expansion valve into the closed state, and performs refrigerant leak second control to bring the fusible plug into the open state.

15 Claims, 16 Drawing Sheets

(56) References Cited

U.S. PATENT DOCUMENTS

| | | | | |
|---|---|---|---|---|
| 2009/0288713 | A1* | 11/2009 | Hirakata | F17C 13/026<br>137/14 |
| 2017/0010030 | A1* | 1/2017 | Tanaka | F25B 13/00 |

FOREIGN PATENT DOCUMENTS

| | | | | |
|---|---|---|---|---|
| JP | 5-118720 | A | | 5/1993 |
| JP | 2001-208392 | A | | 9/2001 |
| JP | 2005-530650 | A | | 10/2005 |
| JP | 2007-178026 | | * | 7/2007 |
| JP | 2010-002137 | | * | 1/2010 |
| JP | 2010-2137 | A | | 1/2010 |
| JP | 2010-7998 | A | | 1/2010 |
| JP | 2012-159242 | A | | 8/2012 |
| WO | WO 2017/212599 | A1 | | 12/2017 |

* cited by examiner

REFRIGERATION APPARATUS WITH LEAK DETECTION ON THE USAGE SIDE AND A REFRIGERANT RELEASE MECHANISM

TECHNICAL FIELD

The present disclosure relates to a refrigeration apparatus.

BACKGROUND ART

In a conventional refrigeration apparatus, for example, damage to or faulty installation of a component constituting a refrigerant circuit may cause a refrigerant leak from the refrigerant circuit. Such a refrigeration apparatus therefore requires measures for ensuring safety upon occurrence of a refrigerant leak.

For example, Patent Literature 1 (JP H05-118720 A) discloses the following method as one of the measures against a refrigerant leak. Upon detection of a refrigerant leak, a predetermined control valve (e.g., a valve whose opening degree is controllable, such as an electromagnetic valve or an electric valve) in a refrigerant circuit is controlled to have a minimum opening degree, that is, is brought into a closed state. The control valve thus prevents a flow of the refrigerant toward a usage unit, and suppresses occurrence of an additional refrigerant leak at a usage-side space where the usage unit is placed, such as a residence space or a stock space with people coming and going.

SUMMARY OF THE INVENTION

Technical Problem

A control valve, such as an electromagnetic valve or an electric valve, is incapable of completely blocking a flow of a refrigerant even when being controlled to have a minimum opening degree, that is, even when being brought into a closed state, because of its structure. In other words, the control valve even when being controlled to have the minimum opening degree forms a minute refrigerant flow path (a minute flow path) to allow a flow of a small amount of refrigerant.

As disclosed in Patent Literature 1, consequently, even when the control valve is controlled to have the minimum opening degree upon occurrence of a refrigerant leak, a small amount of refrigerant flows toward the usage unit through the control valve, and then is retained in the usage-side space. In this respect, the usage-side space for the refrigeration apparatus may be a highly airtight space such as the interior of a prefabricated storehouse. In such a situation, if a refrigerant leak occurs at the usage-side unit, the use of the method disclosed in Patent Literature 1 may cause an increase in concentration of the leakage refrigerant in the usage-side space. In other words, the method disclosed in Patent Literature 1 is sometimes incapable of reliably ensuring safety from a refrigerant leak.

Hence, the present disclosure provides a refrigeration apparatus with improved safety.

Solutions to Problem

A first aspect of the present disclosure provides a refrigeration apparatus including a refrigerant circuit that includes a usage-side circuit, for a refrigeration cycle in the refrigerant circuit. The refrigeration apparatus includes a compressor, a first control valve, a refrigerant release mechanism, a controller, and a refrigerant leak detector. The compressor is disposed in the refrigerant circuit. The compressor is configured to compress a refrigerant. The first control valve is disposed upstream of the usage-side circuit with regard to a flow of the refrigerant in the refrigerant circuit. The first control valve is controlled to have a minimum opening degree and is brought into a closed state. The closed state refers to a state in which the first control valve maximizes prevention of the flow of the refrigerant toward the usage-side circuit. The refrigerant release mechanism is disposed in the refrigerant circuit. The refrigerant release mechanism is brought into an open state to allow the refrigerant circuit to communicate with an external space. The controller is configured to control states of the respective components. The refrigerant leak detection unit detector is configured to detect a refrigerant leak at the usage-side circuit by detecting a state of the refrigerant in the usage-side circuit or the refrigerant flowing out of the usage-side circuit. The controller performs first control and second control when the refrigerant leak detector detects a refrigerant leak at the usage-side circuit. The controller performs the first control to bring the first control valve into the closed state. The controller performs the second control to bring the refrigerant release mechanism into the open state.

In the refrigeration apparatus according to the first aspect of the present disclosure, the refrigerant leak detector detects a refrigerant leak at the usage-side circuit. When the refrigerant leak detector detects the refrigerant leak at the usage-side circuit, the controller performs the first control to bring the first control valve into the closed state. With this configuration, upon occurrence of a refrigerant leak, the refrigerant leak detector detects the refrigerant leak, and the controller brings into the closed state the first control valve disposed upstream of the usage-side circuit with regard to the flow of the refrigerant. This configuration consequently prevents the flow of the refrigerant toward the usage-side circuit upon occurrence of a refrigerant leak.

In addition, when the refrigerant leak detector detects a refrigerant leak at the usage-side circuit, the controller performs the second control to bring the refrigerant release mechanism into the open state. With this configuration, the refrigerant release mechanism is brought into the open state upon occurrence of a refrigerant leak. Consequently, upon occurrence of a refrigerant leak, the refrigerant release mechanism is brought into the open state to release the refrigerant in the refrigerant circuit from the refrigerant circuit. This configuration thus further prevents the flow of the refrigerant toward the usage-side circuit.

This configuration therefore more reliably suppresses occurrence of an additional refrigerant leak at the space where the usage-side circuit is disposed, that is, the usage-side space. This configuration thus improves the safety of the refrigeration apparatus.

Examples of the refrigerant used herein may include, but not limited to, a slightly combustible refrigerant such as R32, and $CO_2$.

Examples of the refrigerant leak detector used herein may include: a refrigerant leak sensor configured to directly detect a refrigerant that leaks out of the refrigerant circuit (hereinafter, referred to as a leakage refrigerant as appropriate); and a pressure sensor or a temperature sensor configured to detect a state, such as a pressure or a temperature, of the refrigerant in the refrigerant circuit.

The first control valve used herein is not limited as long as it is a valve whose opening degree is controllable. Examples of the first control valve may include an electromagnetic valve and an electric valve.

The refrigerant release mechanism used be herein refers to a mechanism to be brought into the open state to allow the refrigerant circuit to communicate with the external space. The refrigerant release mechanism is not limited as long as it is a mechanism to be brought into the open state when the refrigerant leak detection unit detects a refrigerant leak at the usage-side circuit. Examples of the refrigerant release mechanism may include a fusible plug, and an electromagnetic valve or an electric valve such as an electronic expansion valve.

A second aspect of the present disclosure provides the refrigeration apparatus according to the first aspect, further including a heating unit. The refrigerant release mechanism is a fusible plug that melts by heat at a predetermined first temperature or more so as to be brought into the open state. The heating unit is configured to directly or indirectly apply heat to the fusible plug. The controller performs the second control to cause the heating unit to apply heat to the fusible plug to the first temperature.

With this configuration, upon occurrence of a refrigerant leak, the heating unit is controlled to apply heat to the fusible plug to the first temperature. Consequently, upon occurrence of a refrigerant leak, the fusible plug is brought into the open state to release the refrigerant in the refrigerant circuit from the refrigerant circuit. This configuration thus further prevents the flow of the refrigerant toward the usage-side circuit.

The heating unit used herein is not limited as long as it applies heat to the fusible plug. Examples of the heating unit may include an electric heater, and a refrigerant pipe through which a hot gas refrigerant applying heat to the fusible plug flows.

A third aspect of the present disclosure provides the refrigeration apparatus according to the second aspect, further including a high-pressure refrigerant pipe and a second control valve. The high-pressure refrigerant pipe allows a flow of the high-pressure hot gas refrigerant discharged from the compressor. The second control valve is brought into a first state to allow the compressor to communicate with the high-pressure refrigerant pipe. The controller performs the second control to drive the compressor and to bring the second control valve into the first state such that the high-pressure refrigerant pipe functions as the heating unit.

With this configuration, the refrigerant pipe in the refrigerant circuit, that is, the high-pressure refrigerant pipe functions as the heating unit. This configuration consequently enables the heating unit with a simple structure. This configuration thus improves flexibility and suppresses an increase in cost.

A fourth aspect of the present disclosure provides the refrigeration apparatus according to the second or third aspect, further including an electric heater. The electric heater is brought into a heating state by energization. The heating state refers to a state in which the electric heater generates heat. The controller performs the second control to bring the electric heater into the heating state such that the electric heater functions as the heating unit.

With this configuration, a typical electric heater functions as the heating unit. This configuration consequently enables the heating unit with a simple structure. This configuration therefore improves flexibility and suppresses an increase in cost.

A fifth aspect of the present disclosure provides the refrigeration apparatus according to any of the second to fourth aspects, further including a heating temperature detector. The heating temperature detector is configured to detect a temperature of the heating unit. The controller performs the second control to control a state of the heating unit, based on a value detected by the heating temperature detector.

With this configuration, the controller performs the second control to control the state of the heating unit in accordance with the value detected by the heating temperature detector. The controller consequently performs the second control to set the heating unit at a target temperature in accordance with a situation. The heating unit thus accurately applies heat to the fusible plug to the first temperature. This configuration thus further improves the safety.

A sixth aspect of the present disclosure provides the refrigeration apparatus according to any of the second to fifth aspects, further including a fusible plug temperature detector and an output unit. The fusible plug temperature detector is configured to detect a temperature of the fusible plug. The output is configured to output predetermined notification information. The controller causes the output unit to output the notification information when the refrigerant leak detector detects no refrigerant leak at the usage-side circuit and the fusible plug temperature detector detects that the temperature of the fusible plug is equal to or more than a second temperature. The second temperature is lower than the first temperature.

With this configuration, upon occurrence of no refrigerant leak, when the temperature of the fusible plug is equal to or more than the second temperature, the output outputs the notification information. Consequently, an administrator grasps a situation in which the fusible plug malfunctions or may malfunction, and then takes predetermined measures against the situation. This configuration therefore suppresses a decrease in reliability and also suppresses an increase in cost for repair work or corrective maintenance, in relation to unnecessary release of the refrigerant from the refrigerant circuit.

A seventh aspect of the present disclosure provides the refrigeration apparatus according to any of the second to fifth aspects, further including a fusible plug temperature detector. The fusible plug temperature detector is configured to detect a temperature of the fusible plug. The controller performs third control when the refrigerant leak detector detects no refrigerant leak at the usage-side circuit and the fusible plug temperature detector detects that the temperature of the fusible plug is equal to or more than a second temperature. The second temperature is lower than the first temperature. The controller performs the third control to restrict the temperature of the fusible plug to a temperature less than the first temperature by controlling the states of the respective components.

With this configuration, upon occurrence of no refrigerant leak, when the temperature of the fusible plug is equal to or more than the second temperature, the controller restricts the temperature of the fusible plug to a temperature less than the first temperature, and suppresses release of the refrigerant from the refrigerant circuit. This configuration therefore suppresses a decrease in reliability and also suppresses an increase in cost for repair work or corrective maintenance, in relation to unnecessary release of the refrigerant from the refrigerant circuit.

An eighth aspect of the present disclosure provides the refrigeration apparatus according to any of the second to fifth aspects, further including a fusible plug temperature detector and a third control valve. The fusible plug temperature detector is configured to detect a temperature of the fusible plug. The third control valve is disposed in the refrigerant circuit. The third control valve is configured to control a flow rate of the refrigerant flowing toward the fusible plug, in accordance with an opening degree thereof. The controller minimizes the opening degree of the third control valve when the refrigerant leak detector detects no refrigerant leak at the usage-side circuit and the fusible plug temperature detector detects that the temperature of the fusible plug is equal to or more than a second temperature. The second temperature is lower than the first temperature.

With this configuration, upon occurrence of no refrigerant leak, when the temperature of the fusible plug is equal to or more than the second temperature, the controller minimizes the opening degree of the third control valve to prevent a flow of the refrigerant toward the fusible plug. Consequently, this configuration suppresses release of the refrigerant from the refrigerant circuit when the fusible plug malfunctions or may malfunction. This configuration therefore suppresses a decrease in reliability and also suppresses an increase in cost for repair work or corrective maintenance, in relation to unnecessary release of the refrigerant from the refrigerant circuit.

A ninth aspect of the present disclosure provides the refrigeration apparatus according to any of the first to eighth aspects, further including a heat exchanger and a fan. The fan is configured to provide an air flow. The heat exchanger is disposed between a discharge pipe for the compressor and the refrigerant release mechanism in the refrigerant circuit. The heat exchanger is configured to function as a radiator for the refrigerant by causing the refrigerant to exchange heat with the air flow. The controller performs the second control to stop the fan.

With this configuration, the controller performs the second control to stop the fan and to suppress heat radiation from or condensation of the refrigerant in the heat exchanger. Consequently, the controller performs the second control to supply the high-pressure hot gas refrigerant to the high-pressure refrigerant pipe in a shorter time and to promptly increase the temperature of the refrigerant release mechanism to the first temperature. This configuration thus further improves the safety.

A tenth aspect of the present disclosure provides the refrigeration apparatus according to any of the first to ninth aspects, further including a second fan. The second fan is configured to provide a second air flow. The second air flow is directed to the external space from a space where the refrigerant release mechanism is disposed. The controller drives the second fan after completion of the second control.

With this configuration, the second fan is driven to provide the second air flow after completion of the second control. This configuration consequently promotes release of the refrigerant to the external space through the refrigerant release mechanism. This configuration therefore suppresses occurrence of a situation in which the refrigerant flows out of the refrigerant release mechanism at a hazardous concentration in the space where the refrigerant release mechanism is disposed. This configuration thus further improves the safety.

An eleventh aspect of the present disclosure provides the refrigeration apparatus according to any of the first to tenth aspects, wherein the controller performs the second control after completion of the first control.

With this configuration, upon occurrence of a refrigerant leak, the controller brings the first control valve into the closed state to suppress the refrigerant leak at the usage-side space, and performs a predetermined process before bringing the refrigerant release mechanism into the open state, that is, before releasing the refrigerant from the refrigerant circuit. For example, the controller performs a refrigerant recovery operation to recover the refrigerant into a predetermined reservoir, before bringing the refrigerant release mechanism into the open state. When the refrigerant leak detector detects the refrigerant leak, the controller outputs notification information to the administrator or makes a decision as to whether the refrigerant leak detector erroneously detects the refrigerant leak, before releasing the refrigerant from the refrigerant circuit. In addition, when the refrigerant leak detector detects the refrigerant leak, the controller ensures a grace for ascertaining whether the refrigerant leak detector erroneously detects the refrigerant leak, before releasing the refrigerant from the refrigerant circuit. This configuration thus improves convenience.

A twelfth aspect of the present disclosure provides the refrigeration apparatus according to any of the first to eleventh aspects, further including a refrigerant reservoir. The refrigerant reservoir is disposed in the refrigerant circuit. The refrigerant reservoir is configured to hold the refrigerant. The controller performs the first control to drive the compressor and to recover the refrigerant into the refrigerant reservoir.

With this configuration, upon occurrence of a refrigerant leak, the controller recovers the refrigerant into the refrigerant reservoir. This configuration therefore further prevents the flow of the refrigerant toward the usage-side space. This configuration also enables effective release of the refrigerant from the refrigerant circuit through the refrigerant release mechanism.

A thirteenth aspect of the present disclosure provides the refrigeration apparatus according to any of the first to twelfth aspects, wherein the controller performs the second control after a lapse of a first time from completion of the first control. The first time is calculated based on an amount of the refrigerant passing through the first control valve brought into the closed state, in accordance with a characteristic of the first control valve. The first time is set to a length that the refrigerant leaks at a concentration of a predetermined value in the usage-side space where the usage-side circuit is disposed.

With this configuration, upon occurrence of a refrigerant leak, the controller brings the first control valve into the closed state and, after the lapse of the first time, performs the second control. Consequently, upon occurrence of a refrigerant leak, the controller delays the release of the refrigerant from the refrigerant circuit through the refrigerant release mechanism, until the concentration of the refrigerant takes a hazardous value such as the predetermined value in the usage-side space. Specifically, upon occurrence of a refrigerant leak, the controller performs a predetermined process until the lapse of the first time during which the safety is ensured, without releasing the refrigerant from the refrigerant circuit through the refrigerant release mechanism. For example, the controller performs the refrigerant recovery operation to recover the refrigerant into the predetermined reservoir, before the lapse of the first time, that is, before bringing the refrigerant release mechanism into the open state. In addition, when the refrigerant leak detector detects a refrigerant leak, the controller outputs notification information to the administrator or makes a decision as to whether the refrigerant leak detector erroneously detects the refrigerant leak, before the lapse of the first time, that is, before releasing the refrigerant from the refrigerant circuit.

In addition, when the refrigerant leak detector detects the refrigerant leak, the controller ensures a grace for ascertaining whether the refrigerant leak detector erroneously detects the refrigerant leak, before releasing the refrigerant from the refrigerant circuit.

The predetermined value used herein is appropriately set in accordance with, for example, a type of the refrigerant in the refrigerant circuit, design specifications, and installation environments. For example, the predetermined value is set at a value equivalent to one-fourth of a lower flammable level (LFL) or oxygen deficiency permissible value.

A fourteenth aspect of the present disclosure provides the refrigeration apparatus according to any of the first to thirteenth aspects, wherein the refrigerant leak detector detects a concentration of the refrigerant leaking out of the usage-side circuit. The refrigerant leak detector outputs a detection signal to the controller. The detection signal identifies the concentration of the refrigerant detected by the refrigerant leak detector. The controller performs the first control when the concentration of the refrigerant based on the detection signal takes a value equal to or more than a first reference value. The controller performs the second control when the concentration of the refrigerant based on the detection signal takes a value equal to or more than a second reference value. The second reference value is larger than the first reference value.

With this configuration, the controller performs the first control and the second control in a stepwise manner in accordance with the concentration of the leakage refrigerant detected by the refrigerant leak detector. Specifically, when the concentration of the refrigerant detected by the refrigerant leak detector takes a less hazardous value such as the first reference value, the controller performs the first control to bring the first control valve into the closed state and to suppress occurrence of an additional refrigerant leak at the usage-side space. Moreover, the controller does not perform the second control, thereby holding the release of the refrigerant from the refrigerant circuit through the refrigerant release mechanism.

On the other hand, when the concentration of the refrigerant detected by the refrigerant leak detector takes a considerably hazardous value such as the second reference value, the controller performs, in addition to the first control, the second control to release the refrigerant from the refrigerant circuit through the refrigerant release mechanism. On the assumption that the concentration of the leakage refrigerant is very hazardous, this configuration further suppresses the flow of the refrigerant toward the usage-side circuit, and further suppresses an increase in concentration of the refrigerant in the usage-side space.

This configuration therefore ensures the safety upon occurrence of a refrigerant leak, and suppresses an increase in cost for repair work or corrective maintenance, in relation to less necessary release of the refrigerant from the refrigerant circuit by the second control.

Each of the first reference value and the second reference value is appropriately set in accordance with, for example, a type of the refrigerant in the refrigerant circuit, design specifications, and installation environments. For example, the first reference value is set at a value from which it is assumed that a refrigerant leak occurs. The second reference value is set at a value equivalent to one-fourth of an LFL or oxygen deficiency permissible value.

A fifteenth aspect of the present disclosure provides the refrigeration apparatus according to any of the first to fourteenth aspects, further including a refrigerant state sensor and an erroneous detection decision unit. The refrigerant state sensor is configured to detect a state of the refrigerant in the refrigerant circuit. The erroneous detection decision unit is configured to make a decision as to whether the refrigerant leak detector erroneously detects a refrigerant leak, based on a value detected by the refrigerant state sensor. The controller performs the second control when the erroneous detection decision unit detector decides that the refrigerant leak detector correctly detects a refrigerant leak.

Upon occurrence of erroneous detection by the refrigerant leak detector, this configuration suppresses occurrence of a situation in which the controller performs the second control to release the refrigerant from the refrigerant circuit. This configuration therefore suppresses an increase in cost for repair work or corrective maintenance in relation to unnecessary release of the refrigerant from the refrigerant circuit by the second control.

A sixteenth aspect of the present disclosure provides the refrigeration apparatus according to any of the first to fifteenth aspects, wherein the refrigerant circuit includes a plurality of the usage-side circuits. The refrigerant release mechanism and a plurality of the first control valves are disposed upstream of each usage-side circuit with regard to the flow of the refrigerant. This configuration therefore sore reliably ensures the safety even when the refrigerant circuit includes the plurality of usage-side circuits.

Specifically, the refrigerant circuit including a plurality of usage-side circuits is larger than the refrigerant circuit including a single usage-side circuit in regard to an amount of refrigerant in each refrigerant circuit. In addition, the refrigerant circuit including plurality of usage-side circuits is particularly larger than the refrigerant circuit including a single usage-side circuit in regard to an amount of leakage refrigerant upon occurrence of a refrigerant leak. As to the refrigerant circuit including a plurality of usage-side circuits, therefore, the refrigerant may more frequently leak at a hazardous concentration in the usage-side space. In addition, the refrigerant circuit including a plurality of usage-side circuits requires much more measures for ensuring the safety. In the refrigeration apparatus according to the fifteenth aspect, at least two first control valves are disposed upstream of each usage-side circuit with regard to the flow of the refrigerant to prevent the flow of the refrigerant toward the usage-side refrigerant circuit. This configuration thus more reliably ensures the safety upon occurrence of a refrigerant leak. In particular, upon occurrence of a refrigerant leak, this configurator suppresses occurrence of a situation in which the refrigerant leaks at a hazardous concentration in the usage-side space even when the usage-side space is left in a hermetically closed state for a long period of time.

DESCRIPTION OF EMBODIMENTS

A refrigeration apparatus 100 according to an embodiment of the present disclosure will be described below with reference to the drawings. It should be noted that the following embodiment is merely a specific example, does not intend to limit the technical scope, and may be appropriately it without departing from the gist.

(1) Refrigeration Apparatus 100

Figure 1:
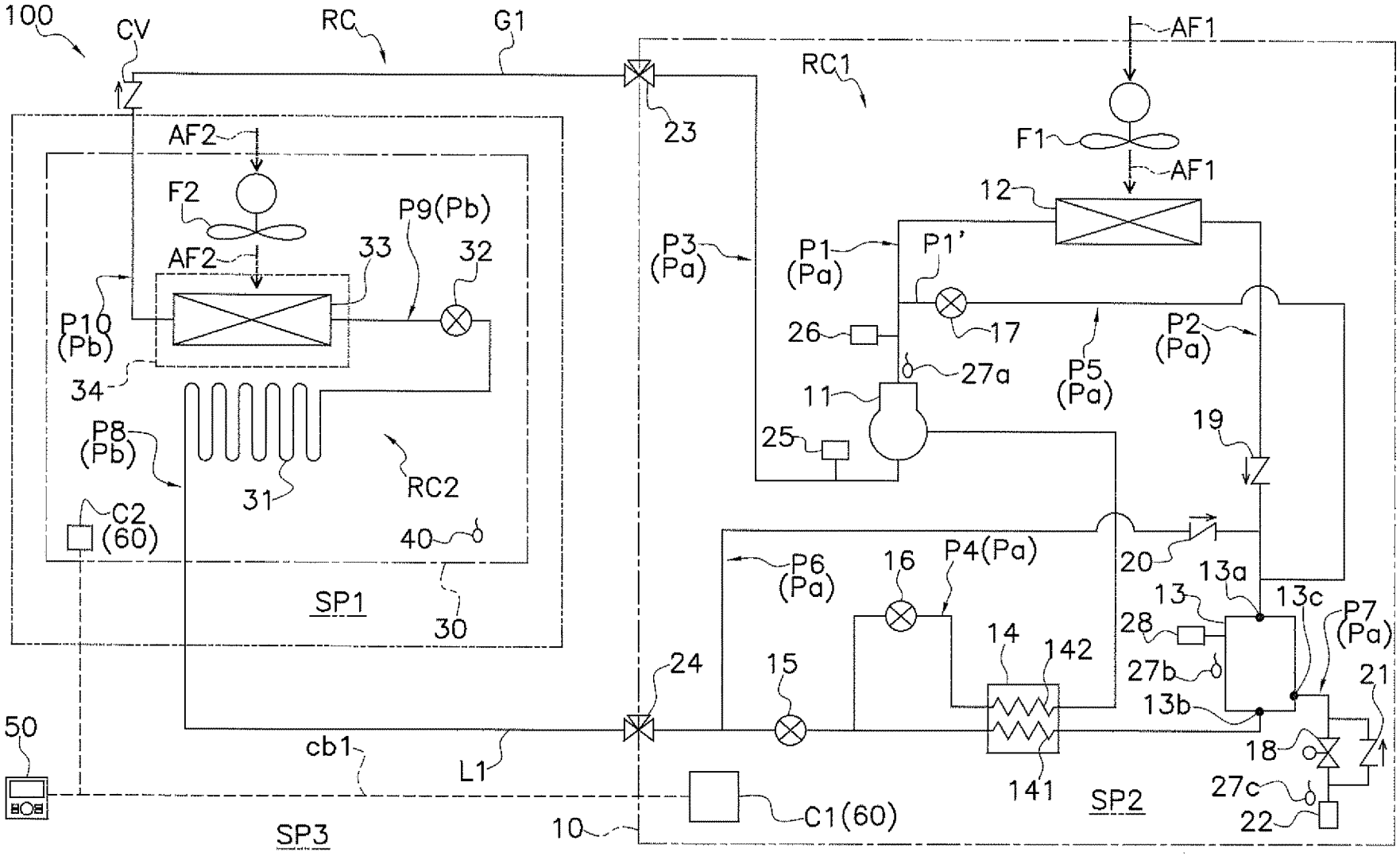
FIG. 1 is a schematic configuration diagram of a refrigeration apparatus according to an embodiment of the present disclosure.

FIG. 1 is a schematic configuration diagram of a refrigeration apparatus 100 according to an embodiment of the present disclosure. The refrigeration apparatus 100 is a low-temperature refrigeration apparatus that employs a vapor compression refrigeration cycle to cool a usage-side space SP1 such as the interior of a prefabricated storage house, the interior of a refrigerated warehouse, the interior of a container for transportation, or the interior of a showcase in a store. The refrigeration apparatus 100 mainly includes: a heat source unit 10; a usage unit 30; a liquid-side connection pipe L1 and a gas-side connection pipe G1; a refrigerant leak sensor 40 configured to detect a refrigerant leak at the usage unit 30; a remote controller 50 serving as an input device and a display device; and a controller 60 configured to control operation of the refrigeration apparatus 100.

In the refrigeration apparatus 100, the heat source unit 10 and the usage unit 30 are connected to each other via the liquid-side connection pipe L1 and the gas-side connection pipe G1 to constitute a refrigerant circuit RC. The refrigeration apparatus 100 performs a refrigeration cycle to compress, cool or condense, decompress, heat or evaporate, and then compress again a refrigerant in the refrigerant circuit RC. In this embodiment, the refrigerant circuit RC is filled with slightly combustible R32 as a refrigerant for a vapor compression refrigeration cycle.

(1-1) Heat Source Unit 10

The heat source unit 10 is connected to the usage unit 30 via the liquid-side connection pipe L1 and the gas-side connection pipe G1, and constitutes a part of the refrigerant circuit RC, that is, a heat source-side refrigerant circuit RC1. The heat source unit 10 includes, as components constituting the heat source-side refrigerant circuit RC1, a plurality of refrigerant pipes Pa, a compressor 11, a heat source-side heat exchanger 12, a receiver 13, a subcooler 14, a heat source-side expansion valve 15, an injection valve 16, a hot gas bypass valve 17, a backup valve 18, a first check valve 19, a second check valve 20, a third check valve 21, a fusible plug 22 (corresponding to a refrigerant release mechanism in the claims), a gas-side shutoff valve 23, and a liquid-side shutoff valve 24.

The refrigerant pipes Pa of the heat source unit 10 include a first gas-side refrigerant pipe P1 connecting a discharge side of the compressor 11 to a gas-side port of the heat source-side heat exchanger 12. The first gas side refrigerant pipe P1 corresponds to a discharge pipe for the compressor 11, that is, a pipe through which the high-pressure hot gas refrigerant discharged from the compressor flows. The first gas-side refrigerant pipe P1 includes a branch pipe P1' branching off a middle of the first gas-side refrigerant pipe P1. The branch pipe P1' is connected to the hot gas bypass valve 17.

The refrigerant pipes Pa also include a liquid-side refrigerant pipe P2 connecting a liquid-side port of the heat source-side heat exchanger 12 to the liquid-side shutoff valve 24.

The refrigerant pipes Pa also include a second gas-side refrigerant pipe P3 connecting a suction side of the compressor 11 to the gas-side shutoff valve 23. The second gas-side refrigerant pipe P3 corresponds to a suction pipe for the compressor 11.

The refrigerant pipes Pa also include an injection pipe P4 configured to shunt part of the refrigerant flowing through the liquid-side refrigerant pipe P2 back to the compressor 11. The injection pipe P4 branches off the liquid-side refrigerant pipe P2 at a position downstream of the subcooler 14, passes through the subcooler 14, and is connected to a middle of a compression process in the compressor 11.

The refrigerant pipes Pa also include a hot gas pipe P5 (corresponding to a high-pressure refrigerant pipe in the claims) configured to divert to a predetermined destination the high-pressure hot gas refrigerant (hot gas) discharged from compressor 11. In this embodiment, the hot gas pipe P5 has a first end connected to the hot gas bypass valve 17 disposed on the first gas-side refrigerant pipe P1, and a second end connected to the liquid-side refrigerant pipe P2 at a position upstream of the receiver 13 with regard to a flow of the refrigerant, more specifically at a position between the first check valve 19 and the receiver 13.

The refrigerant pipes Pa also include a bypass pipe P6 configured to divert to the receiver 13 the refrigerant passing through the heat source-side expansion valve 15. The pipe has a first end connected to the liquid-side refrigerant pipe P2 at a position downstream of the heat source-side expansion valve 15 with regard to the flow of the refrigerant, more specifically at a position between the liquid-size shutoff valve 24 and the heat source-side expansion valve 15. The pipe also has a second end connected to the liquid-side refrigerant pipe P2 at a position upstream of the receiver 13 with regard to the flow of the refrigerant, more specifically at a position between the first cheek valve 19 and the receiver 13.

The refrigerant pipes Pa also include a fusible plug mount pipe P7 connected to the receiver 13. The fusible plug mount pipe P7 has a first end connected to a bypass port 13*c* (to be described later) of the receiver 13, and a second end connected to the fusible plug 22. More specifically, the fusible plug mount pipe P7 includes a main pipe on which the backup valve 18 is disposed, and a branch pipe connecting a portion closer to the receiver 13 with respect to the backup valve 18 to a portion closer to the fusible plug 22 with respect to the backup valve 18. The third check valve 21 is disposed on the branch pipe of the fusible plug mount pipe P7. The fusible plug 22 is connected to the main pipe of the fusible plug mount pipe P7.

In practice, the refrigerant pipes Pa (P1 to P7) may be configured with a single pipe or may be configured with a plurality of pipes connected via joints or the like.

The compressor 11 is a device configured to change by compression a low-pressure refrigerant to a high-pressure refrigerant in the refrigeration cycle. The compressor 11 used in this embodiment is a closed compressor in which a displacement, such as rotary or scroll, compression element (not illustrated) is driven to rotate by a compressor motor (not illustrated). The compressor motor has an operating frequency controllable by an inverter, and controlling the operating frequency enables capacity control for the compressor 11.

The heat source-side heat exchanger 12 (corresponding to a heat exchanger in the claims) functions as a condenser or a radiator for the high-pressure refrigerant in the refrigeration cycle. The heat source-side heat exchanger 12 includes a plurality of heat transfer tubes and a plurality of heat transfer fins (not illustrated). The heat source-side heat exchanger 12 is configured to cause the refrigerant in each of the heat transfer tubes to exchange heat with air (a heat source-side air flow AF1 to be described later) passing around the heat transfer tubes or heat transfer fins. The heat source-side heat exchanger 12 is disposed between the discharge side of, that is, the first gas-side refrigerant pipe P1 for the compressor 11 and the liquid-side refrigerant pipe P2. In other words, the heat source-side heat exchanger 12 is disposed between the discharge pipe for the compressor 11 and the fusible plug 22.

The receiver 13 (corresponding to a refrigerant reservoir in the claims) temporarily stores therein the refrigerant condensed in the heat source-side heat exchanger 12. The receiver 13 is disposed on the liquid-side refrigerant pipe P2. The receiver 13 has a volumetric capacity capable of holding a surplus refrigerant in accordance with the amount of refrigerant in the refrigerant circuit RC. The refrigerant flows into the receiver 13 through an inlet 13*a* of the receiver 13, and flows out of the receiver 13 through an outlet 13*b* of the receiver 13. The receiver 13 has the bypass port 13*c* to which the fusible plug mount pipe P7 is connected.

The subcooler 14 is a heat exchanger for further cooling the refrigerant temporarily stored in the receiver 13. The subcooler 14 is disposed on the liquid side refrigerant pipe P2 at a position downstream of the receiver 13. The subcooler 14 includes: a first flow path 141 through which the refrigerant flowing through the liquid-side refrigerant pipe P2 passes; and a second flow path 142 through which the refrigerant flowing through the injection pipe P4 passes. The subcooler 14 causes the refrigerant flowing through the first flow path 141 to exchange heat with the refrigerant flowing through the second flow path 142.

The heat source-side expansion valve 15 (corresponding to a first control valve in the claims) is an electric expansion valve whose opening degree is controllable. The heat source-side expansion valve 15 is disposed on the liquid-side refrigerant pipe P2 at a position downstream of the subcooler 14. The heat source-side expansion valve 15 is controlled to have the minimum opening degree, and is brought into a closed state in which the heat source-side expansion valve 15 maximizes the prevention of a flow of the refrigerant toward the downstream circuit. The heat source-side expansion valve 15 is disposed upstream of a usage-side refrigerant circuit RC2 (to be described later) with regard to the flow of the refrigerant.

The injection valve 16 is disposed on the injection pipe P4 at a position leading to an inlet of the subcooler 14. The injection valve 16 is an electric expansion valve whose opening degree is controllable. The injection valve 16 decompresses, in accordance with an opening degree thereof, the refrigerant flowing through the injection pipe P4 at a position upstream of the inlet and outlet of the subcooler 14, that is, the second flow path 142. As described above, the subcooler 14 is configured to cool the refrigerant temporarily stored in the receiver 13, with the refrigerant that is shunted from the liquid-side refrigerant pipe P2 via the injection pipe P4.

The hot gas bypass valve 17 (corresponding to a second control valve in the claims) has a first end connected to the branch pipe P1' of the first gas-side refrigerant pipe P1, and a second end connected to the hot gas pipe P5. The hot gas bypass valve 17 is an electric expansion valve whose opening degree is controllable. The hot gas bypass valve 17 adjusts a flow rate of the refrigerant passing through the hot gas pipe P5, in accordance with an opening degree thereof. The hot gas bypass valve 17 is brought into an open state (corresponding to a first state in the claims) to allow the discharge side of, that is, the first gas-side refrigerant pipe P1 for the compressor 11 to communicate with the hot gas pipe P5, so that the hot gas discharged from the compressor 11 is diverted to the receiver 13 via the hot gas pipe P5.

The backup valve 18 (corresponding to a third control valve in the claims) controls a flow rate of the refrigerant flowing toward the fusible plug 22, in accordance with an opening degree thereof. The backup valve 18 is an electromagnetic valve whose fully open state and fully closed state are switchable by switching of a drive voltage. The backup valve 18 is disposed on the main pipe of the fusible plug mount pipe P7. When the backup valve 18 is opened, the refrigerant is supplied from the receiver 13 to the fusible plug 22.

The first check valve 19 is disposed on the liquid-side refrigerant pipe P2. More specifically, the first check valve 19 is disposed upstream of the receiver 13 with regard to the flow of the refrigerant, on the outlet side of the heat source-side heat exchanger 12. The first check valve 19 permits a flow of the refrigerant from the outlet of the heat source-side heat exchanger 12, and interrupts a flow of the refrigerant from the receiver 13.

The second check valve 20 is disposed on the bypass pipe P6. The second check valve 20 permits a flow of the refrigerant from its first end, that is, from the heat source-side expansion valve 15, and interrupts a flow of the refrigerant from its second end, that is, from the receiver 13.

The third check valve 21 is disposed on the branch pipe of the fusible plug mount pipe P7. The third check valve 21 permits a flow of the refrigerant from its first end, that is, from the portion closer to the fusible plug 22 with respect to the backup valve 18, and interrupts a flow of the refrigerant from its second end, that is, from the portion closer to the receiver 13 with respect to the backup valve 18.

The fusible plug 22 is a known fusible plug that melts by heat (e.g., a fusible plug that is typically employed as a safeguard such as a pressure vessel in the related art). For example, the fusible plug 22 is a screw-shaped part having a through hole filled with a low melting point metal. For example, the low melting point metal may be, but not limited to, an alloy of 63.5% by mass of indium, 35% by mass of bismuth, 0.5% by mass of tin, and 1.0% of antimony. When predetermined heating means applies heat to the fusible plug 22 to a predetermined first temperature Te1 or more, the low melting point metal melts, so that the fusible plug 22 is brought into the open state in which a fluid passes through the through hole.

In this embodiment, the fusible plug 22 is coupled to the receiver 13. The fusible plug 22 is brought into the open state to allow the refrigerant circuit RC to communicate with the external space, so that the refrigerant in the receiver 13 flows out of the refrigerant circuit RC through the fusible plug 22 via the fusible plug mount pipe P7. In other words, the fusible plug 22 in the open state releases the refrigerant from the refrigerant circuit RC.

In this embodiment, the fusible plug 22 has an operating temperature (i.e., the first temperature Te1 at which the low melting point metal melts) set at a value larger than the maximum value of the temperature of the refrigerant in the receiver 13, the maximum value being assumed in a normal operation and at an operation stop. The operating temperature is also set at a value equal to or less than a discharge temperature at the compressor 11 in a predetermined circulation amount of the refrigerant. In this embodiment, the fusible plug 22 may be brought into the open state when the hot gas discharged from the compressor 11 is diverted to the receiver 13. A filter (not illustrated) is disposed on the refrigerant circuit RC to capture the melted low melting point metal in the fusible plug 22 brought into the open state.

The gas-side shutoff valve 23 is a manual valve disposed at a joint between the second gas-side refrigerant pipe P3 and the gas-side connection pipe G1. The gas-side shutoff valve 23 has a first end connected to the second gas-side refrigerant pipe P3, and a second end connected to the gas-side connection pipe G1.

The liquid-side shutoff valve 24 is a manual valve disposed at a joint between the liquid-side refrigerant pipe P2 and the liquid-side connection pipe L1. The liquid-side shutoff valve 24 has a first end connected to the liquid-side refrigerant pipe P2, and a second end connected to the liquid-side connection pipe L1.

The heat source unit 10 also includes a heat source-side fan F1 (corresponding to a fan and a second fan in the claims) configured to provide a heat source-side air flow AF1 passing through the heat source-side heat exchanger 12 in a heat source-side space SP2. The heat source-side fan F1 is configured to supply to the heat source-side heat exchanger 12 the heat source-side air flow AF1 for cooling the refrigerant flowing through the heat source-side heat exchanger 12. The heat source-side air flow AF1 (corresponding to an air flow and a second air flow in the claims) flows into a space, that is, the heat source-side space SP2 inside the heat source unit 10 from a space, that is, an external space SP3 outside the usage-side space SP1. Thereafter, the heat source-side air flow AF1 passes through the heat source-side heat exchanger 12, and then flows toward the external space SP3. The heat source-side air flow AF1 also refers to an air flow directed to the external space SP3 from the heat source-side space SP2 where the fusible plug 22 is disposed. The heat source-side fan F1 includes a heat source-side fan motor (not illustrated) for driving the heat source-side fan F1. The heat source-side fan F1 is appropriately controlled as to its start, stop, and number of rotations, in accordance with a situation.

The heat source unit 10 also includes various sensors for detecting a state (mainly a pressure or a temperature) of the refrigerant in the refrigerant circuit RC. In the heat source unit 10, specifically, a suction pressure sensor 25 and a discharge pressure sensor 26 are disposed around the compressor 11. The suction pressure sensor 25 is configured to detect a suction pressure LP that is a pressure of the refrigerant at the suction side of the compressor 11. The discharge pressure sensor 26 is configured to detect a discharge pressure HP that is a pressure of the refrigerant at the discharge side of the compressor 11. The suction pressure sensor 25 (corresponding to refrigerant state sensor in the claims) is connected to the second gas-side refrigerant pipe P3 corresponding to the suction pipe or the compressor 11. The discharge pressure sensor 26 is connected to the first gas side refrigerant pipe P1 corresponding to the discharge pipe for the compressor 11.

The heat source unit 10 also includes a plurality of temperature sensors such as a thermistor and a thermocouple. Specifically, the heat source unit 10 includes a discharge temperature sensor 27*a* disposed on the discharge pipe, that is, the first gas-side refrigerant pipe P1 for the compressor 11. The discharge temperature sensor 27*a* is configured to detect a discharge temperature HT that is a temperature of the refrigerant discharged from the compressor 11. The heat source unit 10 also includes a receiver temperature sensor 27*b* disposed on the receiver 13. The receiver temperature sensor 27*b* is configured to detect a receiver temperature RT that is a temperature of the refrigerant in the receiver 13. The heat source unit 10 also includes a fusible plug temperature sensor 27*c* (corresponding to a fusible plug temperature detection unit in the claims) disposed on or near the fusible plug 22. The fusible plug temperature sensor 27*c* is configured to detect a fusible plug temperature PT that is a temperature of the fusible plug.

The heat source unit 10 also includes a liquid level sensor 28 disposed on the receiver 13. The liquid level sensor 28 is configured to detect a liquid level height HL of the liquid refrigerant in the receiver 13.

The heat source unit 10 also includes a heat source unit control unit C1 configured to control operations and states of the components in the heat source unit 10. The heat source unit control unit C1 includes a microcomputer including, for example, a central processing unit (CPU) and a memory. The heat source unit control unit C1 is electrically connected to the actuators (11, 15 to 18, F1) and the various sensors (25 to 28) in the heat source unit 10 to exchange signals with these actuators and sensors. The heat source unit control unit C1 is connected to a usage unit control unit C2 (to be described later) of the usage unit 30 and the remote controller 50 via a communication line cb1 to exchange, for example, a control signal with each of the usage unit control unit C2 and the remote controller 50.

(1-2) Usage Unit 30

The usage unit 30 is connected to the heat source unit 10 via the liquid-side connection pipe L1 and the gas-side connection pipe G1. The usage unit 30 is disposed in the usage-side space SP1, and constitutes a part of the refrigerant circuit RC, that is, the usage-side refrigerant circuit RC2. In other words, the usage-side refrigerant circuit RC2 (corresponding to a usage-side circuit in the claims) is disposed in the usage-side space SP1. The usage unit 30 includes a plurality of refrigerant pipes Pb, a usage-side expansion valve 32, a usage-side heat exchanger 33, and a drain pan 34.

The refrigerant pipes Pb of the usage unit 30 include a first liquid-side refrigerant pipe P8 connecting the liquid-side connection pipe L1 to the usage-side expansion valve 32. The first liquid-side refrigerant pipe P8 includes a heating pipe 31 that is a refrigerant pipe through which the high-pressure liquid refrigerant from the heat source unit 10 passes. The heating pipe 31 is thermally connected to the drain pan 34 to melt a block ice being frozen drain water in the drain pan 34.

The refrigerant pipes Pb also include a second liquid-side refrigerant pipe P9 connecting a liquid-side port of the usage-side heat exchanger 33 to the usage-side expansion valve 32.

The refrigerant pipes Pb also include a gas-side refrigerant pipe P10 connecting a gas-side port of the usage-side heat exchanger 33 to the gas-side connection pipe G1.

In practice, the refrigerant pipes Pb (P8 to P10) may be configured with a single pipe or may be configured with a plurality of pipes connected via joints or the like.

The usage-side expansion valve 32 is a restrictor functioning as means for decompressing (expanding) the high-pressure refrigerant to be supplied from the heat source unit 10. The usage-side expansion valve 32 is configured to decompress the refrigerant passing therethrough, in accordance with an opening degree thereof. The usage-side expansion valve 32 used in this embodiment is a well-known general-purpose mechanical expansion valve. For example, the usage-side expansion valve 32 is a thermostatic expansion valve including: a valve main body including a valve body, a diaphragm, and the like; a feeler bulb filled with a refrigerant equal in type to the refrigerant flowing through the refrigerant circuit RC; and a capillary tube connecting the valve main body to the feeler bulb. The usage-side expansion valve 32 has a first end connected to the first liquid-side refrigerant pipe P8, and a second end connected to the second liquid-side refrigerant pipe P9.

The usage-side heat exchanger 33 functions as an evaporator for the low-pressure refrigerant in the refrigeration cycle. The usage-side heat exchanger 33 is disposed in the usage-side space SP1, and is configured to cool inside air in the usage-side space SP1. The usage-side heat exchanger 33 includes a plurality of heat transfer tubes and a plurality of heat transfer fins (not illustrated). The usage-side heat exchanger 33 is configured to cause the refrigerant in each of the heat transfer tubes to exchange heat with air passing around the heat transfer tubes or heat transfer fins.

The drain pan 34 receives and recovers the drain water generated in the usage-side heat exchanger 33. The drain pan 34 is disposed below the usage-side heat exchanger 33.

The usage unit 30 also includes a usage-side fan F2 for sucking air inside the usage-side space SP1 (hereinafter, referred to as inside air), allowing the inside air to pass through the usage-side heat exchanger 33, causing the inside air to exchange heat with the refrigerant in the usage-side heat exchanger 33, and then supplying the inside air to the usage-side space SP1 again. The usage-side fan F2 is disposed in the usage-side space SP1. The usage side fan F2 includes a usage-side fan motor (not illustrated) for driving the usage-side fan F2. The usage-side fan F2 when being driven is configured to provide a usage-side air flow AF2 for heating the refrigerant flowing through the usage-side heat exchanger 33.

The usage unit 30 also includes various sensors for detecting a state (mainly a pressure or a temperature) of the refrigerant in the refrigerant circuit RC. Specifically, the usage unit 30 includes an inside temperature sensor (not illustrated) disposed around the usage-side heat exchanger 33 or the usage-side fan F2. The inside temperature sensor is configured to detect a temperature of inside air sucked into the usage-side fan F2.

The usage unit 30 also includes a usage unit control unit C2 configured to control operations and states of the components in the usage unit 30. The usage unit control unit C2 includes a microcomputer including, for example, a CPU and a memory. The usage unit control unit C2 is electrically connected to the actuator (F2) and the various sensors in the usage unit 30 to exchange signals with these actuator and sensors. The usage unit control unit C2 is connected to the heat source unit control unit C1 via the communication line cb1 to exchange, for example, a control signal with the heat source unit control unit C1.

(1-3) Liquid-Side Connection Pipe L1, Gas-Side Connection Pipe G1

Each of the liquid-side connection pipe L1 and the gas-side connection pipe G1 is a connection pipe for connection between the heat source unit 10 and the usage unit 30, and is constructed on site. Each of the liquid-side connection pipe L1 and the gas-side connection pipe G1 has a pipe length and a pipe diameter appropriately selected in accordance with design specifications and installation environments.

A check valve CV is disposed on the gas-side connection pipe G1. The check valve CV permits a flow of the refrigerant from its first end toward its second end, and interrupts a flow of the refrigerant from its second end toward its first end. The check valve CV permits a flow of the refrigerant from the usage unit 30 toward the heat source unit 10, and interrupts a flow of the refrigerant from the heat source unit 10 toward the usage unit 30.

(1-4) Refrigerant Leak Sensor 40

The refrigerant leak sensor 40 (corresponding to a refrigerant leak detector in the claims) is configured to detect a refrigerant leak at the usage-side space SP1 where the usage unit 30 is disposed, more specifically a refrigerant leak at the usage unit 30. The refrigerant leak sensor 40 used in this embodiment is a well-known general-purpose product to be selected in accordance with a type of the refrigerant in the refrigerant circuit RC. The refrigerant leak sensor 40 is disposed in the usage-side space SP1, more specifically in the usage unit 30.

The refrigerant leak sensor 40 continuously or intermittently outputs to the controller 60 an electric signal (a refrigerant leak sensor detection signal) according to a value detected thereby. More specifically, the refrigerant leak sensor detection signal (corresponding to a detection signal in the claims) to be output from the refrigerant leak sensor 40 has a voltage varying in accordance with a concentration of the refrigerant, the concentration being detected by the refrigerant leak sensor 40. In other words, the refrigerant leak sensor detection signal is output to the controller 60 in a form capable of identifying, in addition to occurrence of a refrigerant leak at the refrigerant circuit RC, a concentration of a leakage refrigerant in the usage-side space SP1 where the refrigerant leak sensor 40 is disposed, more specifically a concentration of the refrigerant, the concentration being detected by the refrigerant leak sensor 40. The refrigerant leak sensor 40 corresponds to a refrigerant leak detection unit configured to detect a refrigerant leak at the usage-side refrigerant circuit RC2 by directly detecting the refrigerant flowing out of the usage-side refrigerant circuit RC2, more specifically a concentration of the refrigerant.

1-5) Remote Controller 50 (Corresponding to Output in the Claims)

The remote controller 50 is an input device that causes a user to input various commands for switching an operating state of the refrigeration apparatus 100. For example, the remote controller 50 allows the user to input a command to start or stop the refrigeration apparatus 100, a command to change a set temperature, and other commands.

The remote controller 50 also functions as a display device for displaying various kinds of information for the user. For example, the remote controller 50 displays thereon an operating state, such as a set temperature, of the refrigeration apparatus 100. In addition, when a refrigerant leak occurs, the remote controller 50 displays thereon a fact that the refrigerant leak occurs, and information for notifying an administrator of necessary measures against the refrigerant leak (hereinafter, referred to as refrigerant leak notification information).

The remote controller 50 is connected to the controller 60, more specifically the heat source unit control unit C1 via the communication line cb1 to exchange signals with the controller 60. The remote controller 50 transmits a command input by the user to the controller 60 via the communication line cb1. The remote controller 50 receives an instruction via the communication line cb1 to display thereon information according to the instruction.

(1-6) Controller 60

The controller 60 (corresponding to a controller in the claims) is a computer configured to control the states of the respective components, thereby controlling the operation of the refrigeration apparatus 100. In this embodiment, the controller 60 is constituted of the heat source unit control unit C1 and the usage unit control unit C2 connected to each other via the communication line cb1. The details of the controller 60 will be described later in "(3) Details of Controller 60".

(2) Flow of Refrigerant in Refrigerant Circuit RC in Cooling Operation

Next, a description will be given of the flow of the refrigerant in the refrigerant circuit RC in each operating mode. During the operation, the refrigeration apparatus 100 performs the cooling operation (a refrigeration cycle operation) causing the refrigerant in the refrigerant circuit RC to mainly circulate through the compressor 11, the heat source-side heat exchanger 12, the receiver 13, the subcooler 14, the heat source-side expansion valve 15, the usage-side expansion valve 32, the usage-side heat exchanger 33, and the compressor 11 in this order. In the cooling operation, the refrigerant flowing through the liquid-side refrigerant pipe P2 via the injection pipe P4 is partially shunted to return to the compressor 11 via the injection valve 16 and the subcooler 14 (via the second flow path 142). In a normal situation, for example, at an operation stop or during a normal operation, the hot gas bypass valve 17 is controlled to have the minimum opening degree, that is, is brought into the closed state.

When the cooling operation is started, the refrigerant is sucked into and compressed by the compressor 11, and then is discharged from the compressor 11, in the refrigerant circuit RC. In the cooling operation, the low pressure in the refrigeration cycle corresponds to the suction pressure LP to be detected by the suction pressure sensor 25, and the high pressure in the refrigeration cycle corresponds to the discharge pressure HP to be detected by the discharge pressure sensor 26.

The compressor 11 is subjected to capacity control according to a cooling load to be required for the usage unit 30. Specifically, the operating frequency of the compressor 11 is controlled such that the suction pressure LP takes a target value set in accordance with the cooling load to be required for the usage unit 30. The gas refrigerant discharged from the compressor 11 flows into the heat source-side heat exchanger 12 through the gas-side port of the heat source-side heat exchanger 12, via the first gas-side refrigerant pipe P1.

When the gas refrigerant flows into the heat source-side heat exchanger 12 through the gas-side port of the heat source-side heat exchanger 12, the heat source-side heat exchanger 12 causes the gas refrigerant to radiate heat by heat exchange with the heat source-side air flow supplied by the heat source-side fan F1, and then condenses the gas refrigerant. The refrigerant flows out of the heat source-side heat exchanger 12 through the liquid-side port of the heat source-side heat exchanger 12.

When the refrigerant flows out of the heat source-side heat exchanger 12 through the liquid-side port of the heat source-side heat exchanger 12, then the refrigerant flows into the receiver 13 through the inlet 13*a* of the receiver 13 via a portion, extending from the heat source-side heat exchanger 12 to the receiver 13, of the liquid-side refrigerant pipe P2. When the refrigerant flows into the receiver 13, the receiver 13 temporarily stores therein the refrigerant as the liquid refrigerant in a saturated state. Thereafter, the liquid refrigerant flows out of the receiver 13 through the outlet 13*b* of the receiver 13.

When the liquid refrigerant flows out of the receiver 13 through the outlet 13*b* of the receiver 13, then the liquid refrigerant flows into the subcooler 14 through the inlet of the first flow path 141 via a portion, extending from the receiver 13 to the subcooler 14, of the liquid-side refrigerant pipe P2.

When the liquid refrigerant flows into the first flow path 141 of the subcooler 14, the subcooler 14 further cools the liquid refrigerant by heat exchange with the refrigerant flowing through the second flow path 142, thereby bringing the liquid refrigerant into a subcooled state. The resultant liquid refrigerant flows out of the subcooler 14 through the outlet of the first flow path 141.

When the liquid refrigerant flows out of the subcooler 14 through the outlet of the first flow path 141, then the liquid refrigerant flows into the heat source-side expansion valve 15 via a portion, between the subcooler 14 and the heat source-side expansion valve 15, of the liquid-side refrigerant pipe P2. At this time, the liquid refrigerant, which has flown out of the subcooler 14 through the outlet of the first flow path 141, partly flows into the injection pipe P4 rather than the heat source-side expansion valve 15.

The refrigerant flowing through the injection pipe P4 is decompressed to have an intermediate pressure in the refrigeration cycle by the injection valve 16. The refrigerant decompressed by the injection valve 16 flows through the injection pipe P4, and then flows into the subcooler 14 through the inlet of the second flow path 142. The subcooler 14 heats the refrigerant by heat exchange with the refrigerant flowing through the first flow path 141, thereby turning the refrigerant into the gas refrigerant. The refrigerant heated by the subcooler 14 flows out of the subcooler 14 through the outlet of the second flow path 142, and then returns to a compression chamber of the compressor 11.

When the liquid refrigerant flows into the heat source-side expansion valve 15 via the liquid-side refrigerant pipe P2, then the liquid refrigerant is decompressed or the flow rate of the liquid refrigerant is adjusted in accordance with the opening degree of the heat source-side expansion valve 15. When the refrigerant passes through the heat source-side expansion valve 15, then the refrigerant flows out of the heat source unit 10 through the liquid-side shutoff valve 24. The refrigerant passing through the heat source-side expansion valve 15 partly flows into the receiver 13 via the bypass pipe P6.

When the refrigerant flows out of the heat source unit 10, then the refrigerant flows into the usage unit 30 via the liquid-side connection pipe L1. When the refrigerant flows into the usage unit 30, then the refrigerant flows through the first liquid-side refrigerant pipe P8 including the heating pipe 31, and then flows into the usage-side expansion valve 32. When the refrigerant flows into the usage-side expansion valve 32, then the refrigerant is decompressed to have the low pressure in the refrigeration cycle in accordance with the opening degree of the usage-side expansion valve 32. Thereafter, the refrigerant flows into the use heat exchanger 33 via the second liquid side refrigerant pipe P9.

When the refrigerant flows into the usage-side heat exchanger 33, the usage side heat exchanger 33 causes the refrigerant to exchange heat with the usage-side air flow AF2 supplied by the usage-side fan F2, and evaporates the refrigerant to turn the refrigerant into the gas refrigerant. The resultant gas refrigerant flows out of the usage-side heat exchanger 33. When the gas refrigerant flows out of the usage-side heat exchanger 33, then the gas refrigerant flows out of the usage unit 30 via the gas side refrigerant pipe P10.

When the refrigerant flows out of the usage unit 30, then the refrigerant flows into the heat source unit 10 via the gas-side connection pipe G1 and the gas-side shutoff valve 23. When the refrigerant flows into the heat source unit 10, then the refrigerant flows through the second gas-side refrigerant pipe P3. Thereafter, the refrigerant is sucked into the compressor 11 again.

(3) Details of Controller 60

Figure 2:
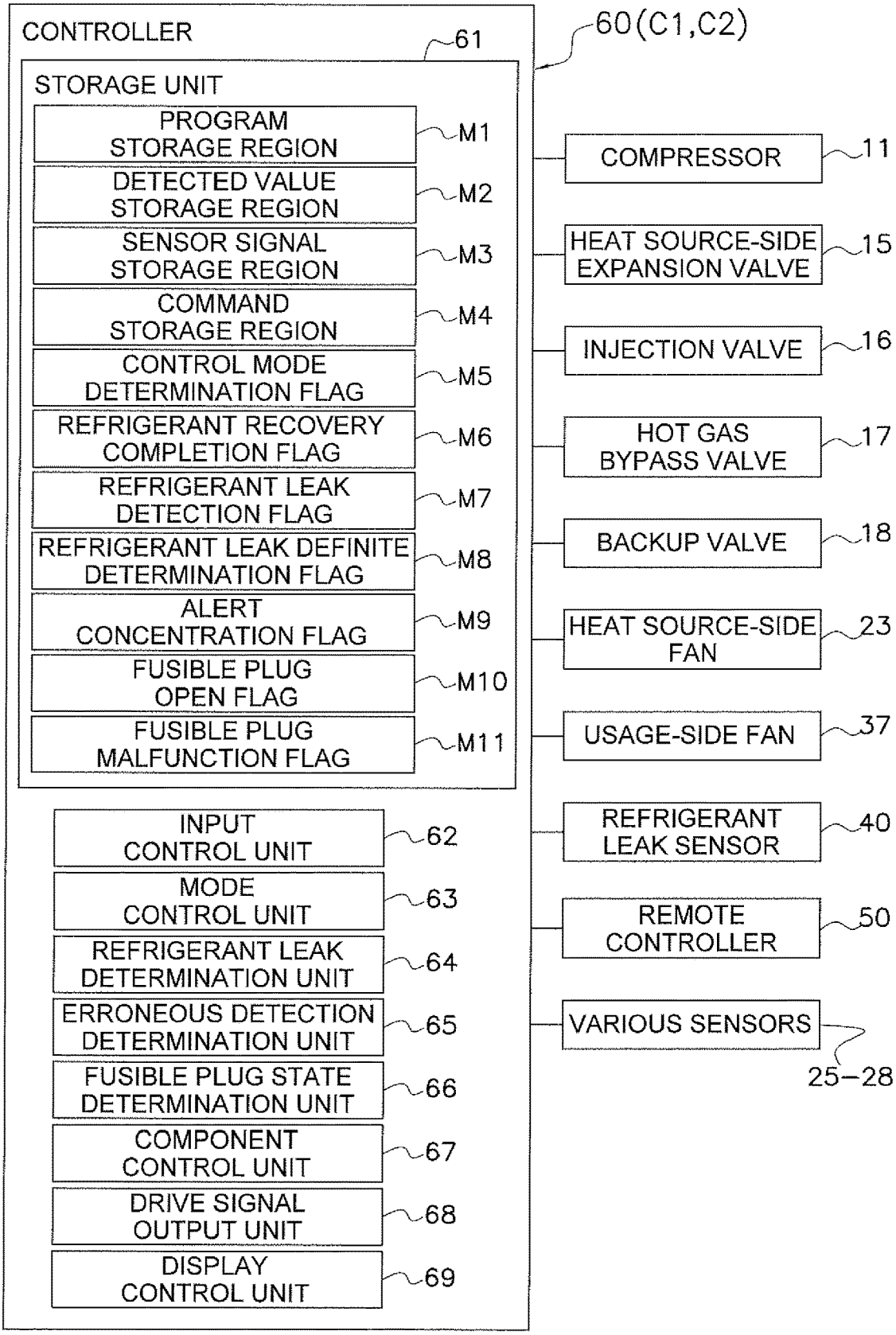
FIG. 2 is a schematic block diagram of a controller and components connected to the controller.

In the refrigeration apparatus 100, the heat source unit control unit C1 and the usage unit control unit C2 are connected to each other via the communication line cb1 to constitute the controller 60. FIG. 2 is a schematic block diagram of the controller 60 and the components connected to the controller 60.

The controller 60 has a plurality of control modes, and controls the operation of each actuator in accordance with a control mode in which the controller 60 is to be placed. In this embodiment, examples of the control modes of the controller 60 include: a normal operating mode in which the controller 60 is placed during operation (no refrigerant leak occurs); and a refrigerant leak mode in which the controller 60 is placed upon occurrence of a refrigerant leak, more specifically upon detection of a refrigerant leak.

The controller 60 is electrically connected to the actuators, that is, the compressor 11, the heat source-side expansion valve 15, the injection valve 16, the hot gas bypass valve 17, the backup valve 18, the heat source-side fan F1, and the usage-side fan F2 in the refrigeration apparatus 100. The controller 60 is also electrically connected to the various sensors, that is, the suction pressure sensor 25, the discharge pressure sensor 26, the discharge temperature sensor 27*a*, the receiver temperature sensor 27*b*, the fusible plug temperature sensor 27*c*, the liquid level sensor 28, and the like in the refrigeration apparatus 100. The controller 60 is also electrically connected to the remote controller 50.

The controller 60 mainly includes a storage unit 61, an input control unit 62, a mode control unit 63, a refrigerant leak determination unit 64, an erroneous detection determination unit 65, a fusible plug state determination unit 66, a component control unit 67, a drive signal output unit 68, and a display control unit 69. These functional units in the controller 60 are implemented in such a manner that the CPUs, the memories, and the various electric and electronic components in the heat source unit control unit C1 and the usage unit control unit C2 integrally function.

(3-1) Storage Unit 61

The storage unit 61 includes, for example, a read only memory (ROM), a random access memory (RAM), and a flash memory. The storage unit 61 has a volatile storage region and a nonvolatile storage region. The storage unit 61 also has a program storage region M1 for storing a control program that defines processing to be performed by each unit of the controller 60.

The storage unit 61 also has a detected value storage region M2 for storing values detected by the various sensors. The detected value storage region M2 stores therein, for example, a value detected by the suction pressure sensor 25, that is, a suction pressure LP, a value detected by the discharge pressure sensor 26, that is, a discharge pressure HP, a value detected by the discharge temperature sensor 27*a*, that is, a discharge temperature HT, a value detected by the receiver temperature sensor 27*b*, that is, a receiver temperature RT, a value detected by the fusible plug temperature sensor 27*c*, that is, a fusible plug temperature PT, and a value detected by the liquid level sensor 28, that is, a liquid level height HL.

The storage unit 61 also has a sensor signal storage region M3 for storing a refrigerant leak sensor detection signal to be transmitted from the refrigerant leak sensor 40, that is, a value detected by the refrigerant leak sensor 40. The refrigerant leak signal stored in the sensor signal storage region M3 is updated each time the storage unit 61 receives a refrigerant leak signal from the refrigerant leak sensor 40.

The storage unit 61 also has a command storage region M4 for storing a command input to the remote controller 50.

In addition, the storage unit 61 is provided with a plurality of flags each including predetermined bits. For example, the storage unit 61 is provided with a control mode determination flag M5 capable of determining a control mode in which the controller 60 is placed. The control mode determination flag M5 includes bits according to the number of control modes, and the bits are set in accordance with a control mode in which the controller 60 is placed.

The storage unit 61 is also provided with a refrigerant recovery completion flag M6 for determining whether a pump down operation (to be described later) to be performed in the refrigerant leak mode is completed. The refrigerant recovery completion flag M6 is set when the pump down operation performed in the refrigerant leak mode is completed.

The storage unit 61 is also provided with a refrigerant leak detection flag M7 for determining that a refrigerant leak at the usage-side space SP1 is detected. The refrigerant leak detection flag M7 is switched by the refrigerant leak determination unit 64.

The storage unit 61 is also provided with a refrigerant leak definite determination flag M8 for determining whether a refrigerant leak is erroneously detected. The refrigerant leak definite determination flag M8 is set when the erroneous detection determination unit 65 determines that there is no possibility of erroneous detection of a refrigerant leak, that is, decides that a refrigerant leak definitely occurs at the usage-side space SP1.

The storage unit 61 is also provided with an alert concentration flag M9 for determining that the refrigerant may leak at a hazardous concentration in the usage-side space SP1. The alert concentration flag M9 is switched by the refrigerant leak determination unit 64.

The storage unit 61 is also provided with a fusible plug open flag M10 for determining that the fusible plug 22 is presumably brought into the open state. The fusible plug open flag M10 is switched by the fusible plug suite determination unit 66.

The storage unit 61 is also provided with a fusible plug malfunction flag M11 for determining that the fusible plug 22 malfunctions or may malfunction. The fusible plug malfunction flag M11 is switched by the fusible plug state determination unit 66.

(3-2) Input Control Unit 62

The input control unit 62 is a functional unit that plays a role as an interface for receiving signals from the respective components connected to the controller 60. For example, the input control unit 62 receives signals from the various sensors (25 to 28) and remote controller 50, and then stores the signals in the corresponding storage regions in the storage unit 61 or sets a predetermined flag.

(3-3) Mode Control Unit 63

The mode control unit 63 is a functional unit that switches a control mode. In a normal situation in which the refrigerant leak definite determination flag M8 is not set, the mode control unit 63 switches the control mode to the normal operating mode. When the refrigerant leak definite determination flag M8 is set, the mode control unit 63 switches the control mode to the refrigerant leak mode. The mode control unit 63 sets the control mode determination flag M5 in accordance with a control mode in which the controller 60 is placed.

(3-4) Refrigerant Leak Determination Unit 64

The refrigerant leak determination unit 64 is a functional unit that determines whether a refrigerant leak occurs at the refrigerant circuit RC, more specifically the usage-side refrigerant circuit RC2. Specifically, when a predetermined refrigerant leak detection condition is satisfied, the refrigerant leak determination unit 64 determines that a refrigerant leak presumably occurs at the refrigerant circuit RC, more specifically the usage-side refrigerant circuit RC2, and sets the refrigerant leak detection flag M7. In addition, when a predetermined alert condition is satisfied, the refrigerant leak determination unit 64 determines that the refrigerant may leak at a hazardous concentration in the usage-side space SP1, and sets the alert concentration flag M9.

In this embodiment, the refrigerant leak determination unit 64 makes a determination as to whether the refrigerant leak detection condition and the alert condition are satisfied, based on the refrigerant leak sensor detection signal in the sensor signal storage region M3.

Specifically, the refrigerant leak detection condition is satisfied when a time during which a voltage value concerning the refrigerant leak sensor detection signal, that is, a value detected by the refrigerant leak sensor 40 is equal to or more than a predetermined first reference value SV1 continues for a predetermined time t1 or more. The first reference value SV1 corresponds to a value (i.e., a concentration of the refrigerant) from which it is assumed that a refrigerant leak occurs at the usage-side refrigerant circuit RC2. The predetermined time t1 is set at a time capable of determining that the refrigerant leak sensor detection signal is not an instantaneous signal.

The alert condition is satisfied when a time during which the voltage value concerning the refrigerant leak sensor detection signal, that is, the value detected by the refrigerant leak sensor 40 is equal to or more than a predetermined second reference value SV2 continues for a predetermined time t3 or more in cases where a predetermined time t2 elapses from completion of refrigerant leak first control (i.e., the pump down operation) to be described later. The second reference value SV2 is larger than the first reference value SV1. The second reference value SV2 corresponds to a value from which it is assumed that the refrigerant may leak at a hazardous concentration in the usage-side space SP1. In this embodiment the second reference value SV2 is set at a value equivalent to one-fourth of a lower flammable level (LFL), that is, a predetermined value V1.

The predetermined time t2 (corresponding to a first time in the claims) is calculated based on an amount of the refrigerant passing through the heat source-side expansion valve 15 brought into the closed state, that is, controlled to have the minimum opening degree, in accordance with a characteristic of the heat source-side expansion valve 15. The predetermined time t2 is set to a length that the refrigerant passing through the heat source-side expansion valve 15 causes a refrigerant leak at the usage-side space SP1 with a concentration of the second reference value SV2.

The predetermined time t3 is set at a time capable of determining that the refrigerant leak sensor detection signal is not an instantaneous signal.

The predetermined times t1, t2, and t3 are appropriately set in accordance with, for example, a type of the refrigerant in the refrigerant circuit RC, specifications of the respective components, and installation environments, and are defined in the control program. The refrigerant leak determination unit 64 is configured to measure the predetermined times t1, t2, and t3.

The first reference value SV1 and the second reference value SV2 are appropriately set in accordance with, for example, a type of the refrigerant in the refrigerant circuit RC, design specifications, and installation environments, and are defined in the control program.

(3-5) Erroneous Detection Determination Unit 65

The erroneous detection determination unit 65 (corresponding to an erroneous detection decision unit in the claims) is a functional unit that determines whether the refrigerant leak sensor 40 erroneously detects a refrigerant leak when the refrigerant leak sensor 40 detects the refrigerant leak, that is, when the refrigerant leak detection flag M7 is set. When a predetermined erroneous detection relevant condition is not satisfied, the erroneous detection determination unit 65 determines that the refrigerant leak sensor 40 correctly detects the refrigerant leak, and sets the refrigerant leak definite determination flag M8. When the erroneous detection relevant condition is satisfied, the erroneous detection determination unit 65 determines that the refrigerant leak sensor 40 erroneously detects the refrigerant leak, and clears the refrigerant leak detection flag M7.

The erroneous detection relevant condition corresponds to a condition from which it is assumed that a refrigerant leak is erroneously detected, based on a state of the refrigerant in the refrigerant circuit RC, and is appropriately set in the control program in accordance with, for example, a type of the refrigerant in the refrigerant circuit RC, design specifications, and installation environments.

In this embodiment, the erroneous detection relevant condition is determined based on a value detected by the suction pressure sensor 25, that is, a suction pressure LP. Specifically, the erroneous detection determination unit 65 determines that the erroneous detection relevant condition is satisfied, that is, determines that the refrigerant leak sensor 40 erroneously detects the refrigerant leak when the refrigerant leak detection flag M7 is set and the value detected by the suction pressure sensor 25 and stored in the detected value storage region M2, that is, the suction pressure LP upon detection of a refrigerant leak is different from a value equivalent to atmospheric pressure or its approximate value (e.g., 2 kW to 0 kW). In other words, the erroneous detection relevant condition is satisfied when the suction pressure LP at the refrigerant circuit RC is reduced to almost the atmospheric pressure upon detection of a refrigerant leak by the refrigerant leak sensor 40, that is, when the erroneous detection determination unit 65 decides that the refrigerant leak sensor 40 erroneously detects the refrigerant leak. On the other hand, the erroneous detection relevant condition is not satisfied when the suction pressure LP is not reduced to almost the atmospheric pressure, that is, when the erroneous detection determination unit 65 decides that the refrigerant leak sensor 40 correctly detects the refrigerant leak.

(3-6) Fusible Plug State Determination Unit 66

The fusible plug state determination unit 66 is a functional unit that determines whether the fusible plug 22 is in the open state. Moreover, the fusible plug state determination unit 66 is a functional unit that determines whether the fusible plug 22 malfunctions or may malfunction.

The fusible plug state determination unit 66 determines that the fusible plug 22 is in the open state when a predetermined fusible plug open estimation condition is satisfied, and sets the fusible plug open flag M10. The fusible plug open estimation condition is appropriately set in accordance with, for example, specifications and installation environments of the fusible plug 22, and is defined in the control program. In this embodiment, the fusible plug open estimation condition is satisfied when a situation in which the fusible plug temperature PT in the detected value storage region M2 is equal to or more than the first temperature Te1 continues for a predetermined time t4. The predetermined time t4 is set to a length that the fusible plug 22 is heated to the first temperature Te1 and is brought into the open state.

In addition, the fusible plug state determination unit 66 determines that the fusible plug 22 may malfunction or malfunctions when a predetermined fusible plug malfunction condition is satisfied, and sets the fusible plug malfunction flag M11. When the fusible plug malfunction condition is not satisfied, the fusible plug state determination unit 66 clears the fusible plug malfunction flag M11.

The fusible plug malfunction condition is appropriately set in accordance with, for example, specifications and installation environments of the fusible plug 22, and is defined in the control program. In this embodiment, the fusible plug malfunction condition is satisfied when the refrigerant leak definite determination flag M8 is not set and a situation in which the fusible plug temperature PT in the detected value storage region M2 is equal to or more than the second temperature Te2 continues for a predetermined time t5. The second temperature Te2 is tower than the first temperature Te1. The second temperature Te2 takes a value from which it is particularly assumed that the temperature of the fusible plug 22 presumably increases to the first temperature Te1 or more. The second temperature Te2 is higher than the temperature of the refrigerant flowing into the receiver 13 during the normal operation. In other words, the second temperature Te2 takes an abnormal value that is not assumed in the normal situation.

The fusible plug state determination unit 66 is configured to measure the predetermined times t4 and t5.

(3-7) Component Control Unit 67

The component control unit 67 controls, based on the control program, the operations of the respective actuators, for example, the compressor 11, the heat source-side expansion valve 15, the injection valve 16, the hot gas bypass valve 17, and the usage-side fan F2 in the refrigeration apparatus 100, in accordance with a situation. The component control unit 67 refers to the control mode determination flag M5, thereby determining a control mode in which the controller 60 is placed, and controls the operations of the respective actuators, based on the determined control mode.

In the normal operating mode, for example, the component control unit 67 controls the operating capacity of the compressor 11, the number of rotations of the heat source-side fan F1, the number of rotations of the usage-side fan F2, the opening degree of the heat source-side expansion valve 15, the opening degree of the injection valve 16, and the opening degree of the hot gas bypass valve 17 in real time, such that the cooling operation is performed in accordance with, for example, set temperatures, and values detected by the various sensors.

The component control unit 67 performs various types of control in accordance with a situation as follows. The component control unit 67 is configured to measure a time.

<Refrigerant Leak First Control>

For example, the component control unit 67 performs refrigerant leak first control (corresponding to first control in the claims) when it is assumed that the refrigerant leak sensor 40 correctly detects a refrigerant leak at the usage-side space SP1, that is, when the refrigerant leak definite determination flag M8 is set.

The component control unit 67 performs the refrigerant leak first control to control the operations of the respective actuators so as to perform the pump down operation for preventing a flow of the refrigerant into the usage-side, refrigerant circuit RC2 and recovering the refrigerant in the refrigerant circuit RC into the component (mainly the receiver 13) in the heat source unit 10. In other words, the refrigerant leak first control is performed for preventing the flow of the refrigerant into the usage-side refrigerant circuit RC2 and recovering the refrigerant in the usage-side refrigerant circuit RC2 into the heat source-side refrigerant circuit RC1, thereby suppressing occurrence of a refrigerant leak at the usage-side refrigerant circuit RC2.

Specifically, the component control unit 67 performs the refrigerant leak first control to minimize the opening degree of the heat source-side expansion valve 15 and the opening degree of the injection valve 16, that is, to bring each of the heat source-side expansion valve 15 and the injection valve 16 into the closed state and to operate the compressor 11 at a number of rotations for the pump down operation. This configuration thus enables prevention of the flow of the refrigerant into the usage-side refrigerant circuit RC2, and also enables recovery of the refrigerant in the refrigerant circuit RC into the heat source unit 10. The number of rotations for the pump down operation is set at, but not limited to, the maximum number of rotations in this embodiment such that the pump down operation is completed in a shorter time.

The component control unit 67 complete the refrigerant leak first control when a predetermined refrigerant recovery completion condition is satisfied of the start of the refrigerant leak first control, that is, after the start of the pump down operation. The component control unit 67 then stops the compressor 11 while minimizing the opening degree of the heat source-side expansion valve 15 and the opening degree of the injection valve 16, and sets the refrigerant recovery completion flag M6.

The refrigerant recovery completion condition is calculated in advance in accordance with the configuration of the refrigerant circuit RC and design specifications such as the amount of refrigerant in the refrigerant circuit RC and the number of rotations of the compressor 11, and is defined in the control program. In this embodiment, the refrigerant recovery completion condition is satisfied based on a lapse of a predetermined time t6 (a time from which it is assumed that the pump down operation is completed) from the start of the pump down operation.

<Leakage Refrigerant Agitation Control>

In addition, the component control unit 67 performs leakage refrigerant agitation control when it is assumed that the refrigerant leak sensor 40 correctly detects a refrigerant leak at usage-side space SP1, that is, when the refrigerant leak definite determination flag M8 is set.

The component control unit 67 performs the leakage refrigerant agitation control to operate the usage-side fan F2 at a number of rotations, that is, art air flow volume for the leakage refrigerant agitation control. The component control unit 67 performs the leakage refrigerant agitation control to operate the usage-side fan F2 at a predetermined number of rotations in order to prevent local emergence of a region where the refrigerant leaks at a high concentration in the usage-side space SP1.

The number of rotations of the usage-side fan F2 in the leakage refrigerant agitation control is set at, but not limited to, the maximum number of rotations, that is, the maximum airflow volume in this embodiment. The leakage refrigerant agitation control allows, even when a refrigerant leak occurs at the usage-side space SP1, an usage-side air flow AF2 provided by the usage-side fan F2 to agitate the leakage refrigerant in the usage-side space SP1, and suppresses emergence of a region where the refrigerant leaks at a hazardous concentration in the usage-side space SP1.

<Refrigerant Leak Second Control>

The component control unit 67 performs refrigerant leak second control (corresponding to second control in the claims) when it is assumed that the refrigerant may leak at a hazardous concentration in the visage side space SP1, that is, when the alert concentration flag M9 is set. The component control unit 67 performs the refrigerant leak second control to bring the fusible plug 22 into the open state and to release the refrigerant from the refrigerant circuit RC toward the external space, thereby reliably preventing occurrence of additional refrigerant leak at the usage-side refrigerant circuit RC2. A control valve (an electric valve, an electromagnetic valve) such as the heat source-side expansion valve 15 is incapable of completely blocking a flow of a refrigerant even when being controlled to have a minimum opening degree, that is, even when being brought into a fully closed state, because of its structure. It is therefore assumed that even when the opening degree of the heat source-side expansion valve 15 is minimized upon occurrence of a refrigerant leak, a small amount of refrigerant passing through the heat source-side expansion valve 15 flows toward the usage-side refrigerant circuit RC2. In such a case, a leakage refrigerant may be locally retained in the usage-side space SP1 at a hazardous concentration. In order to securely prevent such a concern, the refrigerant leak second control is performed when occurrence of a refrigerant leak is definitely determined.

The component control unit 67 performs the refrigerant leak second control to maximize the opening degree of the injection valve 16 and the opening degree of the hot gas bypass valve 17, that is, to bring each of the injection valve 16 and the hot gas bypass valve 17 into the open state. The component control unit 67 also performs the refrigerant leak second control to bring the backup valve 18 into the open state, that is, to maximize the opening degree of the backup valve 18. The component control unit 67 also performs the refrigerant leak second control to drive the compressor 11 at a number of rotations for the refrigerant leak second control. The hot gas discharged from the compressor 11 is thus supplied to the receiver 13 via the hot gas pipe P5, and then is supplied from the receiver 13 to the fusible plug 22 via the fusible plug mount pipe P7, so that the fusible plug 22 is heated is the first temperature Te1. The component control unit 67 performs the refrigerant leak second control to cause the predetermined components (in this embodiment, mainly the compressor 11, the hot gas pipe P5, and the fusible plug mount pipe P7) to function as a heating unit configured to directly or indirectly apply heat to the fusible plug 22. The number of rotations of the compressor 11 in the refrigerant leak second control is set at, but not limited to, the maximum number of rotations such that the fusible plug 22 is heated to the first temperature Te1 in a shorter time in this embodiment.

The component control unit 67 performs the refrigerant leak second control to stop the heat source-side fan F1. This results in suppression of heat radiation from and condensation of the refrigerant in the heat some-side heat exchanger 12, and also results in supply of the hot gas to the receiver 13 via the liquid-side refrigerant pipe P2.

The component control unit 67 completes the refrigerant leak second control when the fusible plug open flag M10 is set.

<Refrigerant Release Promotion Control>

The component control unit 67 performs refrigerant release promotion control after completion of the refrigerant leak second control. The component control unit 67 performs the refrigerant release promotion control to promote a flow of the refrigerant released through the fusible plug 22, from the heat source-side space SP2 toward the external space SP3, thereby preventing retention of the refrigerant in the heat source-side space SP2. The component control unit 67 performs the refrigerant release promotion control to drive the heat source-side fan F1 at a number of rotations for the refrigerant release promotion control. The heat source-side fan F1 thus provides a heat source-side air flow AF1 to supply the refrigerant released through the fusible plug 22, toward the external space SP3 by the heat source-side air flow AF1. This results in prevention of occurrence of a situation in which the refrigerant flowing out of the fusible plug 22 is retained in the heat source-side space SP2 at a hazardous concentration. The component control unit 67 performs the refrigerant release promotion control to drive the heat source-side fan F1 at the maximum number of rotations, that is, the maximum air flow volume so as to produce the maximum effect.

<Backup Control>

The component control unit 67 performs backup control when it is assumed that the fusible plug 22 may malfunction or currently malfunctions, that is, when the fusible plug malfunction flag M11 is set. The component control unit 67 performs the backup control to prevent the fusible plug 22 from malfunctioning or to prevent release of the refrigerant through the fusible plug 22 that currently malfunctions.

The component control unit 67 also performs the backup control to bring the backup valve 18 into the fully closed state, that is, to minimize the opening degree of the backup valve 18. With this configuration, the component control unit 67 prevents the flow of the refrigerant from the receiver 13 toward the fusible plug 22.

The component control unit 67 also performs the backup control to stop the compressor 11. With this configuration, the component control unit 67 stops the refrigeration cycle in the ref circuit RC so as not to supply the hot gas to the receiver 13. This results in prevention of occurrence of a situation in which the fusible plug 22 is heated to the first temperature Te1, when the fusible plug 22 is not brought into the open state.

The component control unit 67 also performs the backup control to drive the heat source-side fan at a number of rotations for the backup control. With this configuration, the component control unit 67 causes heat radiation from the refrigerant in the heat source-side heat exchanger 12, and decreases the temperature of the refrigerant to be supplied to the receiver 13. This results in further prevention of occurrence of the situation in which the fusible plug 22 is heated to the first temperature Te1, when the fusible plug 22 is not brought into the open state. The component control unit 67 performs the backup control to drive the heat source-side fan F1 at the maximum number of rotations, that is, the maximum air flow volume so as to produce the maximum effect.

(3-8) Drive Signal Output Unit 68

The drive signal output unit 68 outputs drive signals (drive voltages) to the actuators (e.g., 11, 15 to 18, F1, F2) in accordance with the details of control by the component control unit 67. The drive signal output unit 68 includes a plurality of inverters (not illustrated) that output drive signals to specific components (e.g., the compressor 11, the heat source-side fan F1, the usage-side fan F2) corresponding thereto.

(3-9) Display Control Unit 69

The display control unit 69 is a functional unit that controls operation of the remote controller 50 serving as the display device. The display control unit 69 causes the remote controller 50 to output predetermined information in order that an operating state or information on a situation is displayed for a user. For example, the display control unit 69 causes the remote controller 50 to display thereon various kinds of information, such as set temperatures, during the cooling operation in the normal mode.

When the refrigerant leak definite determination flag M8 is set, the display control unit 69 causes the remote controller 50 to display thereon the refrigerant leak notification information. The administrator thus knows occurrence of a refrigerant leak, and then takes predetermined measures against the refrigerant leak.

The display control unit 69 causes the remote controller 50 to display thereon predetermined notification information when it is assumed that the fusible plug 22 may malfunction or currently malfunctions, that is, when the fusible plug malfunction flag is set. The administrator thus knows a situation in which it is assumed that the fusible plug may malfunction or currently malfunctions, and then takes predetermined measures against the situation.

(4) Processing by Controller 60

Figure 3:
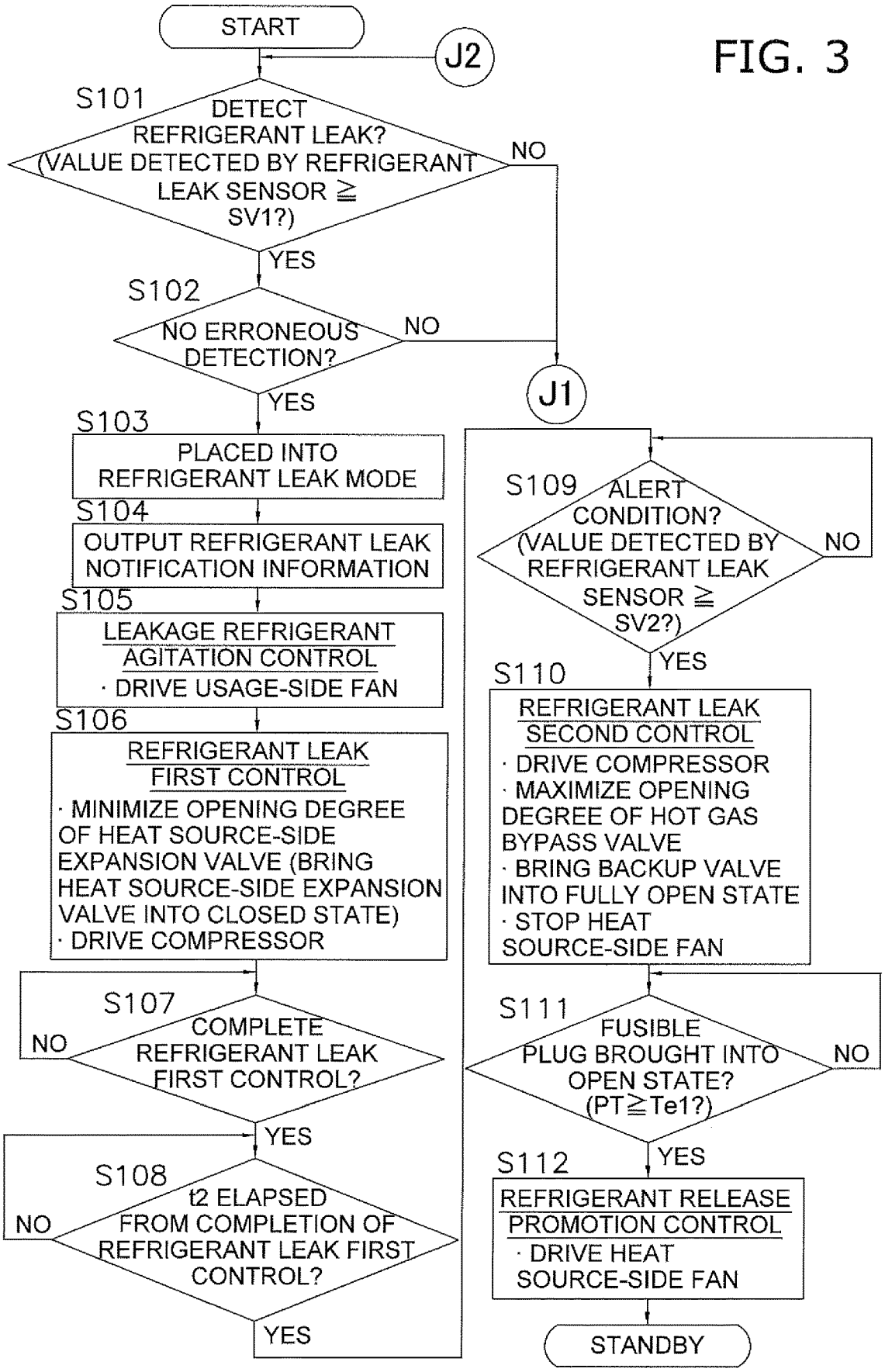
FIG. 3 is a flowchart of exemplary processing to be performed by the controller.
Figure 4:
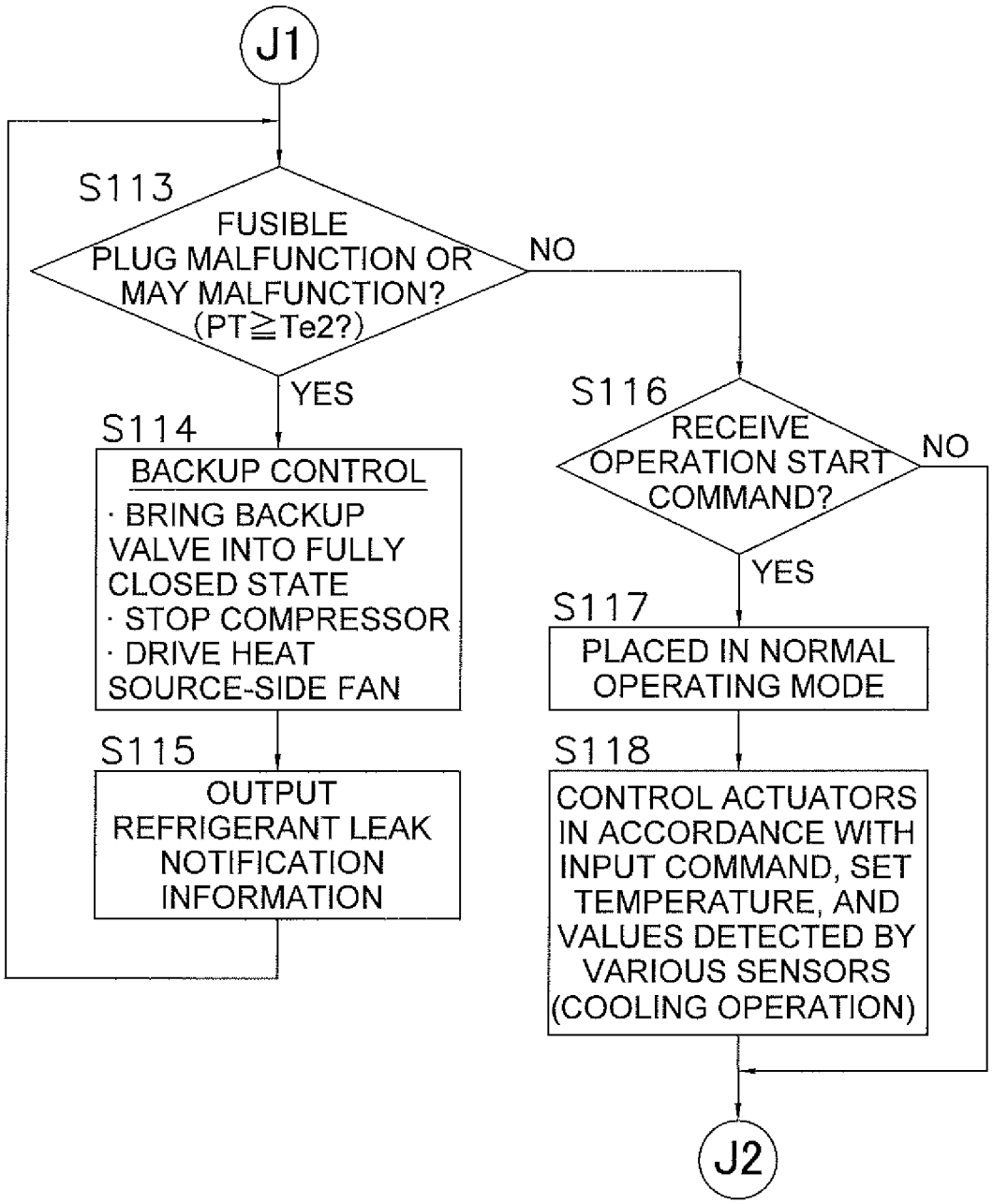
FIG. 4 is a flowchart of exemplary processing to be performed by the controller.

With reference to FIGS. 3 and 4, next, a description will be given of exemplary processing to be performed by the controller 60. FIGS. 3 and 4 are flowcharts of the exemplary processing to be performed by the controller 60. At power-on, the controller 60 sequentially performs steps S101 to S118 illustrated in FIGS. 3 and 4. However, the processing in FIGS. 3 and 4 is merely illustrative and may be appropriately changed. For example, the sequence of the steps may be changed, some of the steps may be carried out in parallel, or additional steps may be carried out insofar as there are no inconsistencies.

In step S101, when the controller 60 determines that the refrigerant leak sensor 40 detects no refrigerant leak at the refrigerant circuit RC, particularly the usage-side refrigerant circuit RC2 (NO in S101; when a value detected by the refrigerant leak sensor is not equal to or more than the first reference value SV1), the processing proceeds to step S113. When the controller 60 determines that the refrigerant leak sensor 40 detects a refrigerant leak at the refrigerant circuit RC (YES in S101; when the value detected by the refrigerant leak sensor 40 is equal to or more than the first reference value SV1), the processing proceeds to step S102.

In step S102, when the controller 60 determines that the refrigerant leak sensor 40 erroneously detects the refrigerant leak in step S101 (NO in S102), the processing proceeds to step S113. On the other hand, when the controller 60 determines that the refrigerant leak sensor 40 correctly detects the refrigerant leak in step S101 (YES in S102), the processing proceeds to step S103.

In step S103, the controller 60 is placed in the refrigerant leak mode. The processing then proceeds to step S104.

In step S104, the controller 60 causes the remote controller 50 to output refrigerant leak notification information. The administrator thus knows occurrence of a refrigerant leak. The processing then proceeds to step S105.

In step S105, the controller 60 performs the leakage refrigerant agitation control. Specifically, the controller 60 drives the usage-side fan F2 at the number of rotations for the leakage refrigerant agitation control. The usage-side fan F2 thus agitates the leakage refrigerant in the usage-side space SP1 to prevent occurrence of a situation in which the refrigerant locally retains at a hazardous concentration. The processing then proceeds to step S106.

In step S106, the controller 60 performs the refrigerant leak first control. Specifically, the controller 60 minimizes the opening degree of the heat source-side expansion valve 15, that is, brings the heat source-side expansion valve 15 into the closed state. The heat source-side expansion valve 15 thus prevents a flow of the refrigerant toward the usage-side refrigerant circuit RC2, and prevents occurrence of an additional refrigerant leak at the usage-side refrigerant circuit RC2. In addition, the controller 60 drives the compressor 11. The refrigerant is thus recovered into the heat source-side refrigerant circuit RC1 (mainly the receiver 13). The processing then proceeds to step S107.

In step S107, when the controller 60 does not complete the refrigerant leak first control (NO in S107; when the controller 60 does not complete the pump down operation), the processing stays at step S107. On the other hand, when the controller 60 completes the refrigerant leak first control (YES in S107; when the controller 60 completes the pump down operation), the controller 60 stops the compressor 11. The processing then proceeds to step S108.

In step S108, when the predetermined time t2 does not elapse from the completion of the refrigerant leak first control (NO in S108), the processing stays at step S108. On the other hand, when the predetermined time t2 elapses from the completion of the refrigerant leak first control (YES in S108), the processing proceeds to step S109.

In step S109, when the alert condition is not satisfied (NO in S109; when the value detected by the refrigerant leak sensor 40 is less than the second reference value SV2), the processing stays at step S109. On the other hand, when the alert condition is satisfied (YES in S109; when the value detected by the refrigerant leak sensor 40 is equal to or more than the second reference value SV2), the processing proceeds to step S110.

In step S110, the controller 60 performs the refrigerant leak second control to apply heat to the fusible plug 22 while controlling a state of each component corresponding to the heating unit. The controller 60 thus increases the temperature of the fusible plug 22 to the first temperature Te1 or more to bring the fusible plug 22 into the open state, and releases the refrigerant from the heat source-side refrigerant circuit RC1. Specifically, the controller 60 drives the compressor 11 at the number of rotations for the refrigerant leak second control, brings the hot gas bypass valve 17 into the open state, more specifically maximizes the opening degree of the hot gas bypass valve 17, and brings the backup valve 18 into the fully open state. The hot gas discharged from the compressor 11, more specifically the gas refrigerant at the first temperature Te1 or more is thus supplied to the receiver 13, and then is supplied to the fusible plug 22 via the fusible plug mount pipe P7. In other words, the controller 60 causes each of the compressor 11, the hot gas pipe P5, and the fusible plug mount pipe P7 to function as the heating unit configured to apply heat to the fusible plug 22. In addition, the controller 60 stops the heat source-side fan F1. The controller 60 thus suppresses heat radiation from the hot gas discharged from the compressor 11, in the heat source-side heat exchanger 12.

In step S111, when the fusible plug 22 is not brought into the open state (NO in S111; when the fusible plug open estimation condition (fusible plug temperature PT≥first temperature Te1) is not satisfied), the processing stays at step S111. On the other hand, when the fusible plug 22 is brought into the open state (YES in S111; when the fusible plug open estimation condition is satisfied), the processing proceeds to step S112.

In step S112, the controller 60 completes the refrigerant leak second control, and then performs the refrigerant release promotion control. Specifically, the controller 60 drives the heat source-side fan F1. The heat source-side fan F1 thus provides a heat source-side air flow AF1 to supply the refrigerant flowing out of the fusible plug 22, from the heat source-side space SF2 to the external space SP3. The controller 60 is then on standby until a service engineer cancels the standby state.

In step S113, when the controller 60 determines that the fusible plug 22 does not malfunction or may not malfunction (NO in S113; when the fusible plug malfunction condition (fusible plug temperature PT≥second temperature Te2) is not satisfied, the processing proceeds to step S116. On the other hand, when the controller 60 determines that the fusible plug 22 malfunctions or may malfunction (YES in S113; when the fusible plug malfunction condition is satisfied), the processing proceeds to step S114.

In step S114, the controller 60 performs the backup control to control a state of each component, thereby preventing an increase in temperature of the fusible plug 22 to the first temperature Te1 or more. Specifically, the controller 60 brings the backup valve 18 into the fully closed state, that is, minimizes the opening degree of the backup valve 18. The backup valve 18 thus prevents a flow of the refrigerant from the receiver 13 to the fusible plug 22. In addition, the controller 60 stops the compressor 11. The controller 60 thus stops the refrigeration cycle in the refrigerant circuit RC so as not to supply the hot gas to the receiver 13, and prevents an increase in temperature of the fusible plug 22 to the first temperature Te1 or more when the fusible plug 22 is not brought into the open state. Moreover, the controller 60 drives the heat source-side fan F1 at the number of rotations for the backup control. The heat source-side fan F1 thus causes heat radiation from the refrigerant in the heat source-side heat exchanger 12 so as to decrease the temperature of the refrigerant to be supplied to the receiver 13, and further prevents an increase in temperature of the fusible plug 22 to the first temperature Te1 or more when the fusible plug 22 is not brought into the open state. The processing then proceeds to step S115.

In step S115, the controller 60 causes the remote controller 50 to output refrigerant leak notification information. The administrator thus knows a situation in which the fusible plug 22 malfunctions or may malfunction. The processing then returns to step S113.

In step S116, when the controller 60 receives no operation start command (NO in S116), the processing returns to step S101. On the other hand, when the controller 60 receives an operation start command (YES in S116), the processing proceeds to step S117.

In step S117, the controller 60 is placed in the normal operating mode. The processing then proceeds to step S118.

In step S118, the controller 60 controls the states of the respective actuators in real time in accordance with the received command, the set temperatures, and the values detected by the various sensors (25 to 28), thereby causing the refrigeration apparatus 100 to perform the cooling operation. Although not illustrated in the drawings, the controller 60 causes the remote controller 50 to display thereon various kinds of information such as the set temperatures. The processing then returns to step S101.

(5) Features of Refrigeration Apparatus 100

(5-1)

The refrigeration apparatus 100 according to this embodiment ensures safety from a refrigerant leak.

In a refrigeration apparatus, for example, damage to or faulty installation of a component constituting a refrigerant circuit may cause a refrigerant leak from the refrigerant circuit. Such a refrigeration apparatus therefore requires measures for ensuring safety upon occurrence of the refrigerant leak. For example, the use of a combustible refrigerant particularly requires measures for ensuring safety. As one of the measures, there has been proposed the following method. Upon detection of a refrigerant leak, a predetermined control valve (e.g., a valve whose opening degree is controllable, such as an electromagnetic valve or an electric valve) in a refrigerant circuit is controlled to have a minimum opening degree, that is, is brought into a closed state. The control valve thus prevents a flow of the refrigerant toward a usage unit, and suppresses occurrence of an additional refrigerant leak at a usage-side space where the usage unit is placed, such as a residence space or a stock space with people coming and going.

A control valve, such as an electromagnetic valve or an electric valve, is incapable of completely blocking a flow of a refrigerant even when being controlled to have a minimum opening degree, that is, even when being brought into a closed state, because of its structure. In other words, the control valve even when being controlled to have the minimum opening degree forms a minute refrigerant path (a minute flow path) to allow a flow of a small amount of refrigerant. Consequently, even when the control valve is controlled to have the minimum opening degree upon occurrence of a refrigerant leak, a small amount of refrigerant flows toward the usage unit through the control valve, and then is retained in the usage-side space. In particular, if the usage-side space is a highly airtight space such as the interior of a prefabricated storehouse, the use of the above method may cause an increase in concentration of the leakage refrigerant in the usage-side space. In other words, it is assumed that safety from a refrigerant leak cannot be sometimes ensured with reliability.

In this respect, the refrigeration apparatus 100, the refrigerant leak sensor 40 detects a refrigerant leak at the usage-side refrigerant circuit RC2. When the refrigerant leak sensor 40 detects the refrigerant leak at the usage-side refrigerant circuit RC2, the controller 60 performs the refrigerant leak first control to bring the heat source-side expansion valve 15 into the closed state. With this configuration, upon occurrence of a refrigerant leak, the refrigerant leak sensor 40 detects the refrigerant leak, and the controller 60 brings into the closed state the heat source-side expansion valve 15 disposed upstream of the usage-side refrigerant circuit RC2 with regard to the flow of the refrigerant. This configuration consequently prevents the flow of the refrigerant toward the usage-side refrigerant circuit RC2 upon occurrence of a refrigerant leak.

In addition, the controller 60 performs the refrigerant leak second control to bring the fusible plug 22 (the refrigerant release mechanism) into the open state. Consequently, upon occurrence of a refrigerant leak, the fusible plug 22 is brought into the open state to release the refrigerant to the outside of the refrigerant circuit RC from the refrigerant circuit RC. This configuration therefore further prevents the flow of the refrigerant toward the usage-side refrigerant circuit RC2.

This configuration therefore more reliably suppresses occurrence of an additional refrigerant leak at the space where the usage-side refrigerant circuit RC2 is disposed, that is, the usage-side space SP1. This configuration thus improves the safety of the refrigeration apparatus 100.

(5-2)

In the refrigeration apparatus 100 according to this embodiment, the controller 60 performs the refrigerant leak second control to cause the heating unit (mainly including the compressor 11, the hot gas pipe P5, and the fusible plug mount pipe P7) to apply heat to the fusible plug 22 to the first temperature Te1. With this configuration, upon occurrence of a refrigerant leak, the controller 60 causes the heating unit to apply heat to the fusible plug 22 to the first temperature Te1. Consequently, upon occurrence of a refrigerant leak, the fusible plug 22 is brought into the open state to release the refrigerant to the outside of the refrigerant circuit RC from the refrigerant circuit RC. This configuration therefore further prevents the flow of the refrigerant toward the usage-side refrigerant circuit RC2.

(5-3)

In the refrigeration apparatus 100 according to this embodiment, the hot gas pipe P5 allows the flow of the hot gas refrigerant discharged from the compressor 11. The hot gas bypass valve 17 is controlled to have the maximum opening degree, that is, brought into the first state to allow the compressor 11 to communicate with the hot gas pipe P5. The controller 60 performs the refrigerant leak second control to drive the compressor 11 and to maximize the opening degree of the hot gas bypass valve 17, that is, to bring the hot gas bypass valve 17 into the first state. The controller 60 thus causes the hot gas pipe P5 to function as the heating unit configured to indirectly apply heat to the fusible plug 22.

With this configuration, the refrigerant pipe, that is, the hot gas pipe P5 in the refrigerant circuit RC functions as the heating unit. This configuration consequently enables the heating unit with a simple structure.

(5-4)

In the refrigeration apparatus 100 according to this embodiment, the controller 60 performs the backup control to control the state of each component, thereby preventing an increase in temperature of the fusible plug 22 to the first temperature Te1 or more when no refrigerant leak occurs, that is, the refrigerant leak sensor 40 detects no refrigerant leak at the usage-side refrigerant circuit RC2 and the fusible plug temperature sensor 27*c* detects that the temperature of the fusible plug 22 is equal to or more than the second temperature Te2 lower than the first temperature Te1.

This configuration prevents an increase in temperature of the fusible plug 22 to the first temperature Te1, and also prevents release of the refrigerant to the outside of the refrigerant circuit RC from the refrigerant circuit RC when no refrigerant leak occurs at the usage-side refrigerant circuit RC2 and the temperature of the fusible plug 22 is equal to or more than the second temperature Te2. This configuration therefore suppresses a decrease in reliability, and also suppresses an increase in cost for repair work or corrective maintenance, in relation to unnecessary release of the refrigerant to the outside of the refrigerant circuit RC.

In the refrigeration apparatus 100 according to this embodiment, the controller 60 causes the remote controller 50 (the output unit) to output predetermined notification information when no refrigerant leak occurs, that is, the refrigerant leak sensor 40 detects no refrigerant leak at the usage-side refrigerant circuit RC2 and the fusible plug temperature sensor 27*c* detects that the temperature of the fusible plug 22 is equal to or more than the second temperature Te2 lower than the first temperature Te1.

With this configuration, the remote controller 50 outputs the predetermined notification information when no refrigerant leak occurs at the usage-side refrigerant circuit RC2 and the temperature of the fusible plug 22 is equal to or more than the second temperature Te2. Consequently, the administrator knows a situation in which the fusible plug 22 malfunctions or may malfunction, and then takes predetermined measures against the situation. This configuration therefore suppresses a decrease in reliability, and also suppresses an increase in cost for repair work or corrective maintenance, in relation to unnecessary release of the refrigerant to the outside of the refrigerant circuit RC from the refrigerant circuit RC.

(5-6)

In the refrigeration apparatus 100 according to this embodiment, the controller 60 brings the backup valve 18 into the closed state, that is, minimizes the opening degree of the backup valve 18 when the refrigerant leak sensor 40 detects no refrigerant leak at the usage side refrigerant circuit RC2 and the fusible plug temperature sensor 27*c* detects that the temperature of the fusible plug 22 is equal to or more than the second temperature Te2 lower than the first temperature Te1. The backup valve 18 is configured to control the flow-rate of the refrigerant flowing into fusible plug 22, in accordance with the opening degree thereof.

With this configuration, the controller 60 brings the backup valve 18 into the closed state to prevent the flow of the refrigerant toward the fusible plug 22 when no refrigerant leak occurs, that is, the refrigerant leak sensor 40 detects no refrigerant leak at the usage-side refrigerant circuit RC2 and the temperature of the fusible plug 22 is equal to or more than the second temperature Te2. Consequently, this configuration prevents release of the refrigerant to the outside of the refrigerant circuit RC from the refrigerant circuit RC when the fusible plug 22 malfunctions or may malfunction. This configuration therefore suppresses a decrease in reliability, and also suppresses an increase in cost for repair work or corrective maintenance, in relation to unnecessary release of the refrigerant to the outside of the refrigerant circuit RC from the refrigerant circuit RC.

(5-7)

In the refrigeration apparatus 100 according to this embodiment, the heat source-side heat exchanger 12 is disposed between the discharge pipe, that is, the first gas-side refrigerant pipe P1 for the compressor 11 and the fusible plug 22 in the refrigerant circuit RC to cause the refrigerant to exchange heat with the heat source-side air flow AF1, thereby functioning as a radiator for the refrigerant. The controller 60 performs the refrigerant leak second control to stop the heat source-side fan F1 configured to provide the heat source-side air flow AF1.

With this configuration, the controller 60 performs the refrigerant leak second control to stop the heat source-side F1, thereby suppressing heat radiation from or condensation of the refrigerant in the heat source-side heat exchanger 12. Consequently, the controller 60 performs the refrigerant leak second control to supply the hot gas to the hot gas pipe P5 in a shorter time and to promptly increase the temperature of the fusible plug 22 to the first temperature Te1.

(5-8)

In the refrigeration apparatus 100 according to this embodiment, the heat source-side fan F1 provides the heat source-side air flow AF1 to be directed to the external space SP3 from the heat source-side space SP2 where the fusible plug 22 is disposed. The controller 60 drives the heat source-side fan F1 after completion of the refrigerant leak second control.

With this configuration, the heat source-side fan F1 is driven to provide the heat source-side air flow AF1 after completion of the refrigerant leak second control. This configuration consequently promotes release of the refrigerant to the external space SP3 through the fusible plug 22. This configuration therefore prevents occurrence of a situation in which the refrigerant flowing out of the fusible plug 22 leaks at a hazardous concentration in the heat source-side space SP2 where the fusible plug 22 is disposed.

(5-9)

In the refrigeration apparatus 100 according to this embodiment, the controller 60 performs the refrigerant leak second control after completion of the refrigerant leak first control. With this configuration, upon occurrence of a refrigerant leak, the controller 60 brings the heat source-side expansion valve 15 into the closed state to suppress the refrigerant leak at the usage-side space SP1, and performs a predetermined process before bringing the fusible plug 22 into the open state, that is, before releasing the refrigerant to the outside of the refrigerant circuit RC from the refrigerant circuit RC. For example, the controller 60 performs the refrigerant recovery operation to recover the refrigerant into the predetermined reservoir, before bringing the fusible plug 22 into the open state. When the refrigerant leak sensor 40 detects the refrigerant leak, the controller 60 outputs refrigerant leak notification information to the administrator or makes a decision as to whether the refrigerant leak sensor 40 erroneously detects the refrigerant leak, before releasing the refrigerant to the outside of the refrigerant circuit RC from the refrigerant circuit RC. In addition, when the refrigerant leak sensor 40 detects the refrigerant leak, the controller 60 ensures a grace for ascertaining whether the refrigerant leak sensor 40 erroneously detects the refrigerant leak, before releasing the refrigerant to the outside of the refrigerant circuit RC from the refrigerant circuit RC.

(5-10)

In the refrigeration apparatus 100 according to this embodiment, the controller 60 performs the refrigerant leak first control to drive the compressor 11 and to recover the refrigerant into the receiver 13. With this configuration, upon occurrence of a refrigerant leak, the controller 60 recovers the refrigerant into the receiver 13, thereby further preventing the flow of the refrigerant toward the usage-side space SP1. This configuration also enables effective release of the refrigerant from the refrigerant circuit RC through the fusible plug 22.

(5-11)

In the refrigeration apparatus 100 according to this embodiment, the controller 60 performs the refrigerant leak second control after the lapse of the predetermined time t2 from the completion of the refrigerant leak first control. The predetermined time t2 is calculated based on the amount of refrigerant passing through the heat source-side expansion valve 15 brought into the closed state, in accordance with the characteristic of the heat source-side expansion valve 15. In addition, the predetermined time t2 is set to the length required for the refrigerant to reach the concentration of the predetermined value V1 in the usage-side space SP1 where the usage-side refrigerant circuit RC2 is disposed.

With this configuration, upon occurrence of a refrigerant leak, the controller 60 brings the heat source-side expansion valve 15 into the closed state and, after the lapse of the predetermined time t2, performs the refrigerant leak second control. Consequently, upon occurrence of a refrigerant leak, the controller 60 delays release of the refrigerant from the refrigerant circuit RC through the fusible plug 22 until the concentration of the refrigerant takes a hazardous value such as the predetermined value V1 in the usage-side space SP1.

Specifically, upon occurrence of a refrigerant leak, the controller 60 performs a predetermined process until the laps of the predetermined time t2 during which the safety is ensured, without releasing the refrigerant to the outside of the refrigerant circuit RC from the refrigerant circuit RC through the fusible plug 22. For example, the controller 60 performs the pump down operation to recover the refrigerant into the receiver 13 before the lapse of the predetermined time t2, that is, before bringing the fusible plug 22 into the open state. When the refrigerant leak sensor 40 detects the refrigerant leak, the controller 60 outputs the refrigerant leak notification information to the administrator or makes a decision as to whether the refrigerant leak sensor 40 erroneously detects the refrigerant leak, before the lapse of the predetermined time t2, that is, before releasing the refrigerant to the outside of the refrigerant circuit RC from the refrigerant circuit RC. In addition, when the refrigerant leak sensor 40 detects the refrigerant leak, the controller 60 ensures a grace for ascertaining whether the refrigerant leak sensor 40 erroneously detects the refrigerant leak, before releasing the refrigerant to the outside of the refrigerant circuit RC from the refrigerant circuit RC.

(5-12)

In the refrigeration apparatus 100 according to this embodiment, the controller 60 performs the refrigerant leak first control when the concentration of the refrigerant based on the value detected by the refrigerant leak sensor 40, that is, based on the refrigerant leak sensor detection signal takes a value equal to or more than the first reference value SV1, and performs the refrigerant leak second control when the concentration of the refrigerant based on the detected value takes a value equal to or more than the second reference value SV2 larger than the first reference value SV1.

With this configuration, the controller 60 performs the refrigerant leak first control and the refrigerant leak second control in a stepwise manner in accordance with the concentration of the leakage refrigerant detected by the refrigerant leak sensor 40. Specifically, when the concentration of the refrigerant detected by the refrigerant leak sensor 40 takes a less hazardous value such as the first reference value SV1, the controller 60 performs the refrigerant leak first control to bring the heat source-side expansion valve 15 into the closed state and to suppress occurrence of an additional refrigerant leak at the usage-side space SP1. Moreover, the controller 60 does not perform the refrigerant leak second control, thereby holding release of the refrigerant to the outside of the refrigerant circuit RC from the refrigerant circuit RC through the fusible plug 22.

On the other hand, when the concentration of the refrigerant detected by the refrigerant leak sensor 40 takes a considerably hazardous value such as the second reference value SV2, the controller 60 performs, in addition to the refrigerant leak first control, the refrigerant leak second control to release the refrigerant the refrigerant to the outside of the refrigerant circuit RC from the refrigerant circuit RC through the fusible plug 22. On the assumption that the concentration of the leakage refrigerant is very hazardous, this configuration further suppresses the flow of the refrigerant toward the usage-side refrigerant circuit RC2, and further suppresses an increase in concentration of the refrigerant in the usage-side space SP1.

This configuration therefore ensures the safety upon occurrence of a refrigerant leak, and suppresses an increase in cost for repair work or corrective maintenance, in relation to less necessary release of the refrigerant the refrigerant to the outside of the refrigerant circuit RC from the refrigerant circuit RC by the refrigerant leak second control.

(5-13)

In the refrigeration apparatus 100 according to this embodiment, the controller 60, specifically the erroneous detection determination unit 65 makes a decision as to whether the refrigerant leak sensor 40 erroneously detects a refrigerant leak, based on the value detected by the refrigerant state sensor, that is, the suction pressure sensor 25 configured to detect the state of the refrigerant in the refrigerant circuit RC. The controller 60, specifically the component control unit 67 performs the refrigerant leak second control when the erroneous detection determination unit 65 decides that the refrigerant leak sensor 40 correctly detects the refrigerant leak.

If the refrigerant leak sensor 40 erroneously detects the refrigerant leak, this configuration suppresses occurrence of a situation in which the controller 60 performs the refrigerant leak second control to release the refrigerant the refrigerant to the outside of the refrigerant circuit PC from the refrigerant circuit RC. This configuration therefore suppresses an increase in cost for repair work or corrective maintenance in relation to unnecessary release of the refrigerant the refrigerant to the outside of the refrigerant circuit RC from the refrigerant circuit RC by the refrigerant leak second control.

(6) Modifications

The foregoing embodiment may be appropriately modified as described in the following modifications. It should be noted that these modifications are applicable in conjunction with other modifications insofar as there are no consistencies.

(6-1) Modification 1

In the foregoing embodiment, the heat source-side expansion valve 15 is controlled to have the minimum opening degree, that is, brought into the closed state by the refrigerant leak first control to function as the control valve (corresponding to a first control valve in the claims) configured to prevent the flow of the refrigerant toward the usage-side refrigerant circuit RC2 upon occurrence of a refrigerant leak. Alternatively, any valve rather than the heat source-side expansion valve 15 may function as the first control valve.

Figure 5:
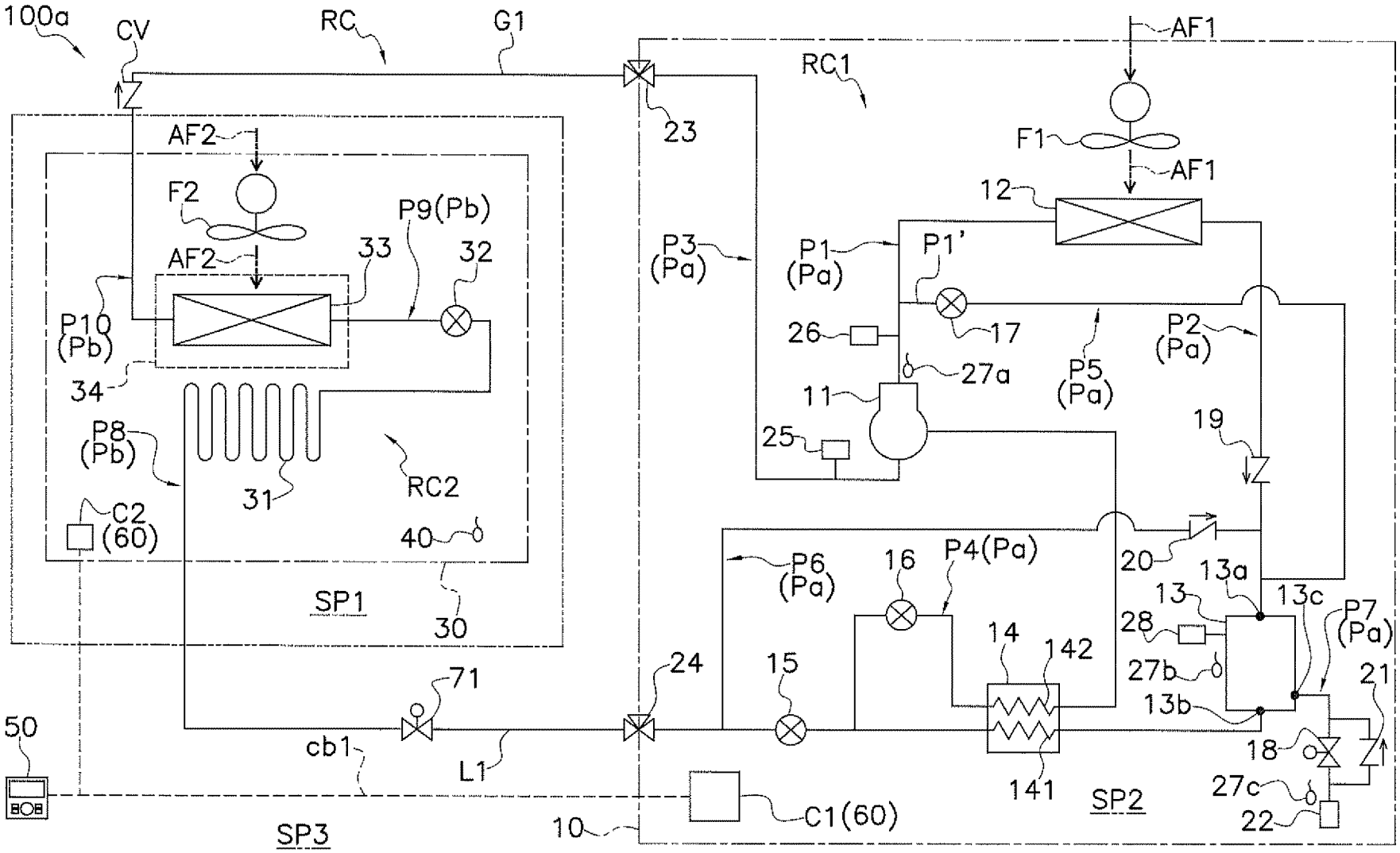
FIG. 5 is a schematic configuration diagram of a refrigeration apparatus according to Modification 1.

For example, as in a refrigeration apparatus 100*a* illustrated in FIG. 5, a first electromagnetic valve 71 is disposed on a liquid-side connection pipe L1. A controller 60 performs refrigerant leak first control to bring the first electromagnetic valve 71 into a fully closed state, that is, to minimize an opening degree of the first electromagnetic valve 71. With this configuration, the first electromagnetic valve 71 may function as a control valve (a first control valve) configured to prevent a How of a refrigerant toward a usage-side refrigerant circuit RC2 upon occurrence of a refrigerant leak. This configuration produces similar operations and effects to those in the foregoing embodiment.

Figure 6:
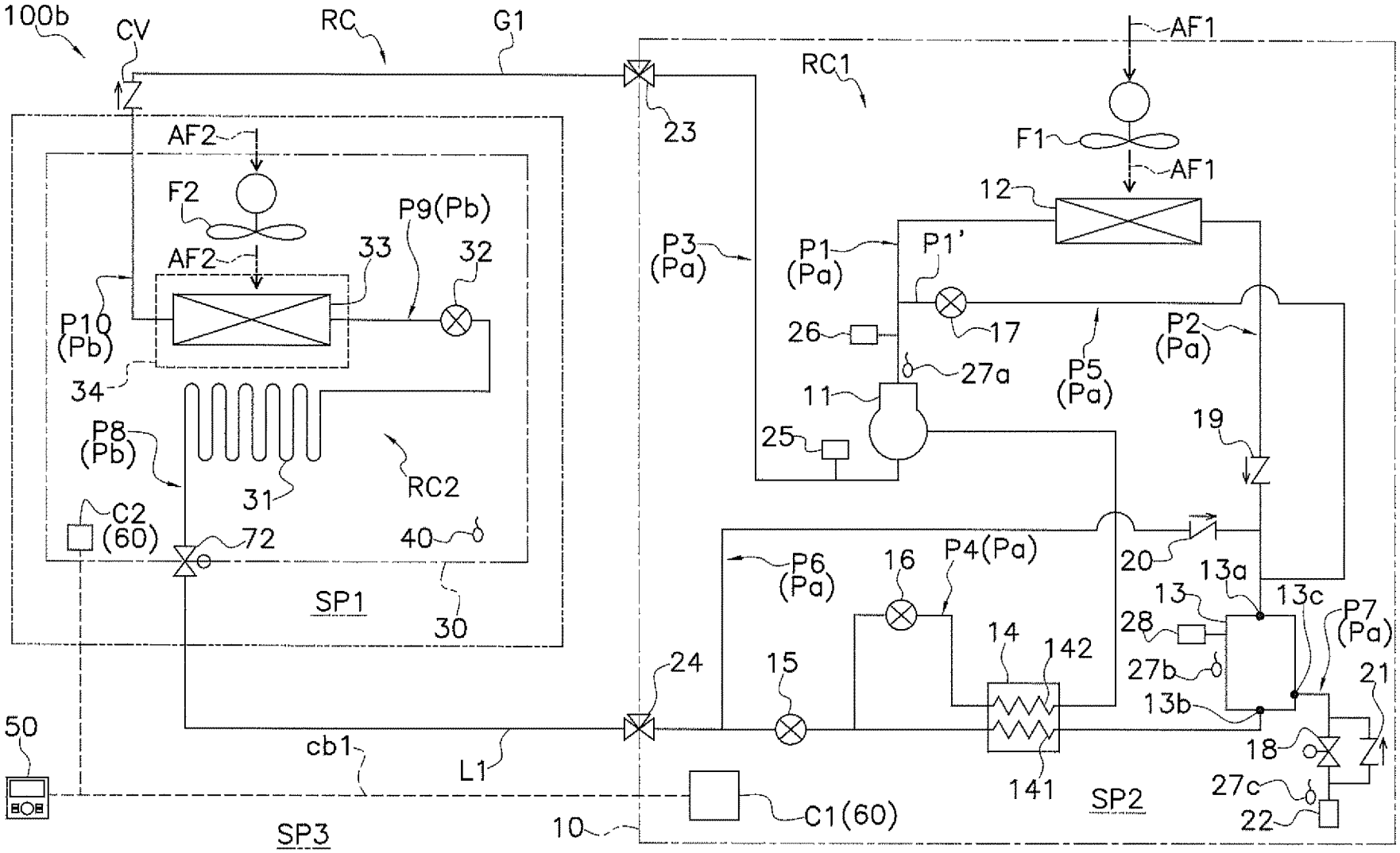
FIG. 6 is a schematic configuration diagram of another refrigeration apparatus according to Modification 1.

Alternatively, in a refrigeration apparatus 100*b* illustrated in FIG. 6, a usage unit 30 includes a second electromagnetic valve 72 disposed between a first liquid-side refrigerant pipe P8 and a liquid-side connection pipe L1. A controller 60 performs refrigerant leak first control to bring the second electromagnetic valve 72 into a fully closed state, that is, to minimize an opening degree of the second electromagnetic valve 72. With this configuration, the second electromagnetic valve 72 may function as a control valve (a first control valve) configured to prevent a flow of a refrigerant to a usage-side refrigerant circuit RC2 upon occurrence of a refrigerant leak. This configuration also produces similar operations and effects to those in the foregoing embodiment.

It should be noted that each of the first electromagnetic valve 71 and the second electromagnetic valve 72 may be an electric valve. In other words, a valve functioning as the first control valve may be either an electromagnetic valve or an electric valve as long as it is controllable.

(6-2) Modification 2

In the foregoing embodiment, the fusible plug mount pipe P7 is disposed between the receiver 13 and the fusible plug 22. In addition, the backup valve 18 and the third check valve 21 are disposed on the fusible plug mount pipe P7. In other words, the fusible plug 22 is coupled to the receiver 13 via the fusible plug mount pipe P7. However, how to mount the fusible plug 22 is not limited as long as the fusible plug 22 is capable of releasing the refrigerant to the outside of the refrigerant circuit RC from the refrigerant circuit RC, and may be appropriately changed in accordance with installation environments and design specifications.

Figure 7:
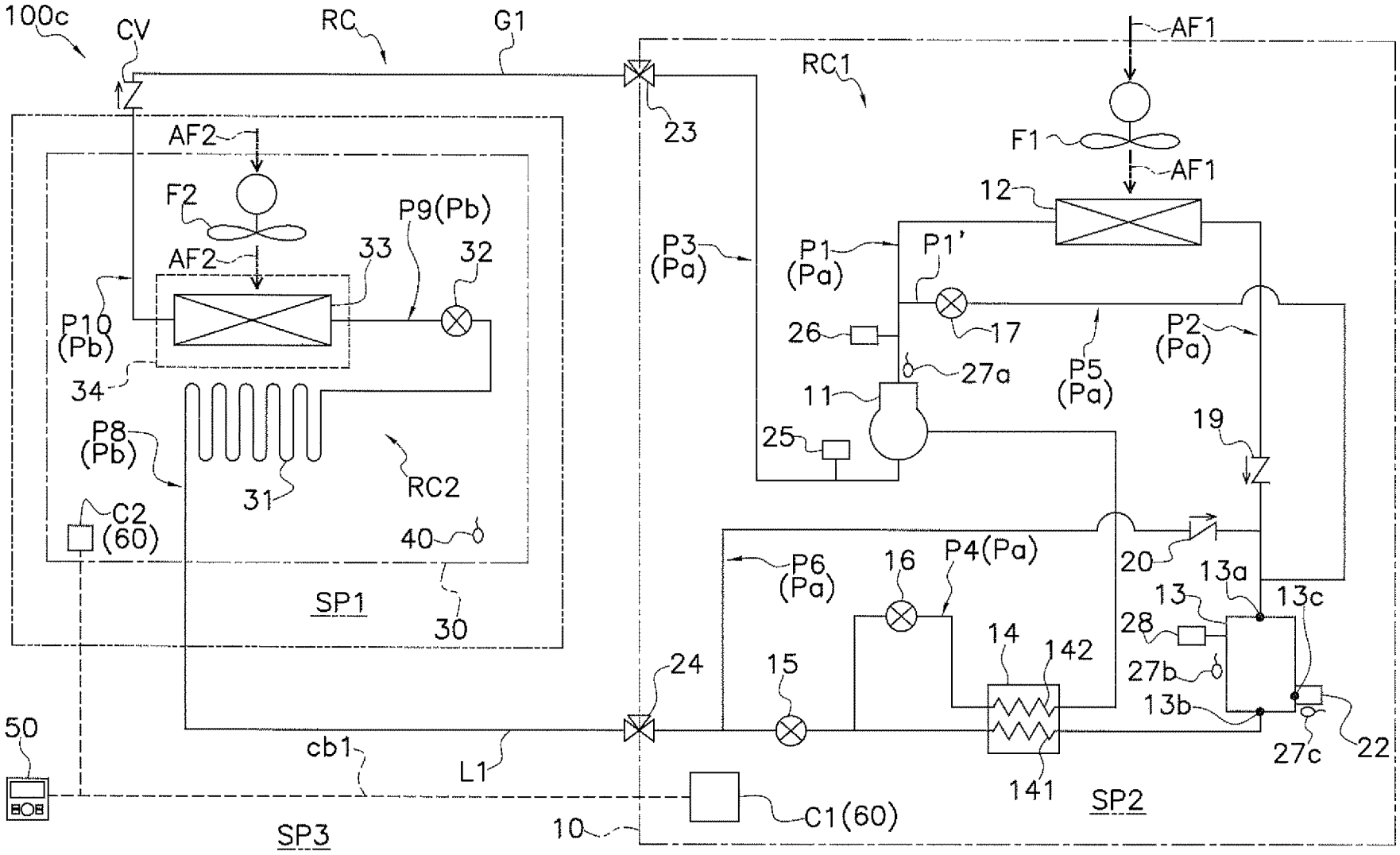
FIG. 7 is a schematic configuration diagram of a refrigeration apparatus according to Modification 2.

For example, in a refrigeration apparatus 100*c* illustrated in FIG. 7, a fusible plug 22 may be directly connected to a receiver 13, more specifically a bypass port 13*c*. The refrigeration apparatus 100*c* does not include the fusible plug mount pipe P7, the backup valve 18, and the third check valve 21 described in the foregoing embodiment. This configuration produces similar operations and effects to those in the foregoing embodiment, except for the operation and effects described in (5-10).

(6-3) Modification 3

In the foregoing embodiment, the controller 60 performs the refrigerant leak second control to maximize the opening degree of the injection valve 16 and the opening degree of the hot gas bypass valve 17 and to bring the backup valve 18 into the fully open state. Moreover, the controller 60 also performs the refrigerant leak second control to drive the compressor 11 at the number of rotations for the refrigerant leak second control. With this configuration, the hot gas discharged from the compressor 11 is supplied to the receiver 13 via the hot gas pipe P5, and then is supplied from the receiver 13 to the fusible plug 22 via the fusible plug mount pipe P7. The fusible plug 22 is thus heated to the first temperature Te1. In other words, the controller 60 performs the refrigerant leak second control to cause mainly the compressor 11, the hot gas pipe P5, and the fusible plug mount pipe P7 to function as the heating unit configured to directly or indirectly apply heat to the fusible plug 22.

However, the configuration of the heating unit is not limited thereto. For example, other components may function as the heating unit as long as the components are configured to apply heat to the fusible plug 22 to the first temperature Te1 or more by the refrigerant leak second control.

Figure 8:
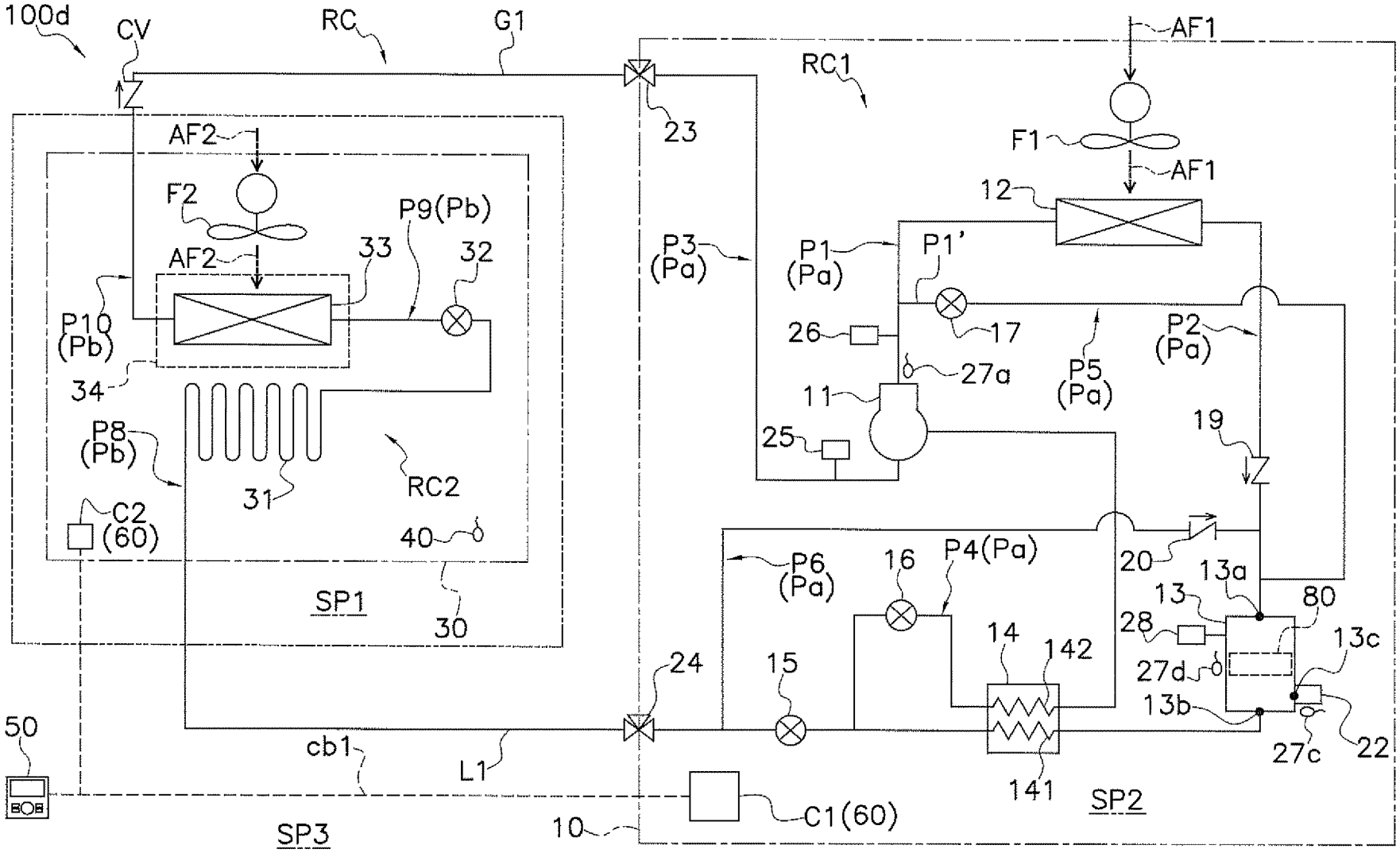
FIG. 8 is a schematic configuration diagram of a refrigeration apparatus according to Modification 3.

For example, in a refrigeration apparatus 100*d* illustrated in FIG. 8, an electric heater 80 is disposed in a receiver 13 to which a fusible plug 22 is connected. The electric heater 80 may be a typical general-purpose product to be brought into a heating state in which the electric heater 80 generates heat by energization. The electric heater 80 when being brought into the heating state applies heat to the fusible plug 22 or a refrigerant in the receiver 13. Also in the refrigeration apparatus 100*d*, a heater temperature sensor 27*d*, such as a thermistor or a thermocouple, is disposed on the electric heater 80 to detect a temperature of the electric heater 80. The electric heater 80 and the heater temperature sensor 27*d* are electrically connected to a controller 60. A component control unit 67 adjusts a voltage to be applied to the electric heater 80, and a detected value storage region M2 stores therein a value TE detected by the heater temperature sensor 27*d* (corresponding to a heating temperature detection unit in the claims).

Figure 9:
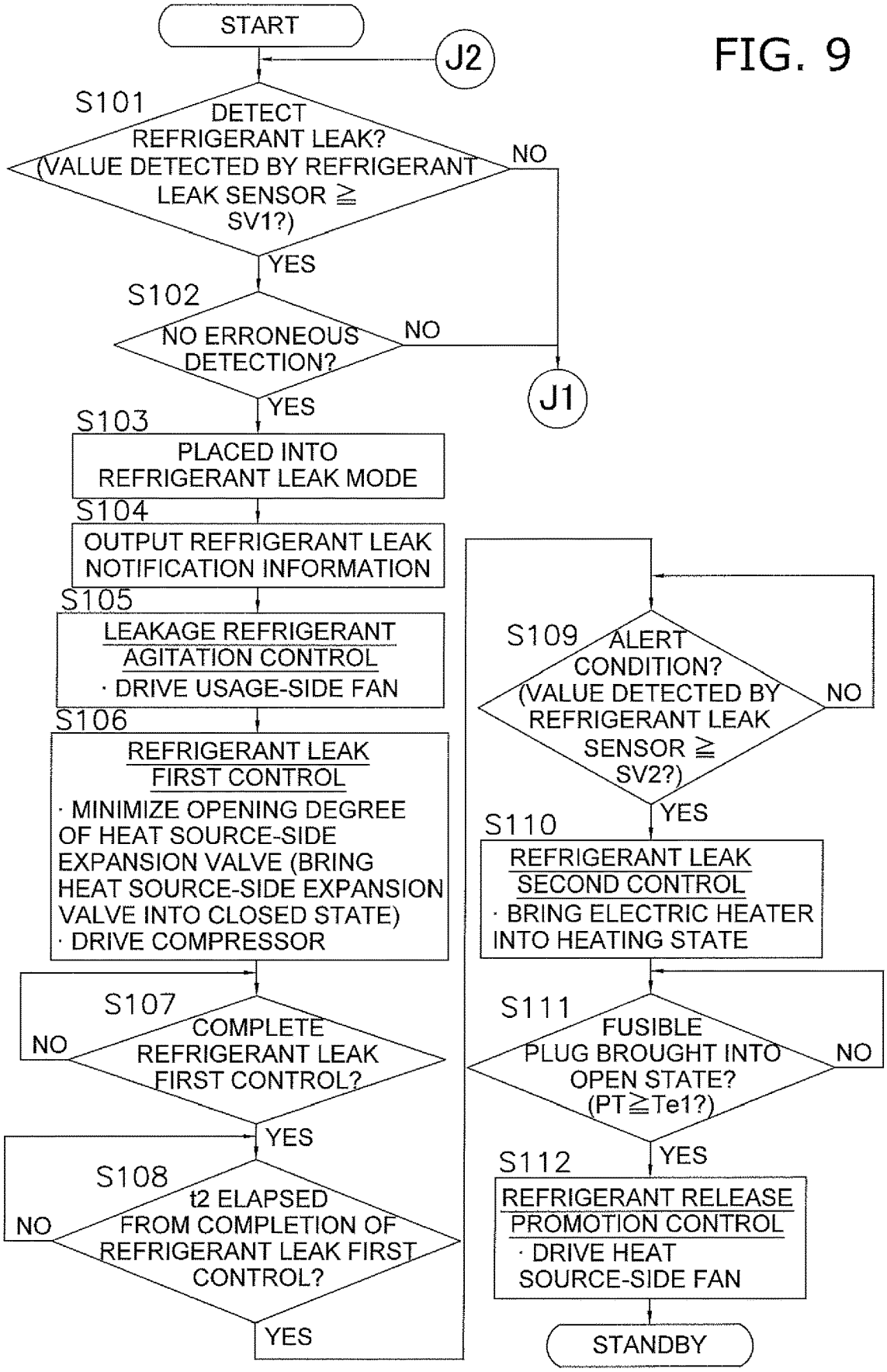
FIG. 9 is a flowchart of exemplary processing to be performed by a controller in the refrigeration apparatus according to Modification 3.

In the refrigeration apparatus 100*d* having the configuration described above, as illustrated in a flowchart of FIG. 9, the controller 60 performs refrigerant leak second control to energize the electric heater 80 and to bring the electric heater 80 into the heating state (step S110'). The controller 60, specifically the component control unit 67 applies a voltage to the electric heater 80, the voltage being appropriate for the electric heater 80 to generate heat at a temperature equal to or more than a first temperature Te1, based on the value TE detected by the heater temperature sensor 27*d* and stored in the detected value storage region M2. By the refrigerant leak second control, a fusible plug 22 is directly heated with heat generated by the electric heater 80 or is heated with a refrigerant heated with the heat generated by the electric heater 80, to a temperature equal to or more than the first temperature Te1. In the refrigeration apparatus 100*d*, the controller performs the refrigerant leak second control to bring the electric heater 80 into the heating state, based on the value TE detected by the heater temperature sensor 27*d*. The controller thus causes the electric heater 80 to function as a heating unit configured to directly or indirectly apply heat to the fusible plug 22.

The refrigeration apparatus 100*d* also produces similar operations and effects to those of the refrigeration apparatus 100 according to the foregoing embodiment.

(6-4) Modification 4

Figure 10:
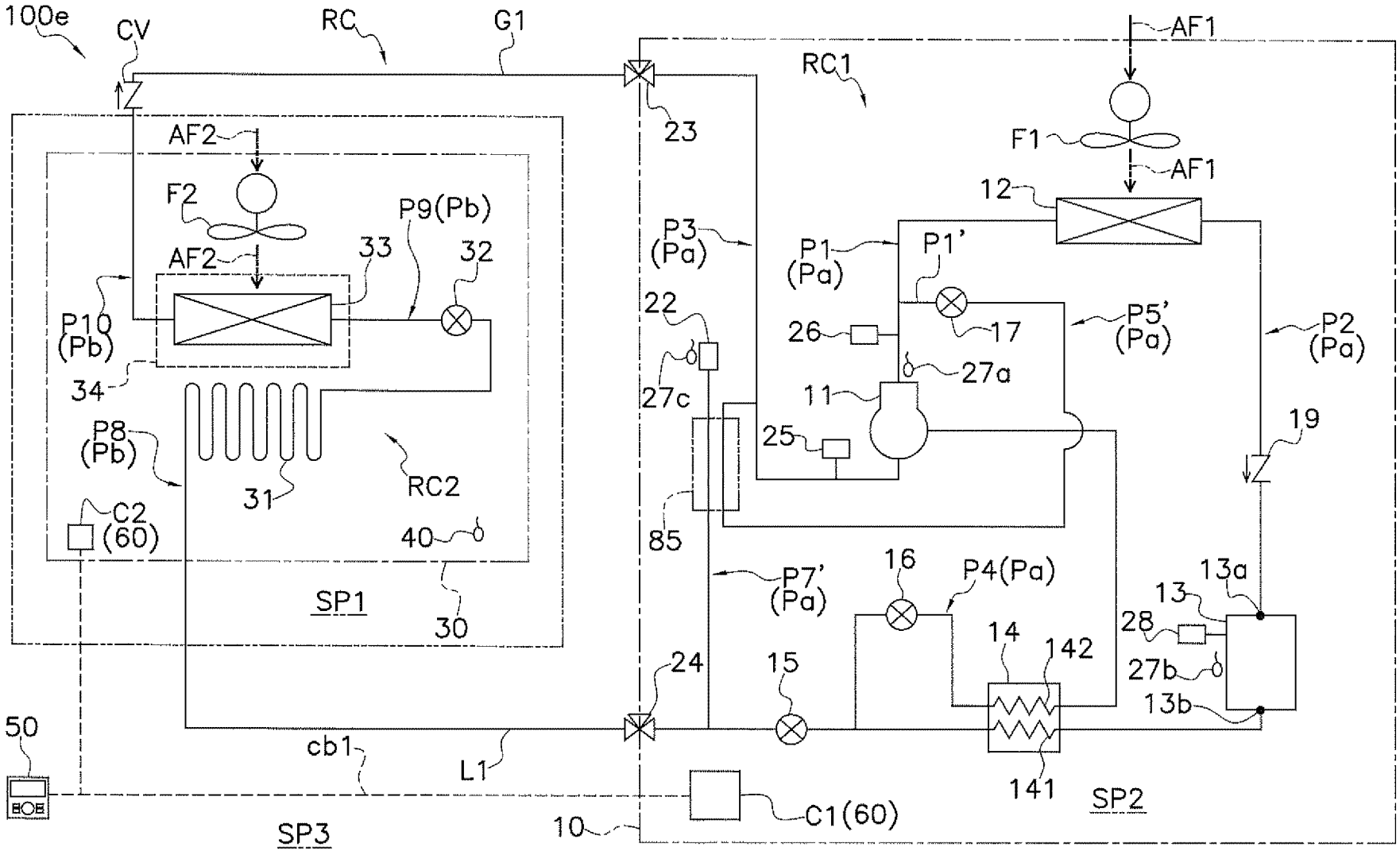
FIG. 10 is a schematic configuration diagram of a refrigeration apparatus according to Modification 4.

The refrigeration apparatus 100 according to the foregoing embodiment may be configured like a refrigeration apparatus 100*e* illustrated in FIG. 10. In the refrigeration apparatus 100*e*, a fusible plug mount pipe P7' on which a fusible plug 22 is disposed is connected to a liquid-side refrigerant pipe P2 at a position between a heat source-side expansion valve 15 and a liquid-side shutoff valve 24. A hot gas pipe P5' has a first end connected to a hot gas bypass valve 17, and a second end connected to a second gas-side refrigerant pipe P3. Also in the refrigeration apparatus 100*e*, a heater 85 thermally connects the fusible plug mount pipe P7' to the hot gas pipe P5'. In other words, the fusible plug mount pipe P7' is thermally connected to the hot gas pipe P5'.

In the refrigeration apparatus 100*e* having the configuration described above, as in the foregoing embodiment, a controller 60 performs refrigerant leak second control to bring each of an injection valve 16 and the hot gas bypass valve 17 into an open state, that is, to maximize an opening degree of the injection valve 16 and an opening degree of the hot gas bypass valve 17. The controller 60 also performs the refrigerant leak second control to drive a compressor 11 at a number of rotations for the refrigerant leak second control. The controller 60 thus causes a hot gas discharged from the compressor 11 to flow through the hot gas pipe P5'. Consequently, the heater 85 causes the hot gas in the hot gas pipe P5' to exchange heat with the refrigerant in the fusible plug mount pine P7', more specifically the refrigerant passing through a heat source-side expansion valve 15 brought into in a closed state. In the refrigerant leak second control, even when the refrigerant passes through the heat source-side expansion valve 15 brought into the closed state, the refrigerant is heated at the fusible plug mount pipe P7' to apply heat to the fusible plug 22 to a temperature equal to or more than the first temperature Te1. In such a case, the controller 60 performs the refrigerant leak second control to cause mainly the hot gas pipe P5', the compressor 11, and the heater 85 to function as a heating unit configured to indirectly apply heat to the fusible plug 22.

The refrigeration apparatus 100*e* also produces similar operations and effects to those of the refrigeration apparatus 100 according to the foregoing embodiment.

In the refrigeration apparatus 100*e*, the heater 85 may include an electric heater similar to the electric heater 80 of the refrigeration apparatus 100*d*. The controller 60 may perform the refrigerant leak second control to bring the electric heater into the heating state. The electric heater may thus apply heat to the fusible plug 22 or the refrigerant in the fusible plug mount pipe P7'. In other words, the electric heater may function as a heating unit. In such a case, the refrigeration apparatus 100*e* does not necessarily include the hot gas pipe P5' and the hot gas bypass valve 17.

Figure 11:
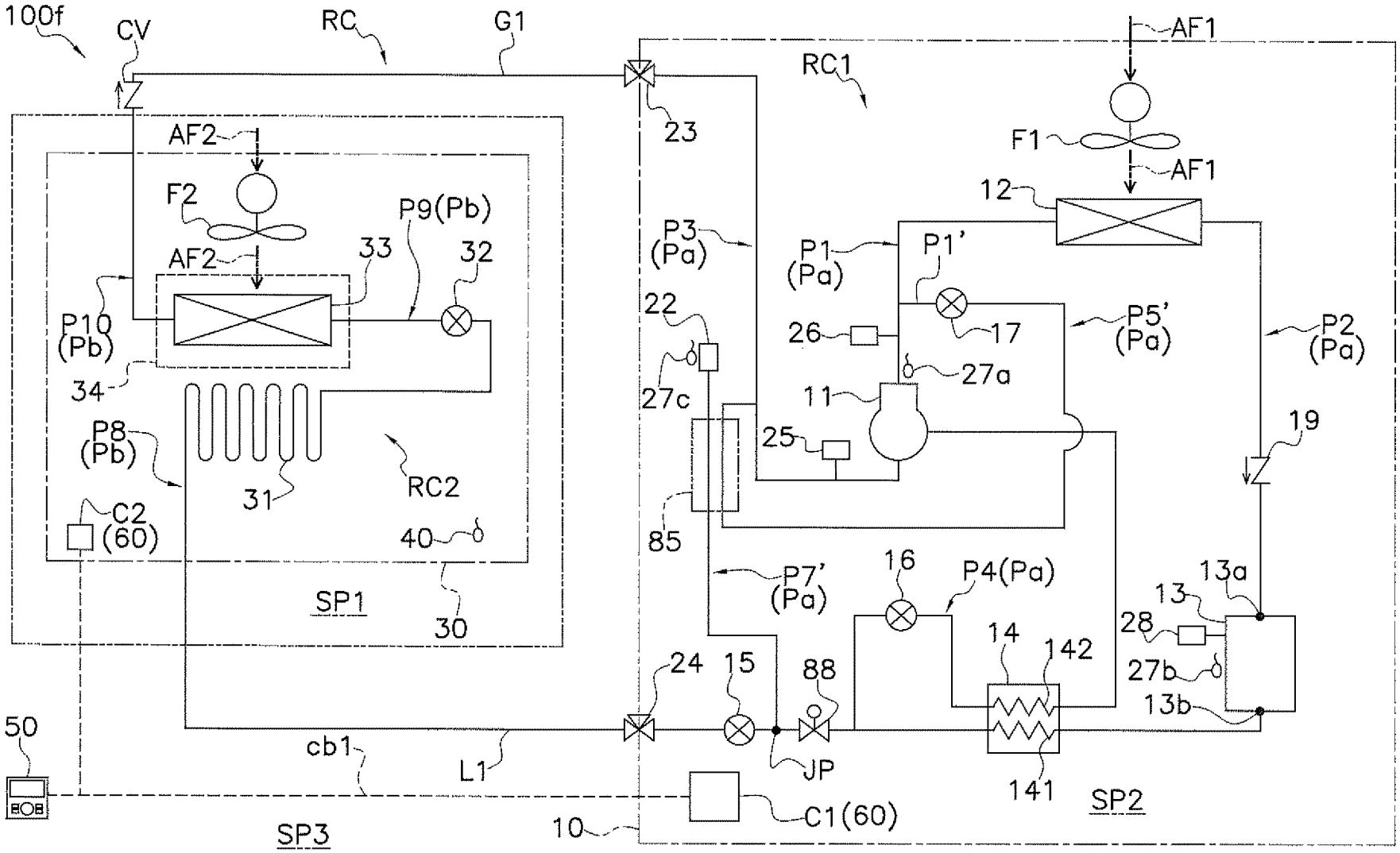
FIG. 11 is a schematic configuration diagram of another refrigeration apparatus according to Modification 4.
Figure 12:
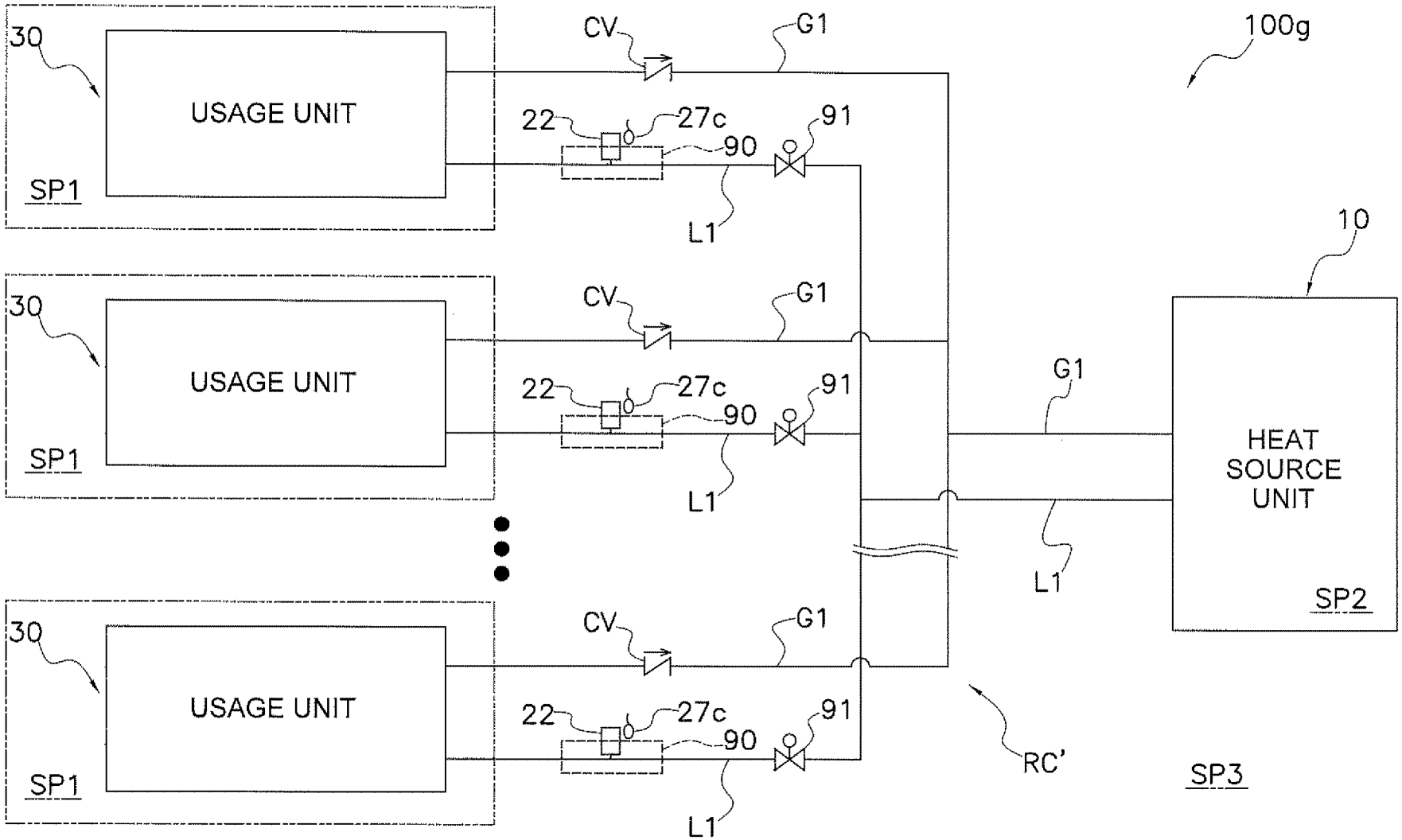
FIG. 12 is a schematic configuration diagram of a refrigeration apparatus according to Modification 5.

The refrigeration apparatus 100*e* may be configured like a refrigeration apparatus 100*f* illustrated in FIG. 11. In the refrigeration apparatus 100*f*, an on-off valve 88 (an electromagnetic valve) is disposed upstream of a joint JP between a fusible plug mount pipe P7' and a liquid-side refrigerant pipe P2 with regard to a flow of a refrigerant. In the refrigeration apparatus 100*f* having the configuration described above, a controller 60 performs refrigerant leak first control to minimize an opening degree of each of a heat source-side expansion valve 15 and the on-off valve 88 for a refrigerant leak usage unit 30, that is, to bring each of the heat source-side expansion valve 15 and the on-off valve 88 into a closed state. This configuration thus further prevents a flow of the refrigerant into the refrigerant leak usage unit 30, and suppresses occurrence of an additional refrigerant leak. The refrigeration apparatus 100*f* also produces similar operations and effects to those of the refrigeration apparatus 100 according to the foregoing embodiment.

The following description concerns operations and effects unique to the refrigeration apparatus 100*f*. In cases where a refrigerant circuit RC is filled with a large amount of refrigerant, for example, in cases where a refrigerant circuit RC includes a plurality of usage units 30, the refrigerant may leak particularly in large amounts upon occurrence of a refrigerant leak. As to such a refrigerant circuit RC, therefore, the refrigerant may more frequently leak at a hazardous concentration in a usage-side space SP1. In addition, such a refrigerant circuit RC requires much more measures for ensuring safety. In this respect, the refrigeration apparatus 100*f* includes two control valves, that is, the heat source-side expansion valve 15 and the on-off valve 88 disposed upstream of the usage unit 30 to prevent a flow of the refrigerant toward a usage-side refrigerant circuit RC2. This configuration thus more reliably ensures the safety.

It should be noted that the on-off valve 88 may be an electric valve.

(6-5) Modification 5

In the refrigeration apparatus 100 according to the foregoing embodiment, one heat source unit 10 and one usage unit 30 are connected to each other via the connection pipes (G1, L1) to constitute the refrigerant circuit RC. However, the number of heat source units 10 and/or the number of usage units 30 may be appropriately changed in accordance with installation environments and design specifications. For example, the refrigerant circuit RC may be constituted of one usage unit 30 and a plurality of heat source units 10 connected in series or in parallel to the usage unit 30. Alternatively, the refrigerant circuit RC may be constituted of one heat source unit 10 and a plurality of usage units 30 connected in series or in parallel to the heat source unit 10.

In such a case, the connection pipes (G1, L1) are branched in accordance with the number of heat source units 10 and the number of usage units 30. For example, the refrigeration apparatus 100 may be configured like a refrigeration apparatus 100*g* illustrated in FIG. 2.

In the refrigeration apparatus 100*g*, a gas-side connection pipe G1 and a liquid-side connection pipe L1 are branched in accordance with the number of usage units 30. More specifically, in the refrigeration apparatus 100*g*, a fusible plug 22, a fusible plug temperature sensor 27*c*, and a fusible plug heating unit 90 (a heating unit) for applying heat to the fusible plug 22 are disposed upstream of each usage unit 30 on each branched portion of the liquid-side connection pipe L1. In addition, an on-off valve 91 is disposed upstream of the fusible plug heating unit 90. Also in the refrigeration apparatus 100*g*, a check valve CV is disposed on each branched portion of the gas-side connection pipe G1. The check valve CV permits a flow of a refrigerant from the corresponding usage unit 30, and interrupts a flow of the refrigerant from a heat source unit 10.

As described above, in the refrigeration apparatus 100*g*, the fusible plug 22, the fusible plug heating unit 90, and the on-off valve 91 are disposed for each usage unit 30, specifically a usage side refrigerant circuit RC2. The fusible plug heating unit 90 includes an electric heater similar to the electric heater 80 of the refrigeration apparatus 100*d* or a hot gas pipe similar to the hot gas pipe P5' of the refrigeration apparatus 100*e*. The on-off valve 91 is a control valve such as an electromagnetic valve or an electric valve.

In the refrigeration apparatus 100*g* having the configuration described above, upon detection of a refrigerant leak at one of the usage units 30, specifically the usage-side refrigerant circuits RC2, a controller 60 performs refrigerant leak first control to minimize an opening degree of the on-off valve 91 for a usage unit 30 at which the refrigerant leak occurs (hereinafter, referred to as a refrigerant leak usage unit 30), that is, to bring the on-off valve 91 into a closed state. This configuration thus prevents a flow of the refrigerant into the refrigerant leak usage unit 30, and suppresses occurrence of an additional refrigerant leak.

In addition, the controller 60 performs refrigerant leak second control to cause the fusible plug heating unit 90 to directly or indirectly apply heat to the fusible plug 22, thereby bringing the fusible plug 22 into an open state. The controller 60 thus releases the refrigerant passing through the on-off valve 91 from a refrigerant circuit RC' toward an external space SP3. This configuration the more reliably prevents occurrence of a situation in which the refrigerant leaks at a hazardous concentration in a usage-side space SP1 where the refrigerant leak usage unit 30 is disposed.

Accordingly, the refrigeration apparatus 100*g* also produces similar operations and effects similar to those of the refrigeration apparatus 100 according to the foregoing embodiment.

Figure 13:
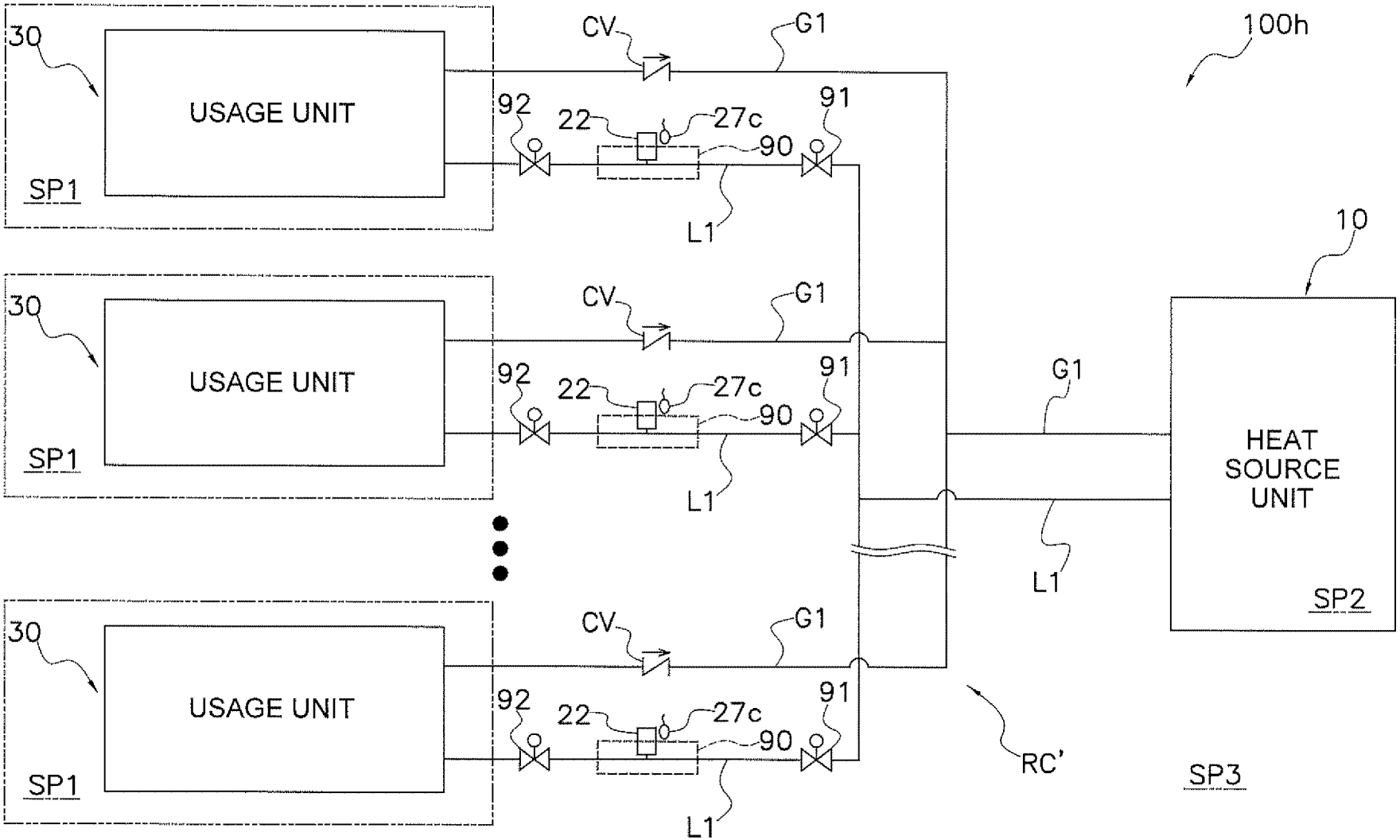
FIG. 13 is a schematic configuration diagram of another refrigeration apparatus according to Modification 5.

The refrigeration apparatus 100*g* may be configured like a refrigeration apparatus 100*h* illustrated in FIG. 13. In the refrigeration apparatus 100*h*, a second on-off valve 92 is disposed downstream of a fusible plug heating unit 90 on each branched portion of a liquid-side connection pipe L1. Specifically, the second on-off valve 92 is disposed between a fusible plug heating unit 90 and each usage unit 30. The second on-off valve 92 is similar in structure to an on-off valve 91. In the refrigeration apparatus 100*h* baying the configuration described above, a controller 60 performs refrigerant leak first control to minimize an opening degree of each of the on-off valve 91 and the second on-off valve 92 for a refrigerant leak usage unit 30, that is, to bring each of the on-off valve 91 and the second on-off valve 92 into a closed state. This configuration thus further prevents a flow of the refrigerant into the refrigerant leak usage unit 30, and suppresses occurrence of an additional refrigerant leak. The refrigeration apparatus 100*h* also produces similar operations and effects to those of the refrigeration apparatus 100 according to the foregoing embodiment.

The following description concerns operations and effects unique to the refrigeration apparat 100*h*. A refrigerant circuit RC' including a plurality of usage units 30 is larger than a refrigerant circuit RC including a single usage unit 30 in regard to an amount of refrigerant in each refrigerant circuit. In addition, the refrigerant circuit RC' including a plurality of usage units 30 is particularly larger than the refrigerant circuit RC including a single usage unit 30 in regard to an amount of leakage refrigerant upon occurrence of a refrigerant leak. As to the refrigerant circuit RC' including a plurality of usage units 30, therefore, the refrigerant may more frequently leak at a hazardous concentration in a usage-side space SP1. In addition, the refrigerant circuit RC' including a plurality of usage units 30 requires much more measures for ensuring safety. In the refrigeration apparatus 100*h*, two control valves, that is, the on-off valve 91 and the second on-off valve 92 are disposed upstream of each usage unit 30 to prevent a flow of the refrigerant into a usage-side refrigerant circuit RC2. Specifically, the on-off valve 91 is disposed upstream of the fusible plug heating unit 90, and the second on-off valve 92 is disposed downstream of the fusible plug heating unit 90. This configuration therefore more reliably ensures safety.

It is assumed herein that in a prefabricated warehouse (a hermetically closed space) which is 1.8 m in length, 1.8 m in width, and 1.8 m in height, each control valve (91, 92) brought into a fully closed state forms a minute flow path with a diameter of 0.1 mm, and a fusible plug 22 brought into an open state has an opening with a diameter of 3 mm. In this case, an amount of refrigerant flowing toward a usage unit 30 through each control valve (91, 92) is reduced to about one five-hundredth. In addition, the refrigerant between the on-off valve 91 and the second on-off valve 92 is not in a liquid state, but is in a mixed gas state by atmospheric pressure. It is therefore assumed that a period of about four or more years is taken until the refrigerant leaks at a hazardous concentration, that is, reaches a combustible range in a usage-side space SP1. Therefore, this configuration suppresses occurrence of a situation in which the refrigerant leaks at a hazardous concentration in the usage-side space SP1 even when the usage-side space SP1 is left in a hermetically closed state for a long period of time.

As described above, in the refrigeration apparatus 100*h*, the fusible plug 22 that allows release of the refrigerant is disposed upstream of each usage unit 30, and the two control valves (91, 92) that prevent the flow of the refrigerant toward the usage-side refrigerant circuit RC2 are also disposed upstream of each usage unit 30. This configuration therefore more reliably ensures the safety.

In the refrigeration apparatus 100*h*, the second on-off valve 92 may be disposed upstream of the fusible plug heating unit 90, that is, may be disposed downstream of the on-off valve 91. In other words, two control valves may be disposed upstream of the fusible plug heating unit 90.

Also in the refrigeration apparatus 100*h*, the on-off valve 91 may be disposed downstream of the fusible plug heating unit 90, that is, may be disposed upstream of the second on-off valve 92. In other words, two control valves may be disposed downstream of the fusible plug heating unit 90.

Also in the refrigeration apparatus 100*h*, a new control valve in addition to the on-off valve 91 and the second on-off valve 92 may be disposed upstream of each usage unit 30. In other words, in the refrigeration apparatus 100*h*, three or more control valves may be disposed upstream of each usage unit 30. This configuration more reliably produces an effect of ensuring safety in the usage-side space SP1.

(6-6) Modification 6

In the foregoing embodiment, R32 is used as the refrigerant circulating through the refrigerant circuit RC. However, the refrigerant for use in the refrigerant circuit RC is not limited, and other refrigerants may be employed. For example, HFO1234yf, HFO1234ze(E), and a mixture thereof may be employed in place of R32 for the refrigerant circuit RC. Alternatively, a hydrofluorocarbon (HFC) refrigerant such as R407C or R410A may be employed for the refrigerant circuit RC. In such a case, the second reference value SV2 may be set at a value equivalent to one-fourth of an oxygen deficiency permissible value (the predetermined value V1).

Figure 14:
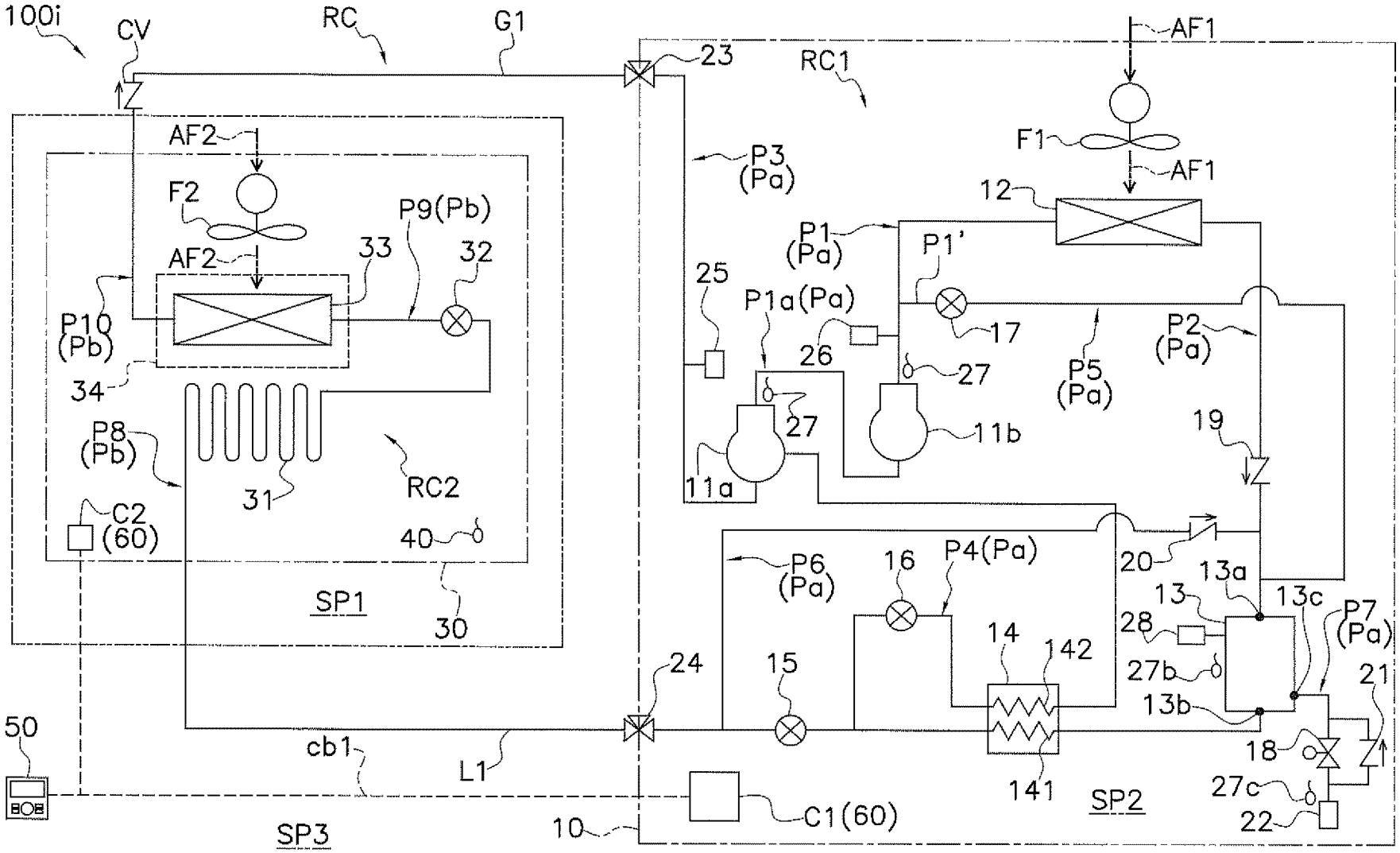
FIG. 14 is a schematic configuration diagram of another refrigeration apparatus according to Modification 6.

Alternatively, a refrigerant such as $CO_2$ or ammonia may be employed for the refrigerant circuit RC. In such a case, the second reference value SV2 may be set at a value equivalent to one-fourth of an oxygen deficiency value or a value harmful to a human body (the predetermined value V1). Also in such a case, the refrigeration apparatus 100 may be configured like a refrigeration apparatus 100*i* illustrated in FIG. 14.

In the refrigeration apparatus 100*i*, a heat source-side refrigerant circuit RC1 includes a plurality of compressors 11, that is, a lower stage-side compressor 11*a* and a higher stage-side compressor 11*b* for a two-stage compression refrigeration cycle. A discharge side of the lower stage-side compressor 11*a* and a suction side of the higher stage-side compressor 11*b* are connected to each other via a pipe P1*a*. The refrigeration apparatus 100*i* is substantially equal to the refrigeration apparatus 100 except for the configuration described above.

The refrigeration apparatus 100*i* also produces similar operations and effects to those of the refrigeration apparatus 100 according to the foregoing embodiment. Also in cases of employing R32 or any HFC refrigerant, a refrigeration apparatus may include a plurality of compressors 11 for a two-stage compression refrigeration cycle, as in the refrigeration apparatus 100*i*.

(6-7) Modification 7

In the foregoing embodiment the fusible plug mount pipe P7 is disposed between the receiver 13 and the fusible plug 22. However, how to mount the fusible plug mount pipe P7 is not limited as long as the fusible plug mount pipe P7 is capable of releasing the refrigerant to the outside of the refrigerant circuit RC from the refrigerant circuit RC when the refrigerant release mechanism is brought into the open state, and may be appropriately changed in accordance with installation environments and design specifications.

Figure 15:
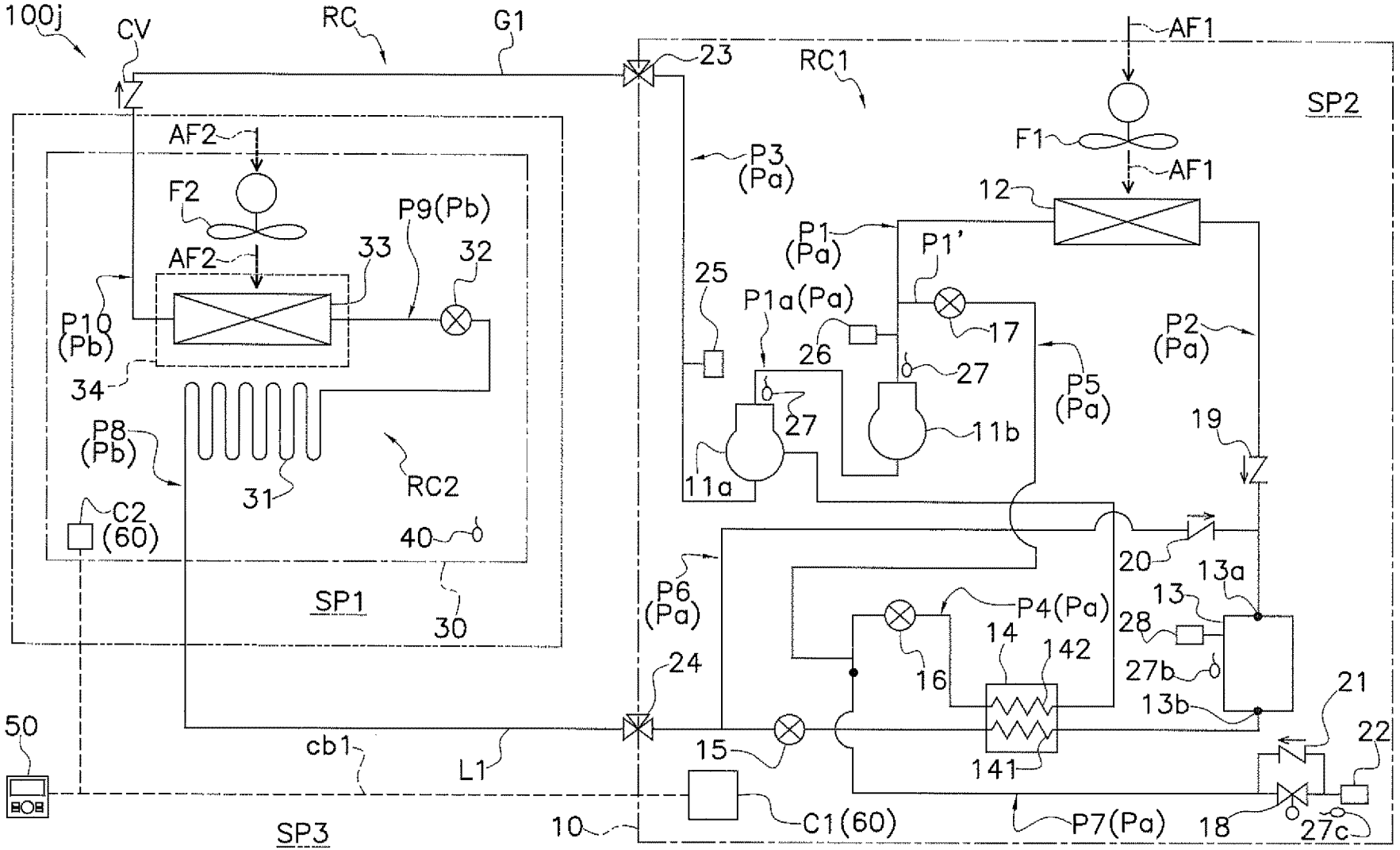
FIG. 15 is a schematic configuration diagram of another refrigeration apparatus according to Modification 7.

For example, in a refrigeration apparatus 100*j* illustrated in FIG. 15, a fusible plug mount pipe P7 may be connected to one end of an injection pipe P4. In such a case, one end of a hot gas pipe P5 may be connected to the injection pipe P4 at a position closer to the fusible plug mount pipe P7 with respect to an injection valve 16.

The refrigeration apparatus 100*j* also produces similar operations and effects to those of the refrigeration apparatus 100 according to the foregoing embodiment. The refrigeration apparatus 100*j* is configured based on the refrigeration apparatus 100*i*, but is not necessarily configured based on the refrigeration apparatus 100*i*. The idea of this modification is applicable to other refrigeration apparatuses, such as the refrigeration apparatuses 100, and 100*a* to 100*h*, in addition to the refrigeration apparatus 100*i*.

(6-8) Modification 8

In the foregoing embodiment, the fusible plug 22 functions as the refrigerant release mechanism to be brought into the open state, thereby allowing the refrigerant circuit RC to communicate with the external space SP3. However, the refrigerant release mechanism is not limited to a fusible plug, and may be any mechanism such as an electromagnetic valve or an electric valve.

Figure 16:
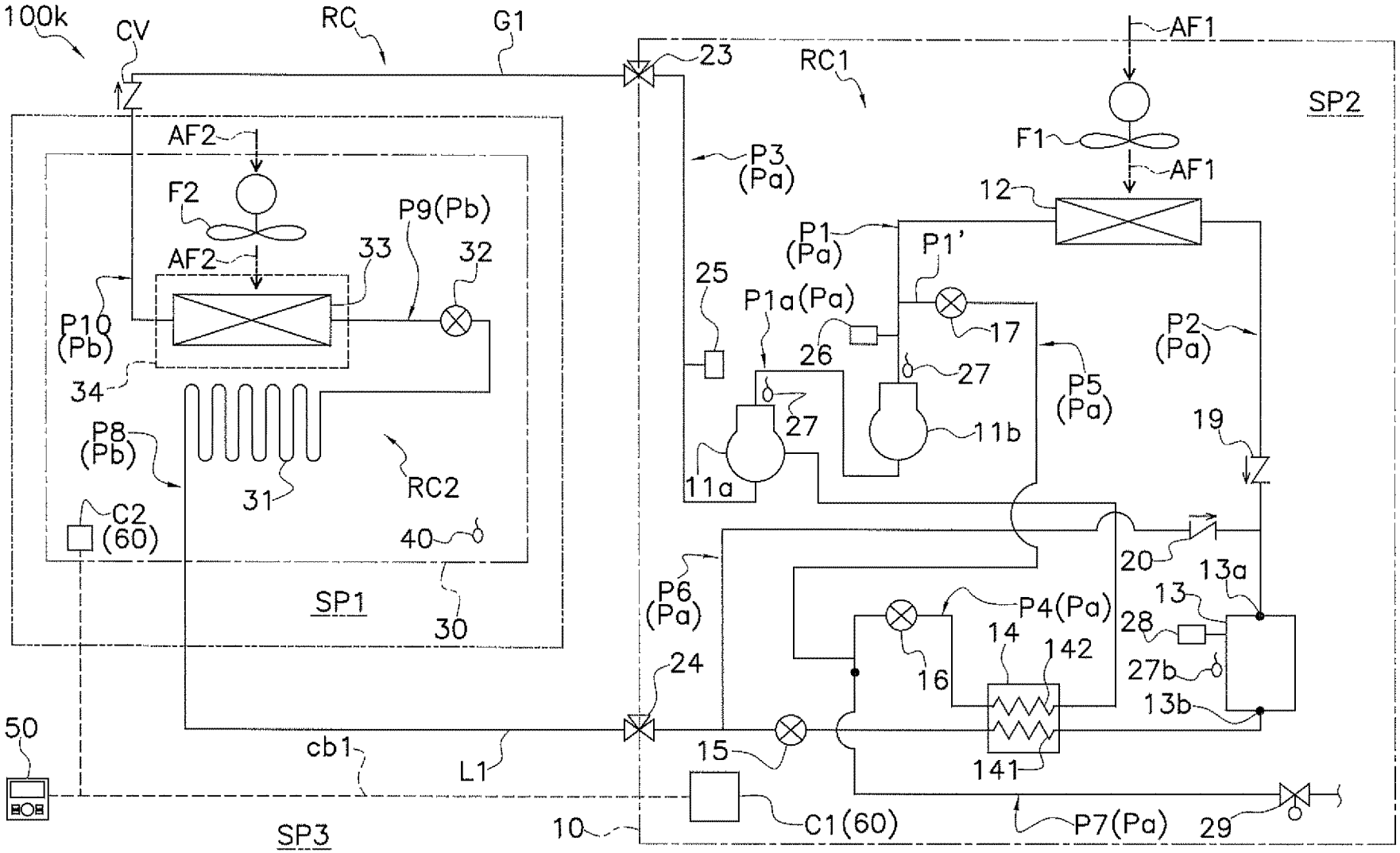
FIG. 16 is a schematic configuration diagram of another refrigeration apparatus according to Modification 8.

For example, the refrigeration apparatus 100 may be configured like a refrigeration apparatus 100*k* illustrated in FIG. 16. The refrigeration apparatus 100*k* is different from the refrigeration apparatus 100*j* in that a refrigerant release valve 29 functions as a refrigerant release mechanism in place of a fusible plug 22. The refrigerant release valve 29 is an electromagnetic valve whose operations (open and closed states) are controllable by a controller 60.

The refrigeration apparatus 100*k* also produces similar operations and effects (particularly the operations and effects described in (5-1)) to those of the refrigeration apparatus 100 according to the foregoing embodiment. It should be noted that the refrigerant release valve 29 in be an electric valve whose opening degree is adjustable. The refrigeration apparatus 100*k* is configured based on the refrigeration apparatus 100*j*, but is not necessarily configured based on the refrigeration apparatus 100*j*. The idea of this modification is applicable to other refrigeration apparatuses, such as the refrigeration apparatuses 100, and 100*a* to 100*i*, in addition to the refrigeration apparatus 100*j*.

(6-9) Modification 9

In the foregoing embodiment, the controller 60 performs the refrigerant leak agitation control upon detection of a refrigerant leak at the usage-side refrigerant circuit RC2 (step S105 of FIG. 3). The refrigerant leak agitation control is preferably performed from the viewpoint of preventing local emergence of a region where the refrigerant leaks at a high concentration in the usage-side space SP1. However, the refrigerant leak agitation control is not necessarily performed, and may be omitted as appropriate in producing the operations and effects described in, for example, (6-1). In other words, step S105 of FIG. 3 may be omitted as appropriate.

(6-10) Modification 10

In the foregoing embodiment, upon detection of a refrigerant leak at the usage-side refrigerant circuit RC2, the controller 60 performs the refrigerant leak first control to drive the compressor 11, thereby performing the pump down operation (step S106 of FIG. 3). The pump down operation is preferably performed from the viewpoint of suppressing occurrence of an additional refrigerant leak at the usage-side refrigerant circuit RC2 and effectively applying heat to the fusible plug 22 by the refrigerant leak second control. In addition, the pump down operation is effective in making a decision as to whether a refrigerant leak is erroneously detected. However, the pump down operation is not necessarily performed, and may be omitted as appropriate in producing the operations and effects described in, for example, (6-1).

(6-11) Modification 11

In the foregoing embodiment, the controller 60 performs the refrigerant leak second control after the lapse of the predetermined time t2 from the completion of the refrigerant leak first control (step S108 of FIG. 3). In other words, a differential time corresponding to the predetermined time t2 is set between the timing of performing the refrigerant leak first control and the timing of performing the refrigerant leak second control. The differential time is effective in making a decision as to whether a refrigerant leak is erroneously detected, and is preferably set from the viewpoint of suppressing an increase in cost for repair work in relation to less necessary release of the refrigerant through the fusible plug 22. In addition, the differential time is effective in making a decision as to weather a refrigerant leak is erroneously detected.

However, the differential time is not necessarily set, and may be omitted as appropriate in producing the operations and effects described in, for example, (6-1). In other words, the controller 60 may concurrently perform the refrigerant leak first control and the refrigerant leak second control. In other words, step S108 of FIG. 3 may be omitted as appropriate.

(6-12) Modification 12

In the foregoing embodiment, upon detection of a refrigerant leak by the refrigerant leak sensor 40, the controller 60 performs the refrigerant leak second control when the predetermined alert condition is satisfied, after completion of the refrigerant leak first control (step S109 of FIG. 3). The trigger of the refrigerant leak second control, that is, the alert condition is preferably set from the viewpoint of suppressing an increase in cost for repair work in relation to less necessary release of the refrigerant through the fusible plug 22.

However, the trigger is not necessarily set, and may be omitted as appropriate in producing the operations and effects described in, for example, (6-1). In other words, step S109 of FIG. 3 may be omitted as appropriate.

(6-13) Modification 13

In the foregoing embodiment, upon detection of a refrigerant leak at the usage-side refrigerant circuit RC2, the controller 60 performs the refrigerant release promotion control after completion of the refrigerant leak second control (step S112 of FIG. 3). The refrigerant release promotion control is preferably performed from the viewpoint of promoting a flow of the refrigerant toward the external space SF3 through the fusible plug 22, thereby preventing local emergence of a region where the refrigerant leaks at a hazardous concentration in the heat source-side space SP2.

However, the refrigerant release promotion control is not necessarily performed, and may be omitted as appropriate in producing the operations and effects described in, for example, (6-1). In other words, step S112 of FIG. 3 may be omitted as appropriate.

(6-14) Modification 14

In the foregoing embodiment, measures against a malfunction of the fusible plug 22 are taken using the backup valve 18, the backup control, and the notification information (steps S114, S115 of FIG. 4). The use of the backup valve 18, the backup control, and the notification information is preferable from the viewpoint of ensuring reliability by virtue of the fusible plug 22 and suppressing an increase in cost for repair work in relation to unnecessary release of the refrigerant through the fusible plug 22.

However, the backup valve 18, the backup control, and/or the notification information are/is not necessarily used, and may be omitted as appropriate in producing the operations and effects described in, for example, (6-1). In other words, step S114 and/or step S115 of FIG. 4 may be omitted as appropriate.

(6-15) Modification 15

In the foregoing embodiment, the controller 60 includes the erroneous detection determination unit 65 configured to make a decision as to whether the refrigerant leak sensor 40 erroneously detects a refrigerant leak (step S102 of FIG. 3). The erroneous detection determination unit 65 is preferably provided from the viewpoint of ensuring reliability and suppressing an increase in cost for repair work in relation to unnecessary release of the refrigerant through the fusible plug 22.

However, the erroneous detection determination unit 65 is not necessarily provided, and may be omitted as appropriate in producing the operations and effects described in, for example, (6-1). In other words, step S102 of FIG. 3 may be omitted as appropriate.

In addition, the tinting of making a decision as to occurrence of erroneous detection, that is, the timing of performing step S102 may be changed. For example, step S102 may be performed after completion of the refrigerant leak first control, that is, may be performed subsequent to step S107.

(6-16) Modification 16

In the foregoing embodiment, the refrigerant leak sensor 40 is disposed inside the usage unit 30 to detect a refrigerant leak at the refrigerant circuit RC, more specifically the usage-side refrigerant circuit RC2. The refrigerant leak sensor 40 is preferably disposed inside the usage unit 30 from the viewpoint of promptly detecting the refrigerant flowing out of the usage-side refrigerant circuit RC2. However, the refrigerant leak sensor 40 is not necessarily disposed inside the usage unit 30 as long as it is capable of detecting the refrigerant flowing out of the usage-side refrigerant circuit RC2. For example, the refrigerant leak sensor 40 may be disposed outside the usage unit 30 in the usage-side space SP1.

(6-17) Modification 17

In the foregoing embodiment, the refrigerant leak sensor 40 configured to directly detect the refrigerant leaking out of the usage-side refrigerant circuit RC2 functions as the refrigerant leak detection unit configured to detect a refrigerant leak at the refrigerant circuit RC, more specifically the usage-side refrigerant circuit RC2. However, any sensor rather than the refrigerant leak sensor 40 may be used for detecting a refrigerant leak as long as it is capable of detecting a fact that a refrigerant leak occurs. For example, a refrigerant leak may be detected using a value detected by the refrigerant state sensor disposed in the refrigerant circuit RC. The refrigerant state sensor may be a sensor configured to detect a state of the refrigerant in the refrigerant circuit RC. Examples of such a sensor may include the suction pressure sensor 25, the discharge pressure sensor 26, the discharge temperature sensor 27*a*, the receiver temperature sensor 27*b*, and the liquid level sensor 28. In such a case, the refrigerant state sensor corresponds to the refrigerant leak detection unit.

(6-18) Modification 18

In the foregoing embodiment when the refrigerant leak detection condition is satisfied, the refrigerant leak determination unit 64 determines that a refrigerant leak presumably occurs at the refrigerant circuit RC, more specifically the usage-side refrigerant circuit RC2, and sets the refrigerant leak detection flag M7. The refrigerant leak detection condition is satisfied when the time during which the voltage value concerning the refrigerant leak sensor detection signal, that is, the value detected by the refrigerant leak sensor 40 is equal to or more than the predetermined first reference value SV1 continues for the predetermined time t1 or more. However, the refrigerant leak detection condition is not limited thereto, and may be appropriately changed as long as it is set in a manner capable of detecting occurrence of a refrigerant leak.

For example, in determining a refrigerant leak using a value detected by any refrigerant state sensor rather than the refrigerant leak sensor 40, the refrigerant leak detection condition may be appropriately set in accordance with, for example, a type of the refrigerant in the refrigerant circuit RC, a type of the refrigerant state sensor, design specifications, and installation environments. For example, the refrigerant leak detection condition may be satisfied when a state in which the value detected by the refrigerant state sensor is equal to or more than a predetermined threshold value or is less than the predetermined threshold value continues for a predetermined time.

(6-19) Modification 19

In the foregoing embodiment, when the alert condition is satisfied, the refrigerant leak determination unit 64 determines that the refrigerant may leak at a hazardous concentration in the usage-side space SP1, and sets the alert concentration flag M9. The alert condition is satisfied when the time during which the voltage value concerning the refrigerant leak sensor detection signal, that is, the value detected by the refrigerant leak sensor 40 is equal to or more than the predetermined second reference value SV2 continues for the predetermined time t3 or more in cases where the predetermined time t2 elapses from the completion of the refrigerant leak first control, more specifically the pump down operation. However, the refrigerant leak detection condition is not limited thereto, and may be appropriately changed in accordance with design specifications and installation environments as long as it is set in a manner capable of detecting occurrence of a refrigerant leak. For example, the second reference value SV2 may be set at a value equivalent to a half of an LFL (Lower Flammability Limit) that is a predetermined value V1'.

(6-20) Modification 20

In the foregoing embodiment, when the erroneous detection relevant condition is not satisfied, the erroneous detection determination unit 65 determines that the refrigerant leak sensor 40 correctly detects a refrigerant leak, and sets the refrigerant leak definite determination flag M8. On the other hand, when the erroneous detection relevant condition is satisfied, the erroneous detection determination unit 65 determines that the refrigerant leak sensor 40 erroneously detects a refrigerant leak, and clears the refrigerant leak detection flag M7. The erroneous detection relevant condition is determined based on the value detected by the suction pressure sensor 25, that is, the suction pressure LP. Specifically, the erroneous detection determination unit 65 determines that the erroneous detection relevant condition is satisfied, that is, determines that the refrigerant leak is erroneously detected when the refrigerant leak detection flag M7 is set and the value detected by the suction pressure sensor 25 and stored in the detected value storage region M2, that is, the suction pressure LP upon detection of a refrigerant leak is different from the value equivalent to atmospheric pressure or its approximate value (e.g., 2 kW to 0 kW).

However, the erroneous detection relevant condition may be appropriately changed in accordance with, for example, design specifications and installation environments as long as it is capable of determining whether a refrigerant leak is erroneously detected. For example, the erroneous detection relevant condition may be determined based on a value detected by any other refrigerant state sensor. For example, the erroneous detection relevant condition may be set as follows. Specifically, the erroneous detection relevant condition is satisfied, that is, the erroneous detection determination unit 65 determines that the refrigerant leak sensor 40 erroneously detects a refrigerant leak when the value detected by the liquid level sensor 28 after completion of the pump down operation, that is, the liquid level height HL is equal to or more than a predetermined threshold value. On the other hand, the erroneous detection relevant condition is not satisfied, that is, the erroneous detection determination unit 65 determines that the refrigerant leak sensor 40 correctly detects a refrigerant leak when the value is less than the threshold value.

(6-21) Modification 21

In the foregoing embodiment, the fusible plug state determination unit 66 determines that the fusible plug 22 is in the open state when the fusible plug open estimation condition is satisfied, and sets the fusible plug open flag M10. The fusible plug open estimation condition is satisfied when the situation in which the fusible plug temperature PT is equal to or more than the first temperature Te1 continues for the predetermined time t3, that is, the time elapsed from when the fusible plug 22 is heated to the first temperature Te1 until the fusible plug 22 is brought into the open state. The fusible plug open estimation condition is not limited thereto, and may be appropriately changed in accordance with, for example, design specifications and installation environments as long as it is capable of determining whether the fusible plug 22 is in the open state.

(6-22) Modification 22

In the foregoing embodiment, when the fusible plug malfunction condition is satisfied, the fusible plug state determination unit 66 determines that the fusible plug 22 may malfunction or malfunctions, and sets the fusible plug malfunction flag M11. On the other hand, when the fusible plug malfunction condition is not satisfied, the fusible plug state determination unit 66 clears the fusible plug malfunction flag M11. The fusible plug malfunction condition is satisfied when the situation in which the fusible plug temperature PT in the detected value storage region M2 is equal to or more than the second temperature Te2 continues for the predetermined time t5 on condition that the refrigerant leak definite determination flag M8 is not set. The second temperature Te2 is lower than the first temperature Te1, and takes the value from which it is particularly assumed that the fusible plug 22 is presumably heated to the first temperature Te1 or more.

The fusible plug malfunction condition is not limited thereto, and may be appropriately changed in accordance with, for example, design specifications and installation environments as long as it is capable of determining whether the fusible plug 22 may malfunction or malfunctions.

(6-23) Modification 23

In the foregoing embodiment, the component control unit 67 completes the refrigerant leak first control when the predetermined refrigerant recovery completion condition is satisfied after the start of the refrigerant leak first control, that is, after the start of the pump down operation. The refrigerant recovery completion condition is satisfied when the predetermined time t6, that is, the time from which it is assumed that the pump down operation is completed elapses from the start of the pump down operation.

The refrigerant recovery completion condition is not limited thereto, and may be appropriately changed in accordance with, for example, design specifications and installation environments as long as it is capable of determining whether the pump down operation is completed. For example, the decision as to whether the refrigerant recovery completion condition is satisfied may be made based on the values detected by the various refrigerant state sensors after the start of the pump down operation. For example, the refrigerant recovery completion condition may be set as follows. Specifically, the refrigerant recovery completion condition is satisfied, that is, the component control unit 67 determines that the refrigerant recovery is completed when the value detected by the liquid level sensor 28 after the start of the pump down operation, that is, the liquid level height HL is equal to or more than a predetermined threshold value. On the other hand, the refrigerant recovery completion condition is not satisfied, that is, the component control unit 67 determines that the refrigerant recovery is not completed when the value is less than the threshold value.

(6-24) Modification 24

In the foregoing embodiment, the controller 60 performs the refrigerant leak release control to drive the heat source-side fan F1. The heat source-side fan F1 functions as the fan (corresponding to a second fan in the claims) configured to provide an air flow for promoting a flow of the refrigerant flowing out of the fusible plug 22, toward the external space SP3. However, the second fan is not limited to the heat source-side fan F1. For example, a fan rather than the heat source-side fan F1 may be disposed in the heat source-side space SP2 or the external space SP3. The controller 60 performs the refrigerant leak release control to drive the fan. The fan thus functions as the second fan.

(6-25) Modification 25

In the foregoing embodiment, the hot gas bypass valve 17 is an electric valve. However, the hot gas bypass valve 17 may be any control valve such as an electromagnetic valve as long as it is brought into a closed state and an open state in a switchable manner.

Also in the foregoing embodiment, the backup valve 18 is an electromagnetic valve. However, the hot gas bypass valve 17 may be any control valve, such as an electric valve whose opening degree is adjustable, as long as it is brought into a closed state and an open state in a switchable manner.

(6-26) Modification 26

The configuration of the refrigerant circuit RC in the foregoing embodiment is not limited to that illustrated in FIG. 1, and may be appropriately changed in accordance with design specifications and installation environments.

For example, the heat source-side expansion valve 15 is not necessarily disposed inside the heat source unit 10. For example, the heat source-side expansion valve 15 may be disposed on the liquid side connection pipe L1.

In addition, the heat source-side refrigerant circuit RC1 includes one compressor 11; however, the number of compressors 11 may be appropriately changed in accordance with design specifications. For example, the heat source-side refrigerant circuit RC1 may include two or more compressors 11 arranged in series or in parallel. Of the compressors 11, the number of variable displacement compressors and the number of fixed displacement compressors may be appropriately selected.

In addition, the position where the receiver 13 is disposed may be appropriately changed.

In addition, the usage-side expansion valve 32 is not necessarily a thermostatic expansion valve, and may be any mechanical expansion valve. The usage-side expansion valve 32 may also be an electric valve whose opening degree is controllable.

(6-27) Modification 27

In the foregoing embodiment, the controller 60 causes the remote controller 50 to output the refrigerant leak notification information. The remote controller 50 thus functions as the output unit configured to output predetermined information, that is, notification information such as refrigerant leak notification information. In this respect, the controller 60 may cause a component rather than the remote controller 50 to output the predetermined information. This component thus functions as the output unit.

For example, the controller 60 may cause a loudspeaker capable of audio output to output a predetermined audible alarm or a predetermined voice message as the refrigerant leak notification information. Alternatively, the controller 60 may cause a light source such as a light emitting diode (LED) lamp to blink or light up, thereby outputting the notification information such as the refrigerant leak notification information. Still alternatively, the controller 60 may cause a unit capable of outputting information to output the notification information such as the refrigerant leak notification information in a facility in which the refrigeration apparatus 100 is installed or in a device such as a centralized control device located at a remote place away from the site.

It should be noted that the remote controller 50 may be appropriately omitted if the refrigeration apparatus 100 does not necessarily include the remote controller 50.

(6-28) Modification 28

In the foregoing embodiment, the heat source unit control unit C1 and the usage unit control unit C2 are connected to each other via the communication line cb1 to constitute the controller 60 for controlling the operation of the refrigeration apparatus 100. However, the configuration of the controller 60 is not limited thereto, and may be appropriately changed in accordance with design specifications and installation environments. Specifically, the configuration of the controller 60 is not limited as long as the elements (61 to 69) in the controller 60 are realized. Some of or all the elements (61 to 69) in the controller 60 are not necessarily disposed in one of the heat source unit 10 and the usage unit 30. For example, these elements (61 to 69) may be disposed in any device rather than the heat source unit 10 and the usage unit 30, or may be disposed independently of one another.

For example, the controller 60 may be constituted of one of or both the heat source unit control unit C1 and the usage unit control unit C2 as well as the remote controller 50 and other devices such as a centralized control device. Alternatively, the controller 60 may be constituted of the remote controller 50 and other devices such as a centralized control device in place of one of or both the heat source unit control unit C1 and the usage unit control unit C2. In such a case, the other devices may be located at a remote place connected to the heat source unit 10 or the usage unit 30 via a communication network.

In addition, the controller 60 may be constituted of only the heat source unit control unit C1.

(6-29) Modification 29

In the foregoing embodiment, the idea of the present disclosure is applied to the refrigeration apparatus 100 configured to cool the usage-side space SP1 such as the interior of a prefabricated storage house, the interior of a low-temperature warehouse, the interior of a container for transportation, or the interior of a showcase in a store. In addition, the idea of the present disclosure may also be applicable to any refrigeration apparatus including a refrigerant circuit.

For example, the idea of the present disclosure is applicable to an air conditioning system (an air conditioner) that achieves air conditioning by cooling the interior of a building. For example, the idea of the present disclosure is also applicable to a refrigeration apparatus configured to heat or warm a space where a usage unit 30 is placed, using a usage-side heat exchanger 33 functioning as a condenser or a radiator for a refrigerant, by rearrangement of a four-way switching valve or a refrigerant pipe in the refrigerant circuit RC illustrated in FIG. 1.

(6-30) Modification 30

In the foregoing embodiment, the fusible plug 22 is a screw-shaped part having a through hole filled with a low melting point metal which is an alloy of 63.5% by mass of indium, 35% by mass of bismuth, 0.5% by mass of tin, and 1.0% of antimony. However, the configuration of the fusible plug 22 is not limited thereto, and may be appropriately changed. The fusible plug 22 may have any configuration as long as it is brought into the open state to allow the refrigerant circuit RC to communicate with the external space when being heated to the predetermined first temperature or more by predetermined heating means.

(7)

Although the embodiment has been described above, it will be understood that numerous modifications and variations can be devised without departing from the gist and scope of the claims.

INDUSTRIAL APPLICABILITY

The present disclosure is applicable to a refrigeration apparatus including a refrigerant circuit.

REFERENCE SIGNS LIST

10: heat source unit
11: compressor (heating unit)
12: heat source-side heat exchanger (heat exchanger)
13: receiver (refrigerant reservoir)
14: subcooler
15: heat source-side expansion valve (first control valve)
16: injection valve
17: hot gas bypass valve (second control valve)
18, 18': backup valve (third control valve)
19: first check valve
20: second check valve
21: third check valve
22: fusible plug (refrigerant release mechanism)
23: gas-side shutoff valve
24: liquid side shutoff valve
25: suction pressure sensor (refrigerant state sensor)
26: discharge pressure sensor refrigerant state sensor)
27*a*: discharge temperature sensor (refrigerant state sensor)
27*b*: receiver temperature sensor (refrigerant state sensor)
27*c*: fusible plug temperature sensor (fusible plug temperature detection unit)
27*d*: heater temperature sensor (heating temperature detection unit)
28: liquid level sensor (refrigerant state sensor)
29: refrigerant release valve (refrigerant release mechanism)
30: usage unit
31: heating pipe
32: usage-side expansion valve
33: usage-side heat exchanger
40: refrigerant leak sensor (refrigerant leak detection unit)
50: remote controller (output unit)
60: controller (control unit)
61: storage unit
62: input control unit
63: mode control unit
64: refrigerant leak determination unit
65: erroneous detection determination unit erroneous detection decision unit)
66: fusible plug state determination unit
67: component control unit (control unit)
68: drive signal output unit
69: display control unit
71: first electromagnetic valve
72: second electromagnetic valve
80: electric heater (heating unit)
85: heater (heating unit)
90: fusible plug heating unit (heating unit)
88, 91: on-off valve
92: second on-off valve
100, 100*a* to 100*k*: refrigeration apparatus
141: first flow path
142: second flow path
AF1: heat source-side air flow (air flow, second air flow)
AF2: usage-side air flow
C1: heat source unit control unit
C2: usage unit control unit
CV: check valve
F1: heat source-side fan (fan, second fan)
F2: usage-side fan
G1: gas-side connection pipe
P1: first gas-side refrigerant pipe (discharge pipe)
P1': branch pipe
P2: liquid-side refrigerant pipe
P3: second gas-side refrigerant pipe
P4: injection pipe
P5, P5'; hot gas pipe (high-pressure refrigerant pipe, heating unit)
P6: bypass pipe
P7, P7': fusible plug mount pipe (heating unit)
P8: first liquid-side refrigerant pipe
P9: second liquid-side refrigerant pipe
P10: gas-side refrigerant pipe
Pa, Pb: refrigerant pipe
PT: fusible plug temperature
RC, RC': refrigerant circuit
RC1: heat source-side refrigerant circuit
RC2: usage-side refrigerant circuit (usage-side circuit)
SP1: usage-side space
SP2: heat source-side space
SP3: external space
SV1: first reference value
SV2: second reference value
Te1: first temperature
Te2: second temperature
cb1: communication line
t2: predetermined time (first time)

CITATION LIST

Patent Literature

Patent Literature 1: JP H05-118720 A

The invention claimed is:

1. A refrigeration apparatus having a refrigerant circuit including a heat source side circuit and a usage-side circuit, for a refrigeration cycle in the refrigerant circuit, the refrigeration apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the refrigerant releaser is a fusible plug that melts by heat at a predetermined first temperature or more so as to be brought into the open state, the heat source side circuit of the refrigeration apparatus further comprising:

a heater configured to directly or independently apply heat to the fusible plug, and a heating temperature detector configured to detect a temperature of the heater, wherein the controller performs the second control to cause the heater to apply heat to the fusible plug to the first temperature, and the controller performs the second control to control a state of the heater based on a value detected by the heating temperature detector.

2. A refrigeration apparatus having a refrigerant including a heat source side circuit and a usage-side circuit, for a refrigeration cycle in the refrigerant circuit, the refrigerant apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the refrigerant releaser is a fusible plug that melts by heat at a predetermined first temperature or more so as to be brought into the open state, the heat source side circuit of the refrigeration apparatus further comprising:

a heater configured to directly or indirectly apply heat to the fusible plug, and a high-pressure refrigerant pipe through which the high-pressure hot gas refrigerant discharged from the compressor flows; and a second control valve to be brought into a first state to allow the compressor to communicate with the high-pressure refrigerant pipe, wherein the controller performs the second control to cause the heater to apply heat to the fusible plug to the first temperature, and the controller performs the second control to drive the compressor and to bring the second control valve into the first state such that the high-pressure refrigerant pipe functions as the heater.

3. A refrigeration apparatus having a refrigerant circuit including a heat source side circuit and a usage-side circuit, for a refrigerant cycle in the refrigerant circuit, the refrigerant apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit, a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the refrigerant releaser is s fusible plug that melts by heat at a predetermined first temperature or more so as to be brought into the open state, the heat source side circuit of the refrigeration apparatus further comprising:

a heater configured to directly or indirectly apply heat to the fusible plug, a fusible plug temperature detector configured to detect a temperature of the fusible plug; and an output unit configured to output predetermined notification information, wherein the controller performs the second control to cause the heater to apply heat to the fusible plug to the first temperature, and the controller causes the output unit to output the notification information when the refrigerant leak detector detects no refrigerant leak at the usage-side circuit and the fusible plug temperature detector detects that the temperature of the fusible plug is equal to or more than a second temperature lower than the first temperature.

4. A refrigeration apparatus having a refrigerant circuit including a heat source side circuit and a user-side circuit, for refrigeration cycle in the refrigerant circuit, the refrigerant apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit, a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the refrigerant releaser is s fusible plug that melts by heat at a predetermined first temperature or more so as to be brought into the open state, the heat source side circuit of the refrigeration apparatus further comprising:

a heater configured to directly or indirectly apply heat to the fusible plug, and a fusible plug temperature detector configured to detect a temperature of the fusible plug, wherein the controller performs a third control when the refrigerant leak detector detects no refrigerant leak at the usage-side circuit and the fusible plug temperature detector detects that the temperature of the fusible plug is equal to or more than a second temperature lower than the first temperature, and the controller performs the third control to suppress the temperature of the fusible plug being greater than or equal to the first temperature by controlling the states of the respective components.

5. A refrigeration apparatus having a refrigerant circuit including a heat source side circuit and a usage-side circuit, for refrigeration cycle in the refrigerant circuit, the refrigeration apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the refrigerant releaser is a fusible plug that melts by heat at a predetermined first temperature or more so as to be brought into the open state, the heat source side circuit of the refrigeration apparatus further comprising:

a heater configured to directly or independently apply heat to the fusible plug, a fusible plug temperature detector configured to detect a temperature of the fusible plug; and a third control valve disposed in the refrigerant circuit and configured to control a flow rate of the refrigerant flowing toward the fusible plug, in accordance with an opening degree thereof, wherein the controller performs the second control to bring the refrigerant releaser into the open state, the controller performs the second control after performing the first control, and the controller minimizes the opening degree of the third control valve when the refrigerant leak detector detects no refrigerant leak at the usage-side circuit and the fusible plug temperature detector detects that the temperature of the fusible plug is equal to or more than a second temperature lower than the first temperature.

6. A refrigeration apparatus having a refrigerant circuit including a heat source side circuit and a usage-side circuit, for a refrigeration cycle in the refrigerant circuit, the refrigerant apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, the heat source side circuit of the refrigeration apparatus further comprising:

a heat exchanger disposed between a discharge pipe for the compressor and the refrigerant releaser in the refrigerant circuit, and configured to function as a radiator for the refrigerant by causing the refrigerant to exchange heat with an air flow; and a fan configured to provide the air flow, wherein the controller performs the second control to stop the fan.

7. A refrigeration apparatus having a refrigerant circuit including a heat source side circuit and a usage-side circuit, for a refrigerant cycle in the refrigerant circuit, the refrigeration apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a second fan configured to provide a second air flow directed to the external space from a space where the refrigerant releaser is disposed, a controller configured to control states of the respective components; and a refrigerant leak detector configured to detect a refrigerant leak at the usage-side circuit by detecting a state of the refrigerant in the usage-side circuit or the refrigerant flowing out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the controller drives the second fan after completion of the second control.

8. A refrigeration apparatus having a refrigerant circuit including a heat source side circuit and a usage-side circuit, for refrigeration cycle in the refrigerant circuit, the refrigerant apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the controller performs the second control after a lapse of a first time from completion of the first control, and the first time is calculated based on an amount of the refrigerant passing through the first control valve brought into the closed state, in accordance with a characteristic of the first control valve, and is set to a length required for the refrigerant to reach a concentration of a predetermined value in a usage-side space where the usage-side circuit is disposed.

9. A refrigeration apparatus having a refrigerant circuit including a heat source circuit and a usage-side circuit, for a refrigeration cycle in the refrigerant circuit, the refrigeration circuit comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the usage-side circuit, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, the refrigerant leak detector detects a concentration of the refrigerant leaking out of the usage-side circuit, and outputs to the controller a detection signal for identifying the detected concentration of the refrigerant, and the controller performs the first control when the concentration of the refrigerant based on the detection signal takes a value equal to or more than a first reference value, and performs the second control when the concentration of the refrigerant based on the detection signal takes a value equal to or more than a second reference value larger than the first reference value.

10. A refrigeration apparatus having a refrigeration circuit including a heat source side circuit and a usage-side circuit, for a refrigeration cycle in the refrigerant circuit, the refrigeration apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the usage-side circuit;

a refrigerant state sensor configured to detect a state of the refrigerant in the refrigerant circuit; and an erroneous detection decider configured to make a decision as to whether the refrigerant leak detector erroneously detects a refrigerant leak, based on a value detected by the refrigerant state sensor, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, and the controller performs the second control when the erroneous detection decider decides that there is no erroneous detection.

11. The refrigeration apparatus according to claim 1, wherein the refrigerant circuit includes a plurality of the usage-side circuits, and the refrigerant release mechanism and a plurality of the first control valves are disposed upstream of the each usage-side circuit with regard to the flow of the refrigerant.

12. The refrigeration apparatus according to claim 2, further comprising:

an electric heater to be brought into a heating state in which the electric heater generates heat by energization, wherein the controller performs the second control to bring the electric heater into the heating state such that the electric heater functions as the heater unit.

13. The refrigeration apparatus according to claim 2, further comprising:

a heating temperature detector configured to detect a temperature of the heater, wherein the controller performs the second control to control a state of the heater, based on a value detected by the heating temperature detector.

14. A refrigeration apparatus having a refrigerant circuit including a heat source side circuit and a usage-side circuit, fir a refrigeration cycle in the refrigerant circuit, the refrigeration apparatus comprising:

a compressor disposed in the refrigerant circuit and configured to compress a refrigerant;

a first control valve to be controlled to be brought into a closed state in which the first control valve maximizes prevention of a flow of the refrigerant toward the usage-side circuit, the first control valve being disposed upstream of the usage-side circuit with regard to a flow of the refrigerant in the refrigerant circuit;

a refrigerant releaser to be brought into an open state to allow the refrigerant circuit to communicate with an external space, the refrigerant releaser being disposed in the refrigerant circuit;

a controller configured to control states of the respective components; and a refrigerant leak detector configured to detect a refrigerant leak at the usage-side circuit by detecting a state of the refrigerant in the usage-side circuit or the refrigerant flowing out of the usage-side circuit, an electric heater to be brought into a heating state in which the electric heater generates heat by energization; and a heating temperature detector configured to detect a temperature of the heater, wherein the controller performs a first control and a second control when the refrigerant leak detector detects a refrigerant leak at the usage-side circuit, the controller performs the first control to bring the first control valve into the closed state, the controller performs the second control to bring the refrigerant releaser into the open state, the controller performs the second control after performing the first control, the controller performs the second control to bring the electric heater into the heating state such that the electric heater functions as the heating unit, and the controller performs the second control to control a state of the heater, based on a value detected by the heating temperature detector.

15. The refrigeration apparatus according to claim 2, further comprising:

a fusible plug temperature detector configured to detect a temperature of the fusible plug; and an output configured to output predetermined notification information, wherein the controller causes the output to output the notification information when the refrigerant leak detector detects no refrigerant leak at the usage-side circuit and the fusible plug temperature detector detects that the temperature of the fusible plug is equal to or more than a second temperature lower than the first temperature.

* * * * *